US012490840B2

(12) United States Patent
Telford

(10) Patent No.: US 12,490,840 B2
(45) **Date of Patent: *Dec. 9, 2025**

(54) ADJUSTABLE CHILD CARRIER

(71) Applicant: The ERGO Baby Carrier, Inc., Torrance, CA (US)

(72) Inventor: Rodney V. Telford, Torrance, CA (US)

(73) Assignee: The ERGO Baby Carrier, Inc., Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/243,500

(22) Filed: Sep. 7, 2023

(65) Prior Publication Data

US 2023/0414011 A1 Dec. 28, 2023

Related U.S. Application Data

(63) Continuation of application No. 18/136,979, filed on Apr. 20, 2023, now Pat. No. 11,786,055, which is a continuation of application No. 18/108,979, filed on Feb. 13, 2023, which is a continuation of application No. 17/349,821, filed on Jun. 16, 2021, now Pat. No. 11,583,104, which is a continuation of application No. 16/551,286, filed on Aug. 26, 2019, now Pat. No. 11,051,634, which is a continuation of application No. 15/337,813, filed on Oct. 28, 2016, now Pat. No. 10,426,275.

(60) Provisional application No. 62/248,745, filed on Oct. 30, 2015.

(51) Int. Cl.
*A47D 13/02* (2006.01)

(52) U.S. Cl.
CPC ..... *A47D 13/025* (2013.01)

(58) Field of Classification Search
CPC ..... A47D 13/025
USPC ..... 224/159
See application file for complete search history.

(56) References Cited

U.S. PATENT DOCUMENTS

| | | | |
|---|---|---|---|
| 268,932 | A | 12/1882 | Poirier |
| 569,258 | A | 10/1896 | Walker |
| 576,292 | A | 2/1897 | Vanderburgh |
| 632,887 | A | 9/1899 | Voncanon |
| 982,376 | A | 1/1911 | Macfarlane |
| 1,026,489 | A | 5/1912 | Blake |
| 2,212,746 | A | 8/1940 | Nunn |

(Continued)

FOREIGN PATENT DOCUMENTS

| | | | |
|---|---|---|---|
| AT | 11620 | U2 | 2/2011 |
| AU | 2003275751 | A1 | 6/2004 |

(Continued)

OTHER PUBLICATIONS

Feb. 2002 forum post from "USA", 2 pgs., retrieved from http://windsorpeak.com/vbulletin/ showthread.php7 I 85 543-baby- bjornand-large-husband.

(Continued)

*Primary Examiner* — Peter N Helvey
(74) *Attorney, Agent, or Firm* — Erise IP, P.A.

(57) ABSTRACT

An adjustable child carrier includes an adjustable bucket seat that can be adjusted to accommodate children of a wide range of sizes. The child carrier includes one or more adjustments that work alone or in cooperation to adjust the depth and width of the bucket seat area provided by the child carrier. The carrier is capable of supporting children of various sizes in an ergonomic position appropriate for the child's size.

30 Claims, 9 Drawing Sheets

(56) References Cited

U.S. PATENT DOCUMENTS

| | | | |
|---|---|---|---|
| 2,599,474 | A | 6/1952 | Mills |
| 2,994,300 | A | 8/1961 | Josephine |
| 3,097,773 | A | 7/1963 | Arthur |
| 3,229,873 | A | 1/1966 | Hershman |
| 3,275,373 | A | 9/1966 | Card |
| 3,327,914 | A | 6/1967 | Abram |
| 3,481,517 | A | 12/1969 | Aukerman |
| 3,780,919 | A | 12/1973 | Hansson |
| 3,840,162 | A | 10/1974 | Horenstein et al. |
| 3,871,562 | A | 3/1975 | Grenier |
| 3,964,654 | A | 6/1976 | Wittenberger |
| 4,009,808 | A | 3/1977 | Sharp |
| D247,199 | S | 2/1978 | Carter |
| 4,139,131 | A | 2/1979 | Hathaway |
| 4,149,687 | A | 4/1979 | Nunemacher |
| D253,558 | S | 12/1979 | Carter |
| 4,234,229 | A | 11/1980 | Arnold |
| 4,273,215 | A | 6/1981 | Leggett |
| 4,318,502 | A | 3/1982 | Lowe et al. |
| 4,324,430 | A | 4/1982 | Dimas et al. |
| 4,333,591 | A | 6/1982 | Case |
| D266,800 | S | 11/1982 | Kula et al. |
| 4,361,259 | A | 11/1982 | Chanter |
| 4,402,440 | A | 9/1983 | Purtzer et al. |
| 4,434,920 | A | 3/1984 | Moore |
| 4,467,945 | A | 8/1984 | Schaapveld |
| 4,469,259 | A | 9/1984 | Krich et al. |
| 4,479,595 | A | 10/1984 | Opsal |
| D276,478 | S | 11/1984 | Fallon |
| 4,480,775 | A | 11/1984 | Stanford |
| 4,492,326 | A | 1/1985 | Storm |
| D277,811 | S | 3/1985 | Moore |
| 4,550,800 | A | 11/1985 | Dietrich |
| 4,579,264 | A | 4/1986 | Napolitano |
| 4,651,366 | A | 3/1987 | Lande et al. |
| 4,666,017 | A | 5/1987 | Zimmerman |
| 4,724,988 | A | 2/1988 | Tucker |
| 4,746,044 | A | 5/1988 | Arvizu et al. |
| 4,765,279 | A | 8/1988 | Klickstein |
| 4,800,629 | A | 1/1989 | Ikeda |
| 4,867,464 | A | 9/1989 | Cook |
| 4,946,119 | A | 8/1990 | Hellhake |
| 4,986,458 | A | 1/1991 | Linday |
| 5,071,047 | A | 12/1991 | Cordisco |
| 5,076,598 | A | 12/1991 | Nauman |
| D324,607 | S | 3/1992 | Nelson |
| 5,114,059 | A | 5/1992 | Thatcher |
| 5,129,406 | A | 7/1992 | Magnusen et al. |
| D334,253 | S | 3/1993 | Balzarini |
| 5,205,450 | A | 4/1993 | Derosier |
| 5,205,451 | A | 4/1993 | Manzer |
| 5,224,637 | A | 7/1993 | Colombo |
| 5,240,159 | A | 8/1993 | Gregory |
| 5,246,152 | A | 9/1993 | Dotseth |
| 5,284,279 | A | 2/1994 | Sason et al. |
| 5,325,818 | A | 7/1994 | Leach |
| D357,800 | S | 5/1995 | Roan et al. |
| 5,490,620 | A | 2/1996 | Bergqvist |
| D370,996 | S | 6/1996 | Shimura et al. |
| 5,522,528 | A | 6/1996 | Petricola |
| 5,564,612 | A | 10/1996 | Gregory |
| 5,570,823 | A | 11/1996 | Lindy |
| D377,116 | S | 1/1997 | Shimura et al. |
| D385,105 | S | 10/1997 | Fair |
| 5,673,828 | A | 10/1997 | Raedel et al. |
| 5,678,739 | A | 10/1997 | Darling et al. |
| 5,690,258 | A | 11/1997 | Kataoka |
| 5,692,655 | A | 12/1997 | Fair et al. |
| 5,699,555 | A | 12/1997 | Schunter |
| 5,725,139 | A | 3/1998 | Smith |
| 5,732,861 | A | 3/1998 | Jakobson |
| D395,161 | S | 6/1998 | Fair et al. |
| 5,772,088 | A | 6/1998 | Nelson |
| 5,791,535 | A | 8/1998 | Roan et al. |
| D397,867 | S | 9/1998 | Fair et al. |
| 5,799,851 | A | 9/1998 | Wulf et al. |
| 5,813,580 | A | 9/1998 | Fair |
| 5,819,341 | A | 10/1998 | Simantob et al. |
| 5,848,576 | A | 12/1998 | Colaianni |
| 5,848,741 | A | 12/1998 | Fair |
| 5,927,235 | A | 7/1999 | Olaiz |
| 5,934,528 | A | 8/1999 | Higuchi |
| D414,032 | S | 9/1999 | Howell |
| 5,988,742 | A | 11/1999 | Stevens |
| 6,055,686 | A | 5/2000 | Knight |
| 6,073,820 | A | 6/2000 | Drobinski |
| 6,079,780 | A | 6/2000 | Bapst |
| 6,125,792 | A | 10/2000 | Gee |
| 6,155,579 | A | 12/2000 | Eyman et al. |
| 6,164,509 | A | 12/2000 | Gausling et al. |
| 6,179,175 | B1 | 1/2001 | Painter |
| D437,996 | S | 2/2001 | Fair et al. |
| 6,182,873 | B1 | 2/2001 | Christopher et al. |
| 6,257,468 | B1 | 7/2001 | Yamazoe et al. |
| D453,066 | S | 1/2002 | Norman |
| D455,546 | S | 4/2002 | Norman |
| 6,364,186 | B1 | 4/2002 | Gilmour et al. |
| 6,409,060 | B2 | 6/2002 | Donine |
| 6,415,969 | B1 | 7/2002 | Higuchi |
| 6,443,339 | B1 | 9/2002 | Higuchi |
| 6,499,165 | B1 | 12/2002 | Morgillo |
| 6,520,391 | B2 | 2/2003 | Yen |
| 6,598,771 | B2 | 7/2003 | Norman |
| 6,609,642 | B2 | 8/2003 | Heinz et al. |
| D484,685 | S | 1/2004 | Kassai et al. |
| 6,681,973 | B2 | 1/2004 | Crumrine |
| D486,635 | S | 2/2004 | Yagisawa |
| 6,715,651 | B2 | 4/2004 | Gal |
| 6,722,543 | B1 | 4/2004 | Fitzgerald et al. |
| 6,736,299 | B2 | 5/2004 | Bergkvist et al. |
| 6,763,983 | B2 | 7/2004 | Norman |
| 6,772,925 | B2 | 8/2004 | O'Hare |
| D507,869 | S | 8/2005 | Liistro et al. |
| D509,056 | S | 9/2005 | Shiraishi et al. |
| 7,007,353 | B2 | 3/2006 | Bergkvist et al. |
| 7,070,076 | B2 | 7/2006 | Bergkvist et al. |
| 7,073,866 | B1 | 7/2006 | Berdahl |
| 7,168,600 | B2 | 1/2007 | Hwang |
| 7,204,462 | B2 | 4/2007 | Lembo |
| 7,204,468 | B2 | 4/2007 | Kintzele et al. |
| 7,255,620 | B1 | 8/2007 | Shepherd et al. |
| 7,284,503 | B2 | 10/2007 | Elmberg |
| 7,322,498 | B2 | 1/2008 | Frost |
| 7,343,880 | B2 | 3/2008 | Bergkvist |
| D567,499 | S | 4/2008 | Elmberg et al. |
| 7,494,031 | B2 | 2/2009 | Kassai et al. |
| D590,568 | S | 4/2009 | Crutchfield |
| D597,788 | S | 8/2009 | Ellis |
| D615,750 | S | 5/2010 | Jones et al. |
| D619,818 | S | 7/2010 | Bergkvist |
| 7,766,199 | B1 | 8/2010 | Caperon |
| 7,779,490 | B2 | 8/2010 | Bergkvist |
| 7,780,236 | B2 | 8/2010 | Bergkvist |
| D623,401 | S | 9/2010 | Bergkvist et al. |
| D623,402 | S | 9/2010 | Bergkvist et al. |
| D627,141 | S | 11/2010 | Elmberg et al. |
| D632,887 | S | 2/2011 | Jones et al. |
| 7,878,587 | B1 | 2/2011 | Leach |
| 7,886,946 | B2 | 2/2011 | Gray |
| D634,584 | S | 3/2011 | Bergkvist |
| 8,028,871 | B2 | 10/2011 | Gray |
| 8,042,869 | B2 | 10/2011 | McClintock et al. |
| D647,693 | S | 11/2011 | Olegård et al. |
| D649,345 | S | 11/2011 | Bergkvist et al. |
| D653,938 | S | 2/2012 | Bergkvist |
| D655,495 | S | 3/2012 | Sauer et al. |
| 8,127,385 | B1 | 3/2012 | Goutevenier |
| D656,749 | S | 4/2012 | Bergkvist |
| 8,172,116 | B1 | 5/2012 | Lehan et al. |
| D662,778 | S | 7/2012 | Sauer et al. |
| D664,351 | S | 7/2012 | Bergkvist et al. |
| 8,272,546 | B2 | 9/2012 | Leistensnider |
| D678,693 | S | 3/2013 | Bergkvist et al. |
| 8,403,189 | B2 | 3/2013 | Nyberg et al. |

(56) References Cited

U.S. PATENT DOCUMENTS

| | | | |
|---|---|---|---|
| 8,408,435 | B2 | 4/2013 | Refsum |
| 8,424,732 | B1 | 4/2013 | Lehan et al. |
| D683,654 | S | 6/2013 | Andren et al. |
| 8,453,894 | B2 | 6/2013 | Jung et al. |
| D692,227 | S | 10/2013 | Andren et al. |
| D692,680 | S | 11/2013 | Bergkvist et al. |
| 8,579,168 | B2 | 11/2013 | Zack et al. |
| 8,590,757 | B2 | 11/2013 | Frost |
| 8,627,988 | B2 | 1/2014 | Bergkvist |
| 8,636,181 | B2 | 1/2014 | Gunter et al. |
| 8,650,663 | B2 | 2/2014 | Fair et al. |
| 8,701,949 | B1 | 4/2014 | Lehan et al. |
| 8,726,437 | B2 | 5/2014 | Hardesty |
| 8,745,794 | B1 | 6/2014 | McDermott |
| 8,752,739 | B2 | 6/2014 | Bergkvist et al. |
| 8,756,728 | B2 | 6/2014 | Bergkvist |
| 8,789,882 | B2 | 7/2014 | Bergkvist |
| 8,973,794 | B2 | 3/2015 | Bergkvist et al. |
| 9,022,260 | B2 | 5/2015 | Frost |
| D733,419 | S | 7/2015 | Wikner et al. |
| 9,179,758 | B2 | 11/2015 | Calilung et al. |
| 9,185,993 | B2 | 11/2015 | Telford et al. |
| 9,220,352 | B2 | 12/2015 | Frost |
| 9,314,113 | B1 | 4/2016 | Lehan |
| 9,357,852 | B2 | 6/2016 | Salazar et al. |
| 9,357,854 | B2 | 6/2016 | Sundberg et al. |
| 9,380,887 | B2 | 7/2016 | Frost |
| 9,380,888 | B2 | 7/2016 | Telford et al. |
| 9,439,515 | B2 | 9/2016 | Kim |
| D773,838 | S | 12/2016 | Ejvinsson et al. |
| D785,325 | S | 5/2017 | Samrelius et al. |
| D786,363 | S | 5/2017 | Andrén |
| D789,160 | S | 6/2017 | Strandberg et al. |
| 9,675,141 | B2 | 6/2017 | Wikner et al. |
| 9,713,391 | B2 | 7/2017 | Telford et al. |
| 9,788,664 | B2 | 10/2017 | Andren et al. |
| D803,549 | S | 11/2017 | Warfaa et al. |
| D807,025 | S | 1/2018 | Elmberg et al. |
| 9,877,595 | B2 | 1/2018 | Wang |
| 9,877,596 | B2 | 1/2018 | Schaarschmidt |
| D811,082 | S | 2/2018 | Lehan |
| 9,955,797 | B2 | 5/2018 | Telford et al. |
| D828,997 | S | 9/2018 | Lehan |
| 10,076,194 | B2 | 9/2018 | Wikner et al. |
| D832,602 | S | 11/2018 | Elmberg et al. |
| 10,159,357 | B2 | 12/2018 | Frost |
| 10,172,478 | B2 | 1/2019 | Telford et al. |
| 10,264,895 | B2 | 4/2019 | Lindeman et al. |
| 10,271,663 | B2 | 4/2019 | Salazar et al. |
| D850,804 | S | 6/2019 | Andersson et al. |
| D851,916 | S | 6/2019 | Andersson et al. |
| 10,313,929 | B2 | 6/2019 | Bhamidipati et al. |
| 10,426,275 | B2 | 10/2019 | Telford |
| 10,433,656 | B2 | 10/2019 | Lundh |
| 10,441,090 | B2 | 10/2019 | Lehan |
| 10,506,885 | B2 | 12/2019 | Telford et al. |
| D879,413 | S | 3/2020 | Ejvinsson et al. |
| D879,414 | S | 3/2020 | Ejvinsson et al. |
| 10,653,251 | B1 | 5/2020 | Young |
| D886,667 | S | 6/2020 | Andersson et al. |
| D891,295 | S | 7/2020 | Andersson et al. |
| 10,702,074 | B2 | 7/2020 | Najafi et al. |
| 10,736,436 | B2 | 8/2020 | Telford |
| 10,743,678 | B2 | 8/2020 | Salazar et al. |
| D899,130 | S | 10/2020 | Dolk et al. |
| 10,874,178 | B2 | 12/2020 | Cheng |
| 10,905,252 | B2 | 2/2021 | Fan et al. |
| 10,905,253 | B2 | 2/2021 | Fan |
| D913,683 | S | 3/2021 | Björkenkvist et al. |
| 11,026,519 | B2 | 6/2021 | Fan |
| 11,026,520 | B2 | 6/2021 | Fan |
| 11,026,521 | B2 | 6/2021 | Telford et al. |
| 11,039,695 | B2 | 6/2021 | Fan |
| 11,051,634 | B2 | 7/2021 | Telford |
| D930,976 | S | 9/2021 | Andersson et al. |
| D933,356 | S | 10/2021 | Elmberg |
| 11,191,368 | B2 | 12/2021 | Manouchehri et al. |
| 11,219,317 | B2 | 1/2022 | Telford |
| 11,272,791 | B2 | 3/2022 | Warner |
| 11,297,957 | B2 | 4/2022 | Telford |
| D954,156 | S | 6/2022 | Hoxter et al. |
| D955,102 | S | 6/2022 | Kleremo et al. |
| 11,357,337 | B2 | 6/2022 | Dolk et al. |
| 11,440,444 | B2 | 9/2022 | Shahbandar |
| D975,993 | S | 1/2023 | Kleremo et al. |
| 11,583,104 | B2 | 2/2023 | Telford |
| D980,623 | S | 3/2023 | Kleremo et al. |
| D984,117 | S | 4/2023 | Fan |
| 11,684,175 | B2 | 6/2023 | Telford |
| 11,759,027 | B2 | 9/2023 | Cheng |
| 11,786,055 | B2 | 10/2023 | Telford |
| 2002/0011503 | A1 | 1/2002 | Hwang |
| 2002/0158433 | A1 | 10/2002 | Naurois et al. |
| 2002/0175194 | A1 | 11/2002 | Norman |
| 2003/0106916 | A1 | 6/2003 | Boone |
| 2003/0178452 | A1 | 9/2003 | Norman |
| 2004/0066066 | A1 | 4/2004 | Hobson |
| 2004/0149790 | A1 | 8/2004 | Kassai et al. |
| 2004/0155078 | A1 | 8/2004 | Hwang |
| 2004/0238579 | A1 | 12/2004 | Krogh |
| 2005/0045674 | A1 | 3/2005 | Rehbein |
| 2005/0067549 | A1 | 3/2005 | Kintzele et al. |
| 2005/0155995 | A1 | 7/2005 | Lee |
| 2005/0184114 | A1 | 8/2005 | Hoff et al. |
| 2005/0242136 | A1 | 11/2005 | Moriguchi et al. |
| 2005/0279785 | A1 | 12/2005 | Liistro et al. |
| 2006/0011678 | A1 | 1/2006 | Kassai et al. |
| 2006/0076373 | A1 | 4/2006 | LaBelle et al. |
| 2006/0130220 | A1 | 6/2006 | Morgan et al. |
| 2006/0261104 | A1 | 11/2006 | Zambrzycki |
| 2007/0029356 | A1 | 2/2007 | Moriguchi et al. |
| 2007/0057003 | A1 | 3/2007 | Keyes |
| 2007/0185370 | A1 | 8/2007 | Eyck |
| 2007/0241146 | A1 | 10/2007 | Nyberg et al. |
| 2007/0293656 | A1 | 12/2007 | Caravan et al. |
| 2008/0047987 | A1 | 2/2008 | Price |
| 2008/0190972 | A1 | 8/2008 | Gray |
| 2008/0283561 | A1 | 11/2008 | Parness et al. |
| 2009/0165209 | A1 | 7/2009 | Bergkvist |
| 2009/0256408 | A1 | 10/2009 | Bergkvisit |
| 2010/0025441 | A1 | 2/2010 | Blaney |
| 2010/0072236 | A1 | 3/2010 | Parness et al. |
| 2010/0147910 | A1 | 6/2010 | Schachtner |
| 2010/0187269 | A1 | 7/2010 | Leistensnider |
| 2010/0308087 | A1 | 12/2010 | Lindbloom |
| 2010/0308088 | A1 | 12/2010 | Lindblom |
| 2011/0062195 | A1 | 3/2011 | Jones et al. |
| 2011/0101051 | A1 | 5/2011 | Parness et al. |
| 2011/0163136 | A1 | 7/2011 | Billingham |
| 2011/0219539 | A1 | 9/2011 | Bergkvist |
| 2011/0290831 | A1 | 12/2011 | Wang |
| 2012/0025569 | A1 | 2/2012 | Bergkvist |
| 2012/0037284 | A1 | 2/2012 | Korbonski |
| 2012/0043359 | A1 | 2/2012 | Bergkvist et al. |
| 2012/0061429 | A1 | 3/2012 | Sauer |
| 2012/0187161 | A1 | 7/2012 | Bergkvist |
| 2012/0187162 | A1 | 7/2012 | Bergkvist et al. |
| 2012/0205406 | A1 | 8/2012 | Schachtner |
| 2012/0241487 | A1 | 9/2012 | Zack et al. |
| 2012/0298702 | A1 | 11/2012 | Jung et al. |
| 2014/0014692 | A1 | 1/2014 | Andren et al. |
| 2014/0097215 | A1 | 4/2014 | Caperon |
| 2014/0167462 | A1 | 6/2014 | Lai et al. |
| 2014/0263491 | A1 | 9/2014 | Telford et al. |
| 2014/0284361 | A1 | 9/2014 | Wang |
| 2014/0319189 | A1 | 10/2014 | Hoppener-Visser |
| 2015/0069097 | A1 | 3/2015 | Lindblom |
| 2015/0181984 | A1 | 7/2015 | Wikner et al. |
| 2015/0208821 | A1 | 7/2015 | Frost |
| 2015/0223614 | A1 | 8/2015 | Pos |
| 2015/0272342 | A1 | 10/2015 | Schaarschmidt |
| 2015/0374139 | A1 | 12/2015 | Salazar et al. |
| 2016/0015187 | A1 | 1/2016 | Telford et al. |
| 2016/0150893 | A1 | 6/2016 | Salazar et al. |

(56) References Cited

U.S. PATENT DOCUMENTS

| | | | |
|---|---|---|---|
| 2016/0227940 | A1 | 8/2016 | Wikner et al. |
| 2016/0270555 | A1 | 9/2016 | Telford et al. |
| 2016/0278537 | A1 | 9/2016 | Frost |
| 2016/0296034 | A1 | 10/2016 | Telford |
| 2016/0316933 | A1 | 11/2016 | Antunovic |
| 2017/0119173 | A1 | 5/2017 | Telford |
| 2017/0150826 | A1 | 6/2017 | Salazar et al. |
| 2017/0196374 | A1 | 7/2017 | Chen |
| 2017/0251829 | A1 | 9/2017 | Telford et al. |
| 2018/0000258 | A1 | 1/2018 | Lehan |
| 2018/0011642 | A1 | 1/2018 | Koseki et al. |
| 2018/0116426 | A1 | 5/2018 | Telford |
| 2018/0184813 | A1 | 7/2018 | Salazar et al. |
| 2018/0192788 | A1 | 7/2018 | Telford et al. |
| 2018/0199730 | A1 | 7/2018 | Lundh |
| 2018/0206653 | A1 | 7/2018 | Andrus et al. |
| 2018/0235379 | A1 | 8/2018 | Lindeman et al. |
| 2018/0296005 | A1 | 10/2018 | Tsai |
| 2019/0014920 | A1 | 1/2019 | Matsuyama |
| 2019/0075936 | A1 | 3/2019 | Salazar et al. |
| 2019/0075937 | A1 | 3/2019 | Salazar et al. |
| 2019/0090657 | A1 | 3/2019 | Telford et al. |
| 2019/0150633 | A1 | 5/2019 | Flaunty et al. |
| 2019/0223619 | A1 | 7/2019 | Lindeman et al. |
| 2019/0350379 | A1 | 11/2019 | Antunovic |
| 2019/0380508 | A1 | 12/2019 | Telford |
| 2020/0077806 | A1 | 3/2020 | Telford et al. |
| 2020/0146464 | A1 | 5/2020 | Manouchehri et al. |
| 2020/0163466 | A1 | 5/2020 | Telford |
| 2020/0253392 | A1 | 8/2020 | Sahadi et al. |
| 2020/0268169 | A1 | 8/2020 | Telford |
| 2021/0059431 | A1 | 3/2021 | Elmberg |
| 2021/0186234 | A1 | 6/2021 | Dolk et al. |
| 2021/0361079 | A1 | 11/2021 | Salazar et al. |
| 2021/0393049 | A1 | 12/2021 | Telford |
| 2022/0151398 | A1 | 5/2022 | Telford |
| 2022/0176853 | A1 | 6/2022 | Shahbandar |
| 2023/0248122 | A1 | 8/2023 | Cheng |

FOREIGN PATENT DOCUMENTS

| | | | |
|---|---|---|---|
| AU | 307890 | S | 7/2006 |
| AU | 2006229579 | A1 | 10/2006 |
| AU | 317278 | S | 12/2007 |
| AU | 317280 | S | 12/2007 |
| AU | 321713 | S | 10/2008 |
| AU | 328480 | S | 11/2009 |
| AU | 328481 | S | 11/2009 |
| AU | 2009318191 | A1 | 5/2010 |
| AU | 331275 | S | 6/2010 |
| AU | 332115 | S | 8/2010 |
| AU | 337726 | S | 7/2011 |
| AU | 345573 | S | 11/2012 |
| AU | 346297 | S | 1/2013 |
| AU | 2012209531 | A1 | 7/2013 |
| AU | 2012209532 | A1 | 7/2013 |
| AU | 354989 | S | 4/2014 |
| AU | 2013287314 | A1 | 1/2015 |
| AU | 362724 | S | 7/2015 |
| AU | 363250 | S | 8/2015 |
| AU | 363251 | S | 8/2015 |
| AU | 364610 | S | 10/2015 |
| AU | 367544 | S | 3/2016 |
| AU | 2015377212 | A1 | 8/2017 |
| AU | 201812916 | S | 6/2018 |
| AU | 201812917 | S | 6/2018 |
| AU | 201814272 | S | 8/2018 |
| AU | 201816523 | S | 11/2018 |
| AU | 201816866 | S | 1/2019 |
| AU | 2018385917 | A1 | 7/2020 |
| AU | 2019224931 | A1 | 9/2020 |
| CA | 181917 | S | 1/1918 |
| CA | 182729 | S | 3/1918 |
| CA | 1332928 | C | 11/1994 |
| CA | 2159241 | A1 | 3/1996 |
| CA | 2240015 | A1 | 1/2000 |
| CA | 132510 | S | 5/2010 |
| CA | 132511 | S | 5/2010 |
| CA | 148380 | S | 8/2013 |
| CA | 149046 | S | 11/2013 |
| CA | 154976 | A | 9/2014 |
| CA | 2739444 | C | 7/2015 |
| CA | 2971848 | A1 | 7/2016 |
| CA | 2755425 | C | 1/2017 |
| CA | 2822606 | C | 1/2018 |
| CA | 175255 | S | 4/2018 |
| CA | 179896 | S | 1/2019 |
| CA | 3091109 | A1 | 8/2019 |
| CA | 2822551 | C | 10/2019 |
| CA | D185008 | S | 11/2019 |
| CA | 2878911 | S | 3/2020 |
| CA | 2878933 | C | 8/2020 |
| CA | 181660 | S | 9/2020 |
| CA | 3160906 | A1 | 11/2022 |
| CN | 102378588 | A | 3/2012 |
| CN | 203873395 | U | 10/2014 |
| CN | 104411213 | A | 3/2015 |
| CN | 104470406 | A | 3/2015 |
| CN | 204363531 | U | 6/2015 |
| CN | 105377085 | A | 3/2016 |
| CN | 106263837 | A | 1/2017 |
| CN | 108135370 | A | 6/2018 |
| CN | 108244885 | A | 7/2018 |
| CN | 109480542 | A | 3/2019 |
| CN | 109480543 | A | 3/2019 |
| CN | 110897429 | A | 3/2020 |
| CN | 111712162 | A | 9/2020 |
| CN | 111885949 | A | 11/2020 |
| CN | 114668265 | A | 6/2022 |
| CN | 115399601 | A | 11/2022 |
| CZ | 2010531 | A3 | 1/2012 |
| DE | 29519530 | U1 | 2/1996 |
| DE | 22912951 | U1 | 1/2000 |
| DE | 20116046 | U1 | 1/2002 |
| DE | 202008014412 | U1 | 3/2009 |
| DE | 602007005645 | | 5/2010 |
| DE | 602008000939 | | 5/2010 |
| DE | 202010011906 | U1 | 11/2010 |
| DE | 202011103052 | U1 | 8/2011 |
| DE | 10767394 | | 10/2012 |
| DE | 202012104318 | U1 | 11/2012 |
| DE | 202014100616 | U1 | 5/2014 |
| DK | 10767394 | T2 | 7/2014 |
| EP | 0046672 | A1 | 3/1982 |
| EP | 0437365 | A1 | 7/1991 |
| EP | 0662292 | B1 | 7/1998 |
| EP | 995380 | A1 | 4/2000 |
| EP | 1055382 | A1 | 11/2000 |
| EP | 1591044 | A1 | 11/2005 |
| EP | 1707082 | A1 | 10/2006 |
| EP | 1893058 | A1 | 3/2008 |
| EP | 1992257 | A1 | 11/2008 |
| EP | 2037777 | A1 | 3/2009 |
| EP | 2037778 | B1 | 3/2009 |
| EP | 2229079 | A1 | 9/2010 |
| EP | 1765123 | B1 | 6/2011 |
| EP | 2346378 | A1 | 7/2011 |
| EP | 2413747 | A1 | 2/2012 |
| EP | 2413748 | A1 | 2/2012 |
| EP | 2421413 | A1 | 2/2012 |
| EP | 2667747 | A1 | 12/2013 |
| EP | 2667748 | A1 | 12/2013 |
| EP | 2810587 | A1 | 12/2014 |
| EP | 2872011 | A1 | 5/2015 |
| EP | 2872012 | A1 | 5/2015 |
| EP | 3054813 | A1 | 8/2016 |
| EP | 3244778 | A1 | 11/2017 |
| EP | 3723556 | A1 | 10/2020 |
| EP | 3755183 | A1 | 12/2020 |
| EP | 4094639 | A1 | 11/2022 |
| ES | 251704 | U | 10/1980 |
| ES | 2343215 | | 7/2010 |
| ES | 2382645 | | 6/2012 |
| ES | 2437222 | | 1/2014 |

(56) References Cited

FOREIGN PATENT DOCUMENTS

| | | | |
|---|---|---|---|
| ES | 2527676 | | 1/2015 |
| ES | 2531641 | | 3/2015 |
| ES | 2582469 | | 9/2016 |
| ES | 2585565 | | 10/2016 |
| ES | 2644318 | | 11/2017 |
| ES | 2823558 | | 5/2021 |
| ES | 2868448 | | 10/2021 |
| ES | 2889755 | | 1/2022 |
| FR | 1545820 | A | 11/1968 |
| FR | 2524288 | A1 | 10/1983 |
| FR | 2794010 | B1 | 7/2001 |
| FR | 2806279 | A3 | 9/2001 |
| FR | 2823655 | A1 | 10/2002 |
| FR | 2851436 | A1 | 8/2004 |
| GB | 2028633 | A | 3/1980 |
| GB | 2026848 | B | 9/1982 |
| GB | 2260687 | A | 4/1993 |
| GB | 2314026 | B | 12/1999 |
| GB | 2346314 | A | 8/2000 |
| ID | 201800806 | A | 1/2018 |
| IL | 199975 | | 4/2010 |
| IL | 196219 | A | 8/2012 |
| JP | 11978146441 | | 4/1953 |
| JP | 53146441 | | 12/1978 |
| JP | 53155443 | | 12/1978 |
| JP | 54108131 | | 8/1979 |
| JP | 63187956 | | 12/1988 |
| JP | 172158 | A | 5/1989 |
| JP | 2124107 | | 5/1990 |
| JP | 09099842 | | 10/1995 |
| JP | 9121987 | | 5/1997 |
| JP | 09173185 | | 7/1997 |
| JP | 10108764 | | 4/1998 |
| JP | 10313929 | | 12/1998 |
| JP | 11046938 | | 2/1999 |
| JP | 3073766 | U | 12/2000 |
| JP | 2001104115 | A | 4/2001 |
| JP | 2002186543 | A | 7/2002 |
| JP | 3403599 | B2 | 5/2003 |
| JP | 10201580 | A | 5/2003 |
| JP | 2003225119 | A1 | 8/2003 |
| JP | 2004000687 | A | 1/2004 |
| JP | 2004154468 | A | 6/2004 |
| JP | 2005052584 | A | 3/2005 |
| JP | 2005118472 | A | 5/2005 |
| JP | 2005131146 | A | 5/2005 |
| JP | 2005185426 | A | 7/2005 |
| JP | 2005288107 | A | 10/2005 |
| JP | 2005312823 | A | 11/2005 |
| JP | 2005312826 | A | 11/2005 |
| JP | 4170894 | B2 | 10/2008 |
| JP | 3154408 | U | 10/2009 |
| JP | 2010524605 | A | 7/2010 |
| JP | 2012152547 | A | 8/2012 |
| JP | 2012152548 | A | 8/2012 |
| JP | 2012187352 | A | 10/2012 |
| JP | 2012524603 | A | 10/2012 |
| JP | 2013118900 | A | 6/2013 |
| JP | 2014018658 | A | 2/2014 |
| JP | 2014176494 | A | 9/2014 |
| JP | 5859841 | B2 | 2/2016 |
| JP | 5895766 | B2 | 3/2016 |
| JP | 2016512124 | A | 4/2016 |
| JP | 5921273 | B2 | 5/2016 |
| JP | 5960429 | B2 | 8/2016 |
| JP | 6130251 | B2 | 5/2017 |
| JP | 2018149349 | A | 9/2018 |
| JP | 2018531745 | A | 11/2018 |
| JP | 6485931 | B2 | 3/2019 |
| JP | 6530576 | B1 | 6/2019 |
| JP | 2019088891 | A | 6/2019 |
| KR | 2000508690000 | | 10/2000 |
| KR | 1020020008534 | A | 1/2002 |
| KR | 2003126950000 | | 4/2003 |
| KR | 2003158200000 | | 6/2003 |
| KR | 2003182590000 | | 6/2003 |
| KR | 2003201940000 | | 7/2003 |
| KR | 200324019 | Y1 | 8/2003 |
| KR | 2003337880000 | | 11/2003 |
| KR | 1020040064749 | A | 7/2004 |
| KR | 20060047603 | A | 5/2006 |
| KR | 1020070039806 | A | 4/2007 |
| KR | 2020090008715 | A | 1/2009 |
| KR | 200447518 | Y1 | 1/2010 |
| KR | 2020100010120 | U | 10/2010 |
| KR | 2020110005263 | U | 5/2011 |
| KR | 20110132580 | A | 12/2011 |
| KR | 101134560 | B1 | 4/2012 |
| KR | 200459659 | Y1 | 4/2012 |
| KR | 1020120070544 | A | 6/2012 |
| KR | 200462354 | Y1 | 9/2012 |
| KR | 101197918 | B1 | 11/2012 |
| KR | 1020130107167 | A | 10/2013 |
| KR | 101426751 | B1 | 8/2014 |
| KR | 20150030251 | A | 3/2015 |
| KR | 101525284 | B1 | 6/2015 |
| KR | 200477837 | Y1 | 7/2015 |
| KR | 1020160112243 | A | 9/2016 |
| KR | 101764566 | B1 | 8/2017 |
| KR | 101834054 | B1 | 3/2018 |
| KR | 20180031827 | A | 3/2018 |
| KR | 101929748 | B1 | 12/2018 |
| KR | 102022746 | B1 | 11/2019 |
| KR | 20200095511 | A | 8/2020 |
| KR | 20200123120 | A | 10/2020 |
| KR | 1020200119904 | A | 10/2020 |
| NO | 339506 | B1 | 12/2016 |
| NO | 20064841 | A | 12/2016 |
| NZ | 733728 | A | 7/2017 |
| PH | 12017501292 | A1 | 2/2018 |
| PH | 12022050229 | B | 4/2023 |
| SE | 0802427 | A1 | 5/2010 |
| SE | 533133 | C2 | 7/2010 |
| SE | 0900412 | A1 | 10/2010 |
| SE | 0900413 | A1 | 10/2010 |
| SE | 0900414 | A1 | 10/2010 |
| SE | 533613 | C2 | 11/2010 |
| SE | 533615 | C2 | 11/2010 |
| SE | 533616 | C2 | 11/2010 |
| SE | 0950955 | A1 | 6/2011 |
| SE | 534383 | C2 | 8/2011 |
| SE | 1150048 | A1 | 7/2012 |
| SE | 1150050 | A1 | 7/2012 |
| SE | 535533 | C2 | 9/2012 |
| SE | 535534 | C2 | 9/2012 |
| SE | 1250817 | A1 | 1/2014 |
| SE | 1250818 | A1 | 1/2014 |
| SE | 536591 | C2 | 3/2014 |
| SE | 536668 | C2 | 5/2014 |
| SE | 1351182 | A1 | 4/2015 |
| SE | 538604 | C2 | 9/2016 |
| SE | 1550298 | A1 | 9/2016 |
| SE | 1550352 | A1 | 9/2016 |
| SE | 538763 | C2 | 11/2016 |
| SE | 540206 | C2 | 5/2018 |
| SE | 1751550 | A1 | 6/2019 |
| SE | 1850189 | A1 | 8/2019 |
| SE | 541460 | C2 | 10/2019 |
| SE | 542422 | C2 | 4/2020 |
| SG | 127135 | A1 | 12/2006 |
| SG | 11201705794 | A | 8/2017 |
| TW | 200913922 | A | 4/2009 |
| TW | 201034603 | A | 10/2010 |
| TW | 201039779 | A | 11/2010 |
| TW | 201039781 | A | 11/2010 |
| TW | 201105273 | A | 2/2011 |
| TW | 201332466 | A | 8/2013 |
| TW | 202233104 | A | 9/2022 |
| WO | 199505952 | | 3/1995 |
| WO | 199505952 | A1 | 3/1995 |
| WO | 2001089978 | A1 | 11/2001 |
| WO | 2006116117 | | 11/2006 |
| WO | 2009034233 | A1 | 3/2009 |
| WO | 2010123447 | A1 | 10/2010 |

(56) References Cited

FOREIGN PATENT DOCUMENTS

| | | | |
|---|---|---|---|
| WO | 2011011158 | A2 | 1/2011 |
| WO | 2011071441 | A1 | 6/2011 |
| WO | 2012079787 | A1 | 6/2012 |
| WO | 2012109467 | A1 | 8/2012 |
| WO | 2013079296 | A1 | 6/2013 |
| WO | 2014033134 | A1 | 3/2014 |
| WO | 2014160355 | A1 | 10/2014 |
| WO | 20150053696 | A1 | 4/2015 |
| WO | 2016153411 | A1 | 9/2016 |
| WO | 2017075500 | A1 | 5/2017 |
| WO | 2017095752 | A1 | 6/2017 |
| WO | 2018081603 | A1 | 5/2018 |
| WO | 2020112660 | A1 | 6/2020 |
| WO | 2020163585 | A1 | 8/2020 |
| WO | 2022136029 | A1 | 6/2022 |

OTHER PUBLICATIONS

File History for European Patent Application No. 04783725.7, filed Sep. 10, 2004, 693 pages.
File History for U.S. Appl. No. 10/937, 193, filed Sep. 9, 2004, 135 pages.
File History for U.S. Appl. No. 14/685,235, filed Apr. 13, 2015, 460 pages.
File History for U.S. Trademark U.S. Appl. No. 75/457,187, filed Mar. 25, 1998, 72 pages.
First Journey Brochure, www.first-journey.com, 2002, 2 pages.
Frame Carriers, 1 pg., retrieved from https://web.archive.org/web/2 0000 5 26184 5 3 5/http ://www.evenflo.com/ ep/fumiture/framecarrier. phtml.
Gebrauchsanweisung (User's Manual), Weego Baby Carrier, 4 pages.
Gebrauchsanweisung (User's Manual), Weego Baby Carrier, 4 pgs.
"Why Choose the Wilkin et?," http://www.wilkinet.co.uk/WhyChoose. asp, Apr. 17, 2003, 2 pgs.
Gilligan, Shannon, Best for Baby: A Selective Consumer's Guide to Products and Services from Infancy to Preschool, 1988, pp. 41-46.
Guide to the Ann Moore Innovative Lives Presentation, 1999, Archives Center, National Museum of American History, Smithsonian Institute, Aug. 2010, 12 pgs., retrieved from http://amhistory.si.edu/ archives/ AC0706.pdf).
Harman et al., "The Effects of Backpack Weight on the Biomechanics of Load Carriage," Military Division, U.S. Army Research Institute of Environmental Medicine, May 3, 2000, 72 pages.
Hinrichs, et al., "An Investigation of the Inertial Properties of Backpacks Loaded in Various Configurations", United States Army Natick, Research and Development Laboratories, Natick, MA, 1982, 75 pgs.
Hodgson, A.R., "Congenital Dislocation of the Hip", British Medical Journal, Sep. 7, 1961, p. 647.
Holewijn, Michael, "Physiological Strain Due to Load Carrying," European Journal of Applied Physiology and Occupational Physiology, Feb. 1990, 10 pages.
http ://www.kelty.com/Kelty/index.cfm?fuseaction=Kids.ShowProduct &type=carrier&ID=I2, Aug. 5, 2002, 1 page.
http:/ /koti.welho.com/skoivune/english/guide/ohje3.html, May 1, 2003, 1 page.
http:/ /koti.welho.com/skoivune/sakara/english/about/index.html, Apr. 30, 2003, 2 pgs.
http:/ /koti.welho.com/skoivune/sakara/english/guide/index. html>>, Jun. 28, 2003, 1 page.
http:/ /koti.welho.com/skoivune/sakara/english/guide/ohje2.html, May 1, 2003, 1 page.
http:/ /koti.welho.com/skoivune/sakara/english/guide/ohje3.html, May 1, 2003, 1 page.
http:/ /koti.welho.com/skoivune/sakara/english/order/index.html, Apr. 30, 2003, 1 page.
http:/ /koti.welho.corn/skoivune/sakara/english/index html, Jun. 24, 2003, 2 pages.
http://koti.welho.com/skoivune/sakara/index2.html, Jun. 20, 2003, 2 pages.
http://koti.welho.com/skoivune/sakara/ohje/ohje4.htrnl, May 2, 2003, 1 page.
http://koti.welho.com/skoivune/sakara/ohje/ohje6.html, May 29, 2003, 1 page.
http://koti.welho.com/skoivune/sakara/ohje/ohje7.html, May 9, 2003, 1 page.
http://koti.welho.com/skoivune/sakara/sakarat/index.html, Apr. 30, 2003, 2 pages.
http://www.weego.com/acatalog/ool.html, Jun. 5, 2002, 3 pages.
http://www.weego.com/coinf.html, Aug. 6, 2002, 2 pages.
http://www.weego.com/fabric.htrnl, Nov. 2, 2001, 2 pages.
http://www.weego.com/preem.html, Aug. 6, 2002, 2 pages.
http://www.weego.com/product.html, Dec. 11, 2001, 1 page.
http://www.weego.de/ english/trageposition.htm, Apr. 23, 2004, 1 page.
http://www.weego.de/024.htm, Aug. 12, 2003, 1 page.
http://www.weego.de/english/024.htm, Apr. 23, 2004, 1 page.
http://www.weego.de/english/design.htm, Mar. 24, 2004, 1 page.
http://www.weego.de/english/interaktiv.htm, Jul. 3, 2004, 1 page.
http://www.weego.de/english/ortho.htm, Jun. 1, 2004, 1 page.
Infantino, Flip 4-in-1 Convertible Carrier Instruction Manual, 2018, www.info@Blue-box.com.
Infantino, Flip 4-in-1 Convertible Carrier Instruction Manual, 2022, www.infantino.com.
Initial Determination on Violation of Section 337 and Recommended Determination on Remedy and Bond, In re Matter of Certain Child Carriers, United States International Trade Commission, Inv. No. 337-TA-1154, Mar. 10, 2020, 210 pgs.
International Preliminary Report on Patentability (Ch. 1) for International Application No. PCT/US2019/063052, dated May 25, 2021, 4 pgs.
International Preliminary Report on Patentability (Ch. I) for International Patent Application No. PCT/US2014/026378, dated Sep. 15, 2015, 6 pgs.
International Preliminary Report on Patentability (IPRP) issued for International Application No. PCT/US2017/058820, dated May 9, 2019, 11 pages.
International Preliminary Report on Patentability and Written Opinion for PCT/US2016/59534, dated May 1, 2018, 6 pgs.
International Preliminary Report on Patentability for PCT /US2004/ 029614, dated Mar. 13, 2006, 7 pgs.
International Search Report and Written Opinion for International Application No. PCT/US2014/026378, dated Jul. 21, 2014, 10 pgs.
International Search Report and Written Opinion for International Application No. PCT/US2019/063052, dated May 25, 2021, 8 pgs.
International Search Report and Written Opinion for International Patent Application No. PCT/US17/58820, dated Jan. 5, 2018, 12 pgs.
Appendix RR: baby Trekker System Invalidity Chart, *The Ergo Baby Carrier, Inc.* v. *BOBA Inc.*, Case No. 2:15-cv-08946, In the United States District Court for the Central District of California, Jul. 15, 2016, 14 pgs.
Appendix RRR: U.S. Pat. No. 4,434,920 ("Moore") Invalidity Chart, *The Ergo Baby Carrier, Inc.* v. *BOBA Inc.*, Case No. 2: 15-cv-08946, In the United States District Court for the Central District of California, Jul. 15, 2016, 2 pgs.
Appendix S: Kozy System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix SS: First Journey System Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix SSS: "A Static Biomechanical Load Carriage Model" by R.P. Pelot et al., Presented in Jun. 2000 ("Pelot") Invalidity Chart, *The Ergo Baby Carrier, Inc.* v. *BOBA Inc.*, Case No. 2: 15-cv-08946, In the United States District Court for the Central District of California, Jul. 15, 2016, 11 pgs.

(56) References Cited

OTHER PUBLICATIONS

Appendix T: Packababy System Invalidity Chart, *The Ergo Baby Carrier, Inc*. v. *BOBA Inc*., Case No. 2:15-cv-08946, In the United States District Court for the Central District of California, Jul. 15, 2016, 19 pgs.
Appendix TT: French Patent Pub. No. 2794010 ("Ducruet") Invalidity Chart, *The Ergo Baby Carrier, Inc*. v. *BOBA Inc*., Case No. 2: 15-cv-08946, In the United States District Court for the Central District of California, Jul. 15, 2016, 5 pgs.
Appendix TTT: Pony Ride Invalidity Chart, *The Ergo Baby Carrier, Inc*. v. *BOBA Inc*., Case No. 2:15-cv-08946, In the United States District District of California, Jul. 15, 2016, 4 pgs.
Appendix U: Sakara System Invalidity Chart, *The Ergo Baby Carrier, Inc*. v. *BOBA Inc*., Case No. 2:15-cv-08946, In the United States District Court for the Central District of California, Jul. 15, 2016, 18 pgs.
Appendix UU: U.S. Pat. No. 4,986,458 ("Linday") Invalidity Chart, *The Ergo Baby Carrier, Inc*. v. *BOBA Inc*., Case No. 2: 15-cv-08946, In the United States District Court for the Central District of California, Jul. 15, 2016, 15 pgs.
Appendix UUU: U.S. Pat. No. 5,114,059 ("Thatcher") Invalidity Chart, *The Ergo Baby Carrier, Inc*. v. *BOBA Inc*., Case No. 2: 15-cv-08946, In the United States District Court for the Central District of California, Jul. 15, 2016, 3 pgs.
Appendix V: Sutemi System Invalidity Chart, *The Ergo Baby Carrier, Inc*. v. *BOBA Inc*., Case No. 2:15-cv-08946, In the United States District Court for the Central District of California, Jul. 15, 2016, 14 pgs.
Appendix VV: U.S. Pat. No. 4,469,259 ("Krich") Invalidity Chart, *The Ergo Baby Carrier, Inc*. v. *BOBA Inc*., Case No. 2: 15-cv-08946, In the United States District Court for the Central District of California, Jul. 15, 2016, 5 pgs.
Appendix VVV: Weego System Invalidity Chart, *The Ergo Baby Carrier, Inc*. v. *BOBA Inc*., Case No. 2:15-cv-08946, In the United States District Court for the Central District of California, Jul. 15, 2016, 18 pgs.
Appendix W: Casses Invalidity Chart, *The Ergo Baby Carrier, Inc*. v. *BOBA Inc*., Case No. 2: 15-cv-08946, In the United States District Court for the Central District of California, Jul. 15, 2016, 6 pgs.
Appendix WW: "A Blue-Jean Person Pack" by E.A. Byrnes as published on p. 164 of the May/Jun. 1982 issue of the Mother Earth News ("Byrnes") Invalidity Chart, *The Ergo Baby Carrier, Inc*. v. *BOBA Inc*., Case No. 2:15-cv-08946, In the United States District Court for the Central District of California, Jul. 15, 2016, 17 pgs.
Appendix WWW: U.S. Pat. No. 6,257,468 ("Yamazoe") Invalidity Chart, *The Ergo Baby Carrier, Inc*. v. *BOBA Inc*., Case No. 2: 15-cv-08946, In the United States District Court for the Central District of California, Jul. 15, 2016, 2 pgs.
Appendix X: U.S. Pat. No. 6,182,873 ("Christopher") Invalidity Chart, *The Ergo Baby Carrier, Inc*. v. *BOBA Inc*., Case No. 2: 15-cv-08946, In the United States District Court for the Central District of California, Jul. 15, 2016, 4 pgs.
Appendix XX: EP Patent No. 0437365 ("Gunderman") Invalidity Chart, *The Ergo Baby Carrier, Inc*. v. *BOBA Inc*., Case No. 2: 15-cv-08946, In the United States District Court for the Central District of California, Jul. 15, 2016, 14 pgs.
Appendix Y: U.S. Pat. No. 6,155,579 ("Eyman") Invalidity Chart, *The Ergo Baby Carrier, Inc*. v. *BOBA Inc*., Case No. 2: 15-cv-08946, In the United States District Court for the Central District of California, Jul. 15, 2016, 4 pgs.
Appendix YY: K wik Sew Pattern No. 1046 ("K wik Sew") Invalidity Chart, *The Ergo Baby Carrier, Inc*. v. *BOBA Inc*., Case No. 2:15-cv-08946, In the United States District Court for the Central District of California, Jul. 15, 2016, 16 pgs.
Appendix Z: U.S. Pat. No. 5,848,741 ("Fair") Invalidity Chart, *The Ergo Baby Carrier, Inc*. v. *BOBA Inc*., Case No. 2: 15-cv-08946, In the United States District Court for the Central District of California, Jul. 15, 2016, 4 pgs.
Appendix ZZ: Japanese Patent Publication No. S53-155443 ("The '443 Patent") Invalidity Chart, *The Ergo Baby Carrier, Inc*. v. *BOBA Inc*., Case No. 2: 15-cv-08946, in the United States District Court for the Central District of California, Jul. 15, 2016, 10 pgs.
Apprica, Baby strap "Laclis Laclis", Baby Products Apprica Official Website Sep. 2023, https:// www.aprica.jp/products/sling/detail/sling/laclis/, Japan.
Aronson, D.D. et al., "Developmental dysplasia of the hip", Pediatrics, Aug. 1994, vol. 94(2), 202, 11 pgs.
Assorted Photos, U.S. Appl. No. 60/501,396, filed Sep. 10, 2003, 3 pages.
Baby Matey Soft Baby Carriers Literature, Kidpower Unlimited Inc., Toronto, ON, CA, 10 pgs.
Baby Trekker—Advantages, 2 pgs., retrieved from https://web.archive.org/web/20000708141511/http://www.babytrekker.com/ advantages.html.
Baby Trekker Instruction Manual, Pettersen Infant Products, Canada, 16 pages.
Baby Trekker Instruction Manual, Pettersen Infant Products, Canada, 1998, 16 pages.
Bach, John, "Practical Inventor Influenced American Culture", University of Cincinnati UC Magazine, Aug. 2010, 6 pgs.
Blaffer Hardy, S., Family Planning Primate Style, Mother Nature—A History of Mothers, Infants and Natural Selection, 2000, pp. 197-204.
BOBA, Inc.'s First Amended Counterclaims for Declaration of Unenforceability, Invalidity, and Monopolization, *The Ergo Baby Carrier, Inc*. v. *BOBA Inc*., Case No. 2:15-cv-08946, in the United States District Court for the Central District of California, May 23, 2016, 73 pgs.
Brewer, Gail S., A Quick Guide for Starting Right, Baby Carriers, Right from the Start: Meeting the Challenges of Mothering Your Unborn and Newborn Baby, 1981, pp. 159-160.
Byrnes, E.A., "A Blue-Jean 'Person Pack': Toting the Tot on the Trail", The Mother Earth News, No. 75, May/Jun. 1982, p. 164.
Casses, R., "Infant Carriers and Spinal Stress," http://continuumconcept.org/reading/spinalstress.html, Jun. 16, 2002, 3 pages.
Certified Translation of "What parents should watch out for when buying babywearing carriers" by Kirkiliones, retrieved from http://web.archive.org/web/20010719033I 13/http://www.continuum-concept.de/liedkir.htm).
Cessnock Eagle and South Mattland Recorder, vol. 32, No. 4162, Jun. 22, 1944, <>, 1 page.
Chancellor, N., "It's a Shoulder Style," The Sydney Morning Herald, https://www.newspapers.com/image/123869066, Jun. 24, 1947, 1 page.
Chinese Patent Application No. 201780075232.5, Office Action dated May 10, 2022.
Coff, H., "Cut Scheduling for Optimum Fabric Utilization in Apparel Production," Georgia Institute of Technology, Nov. 1976, 141 pages.
Commission Investigative Staff's Initial Post-Hearing Brief, In re Matter of Certain Child Carriers, United States International Trade Commission, Inv. No. 337-TA-1154, Jan. 13, 2020, 124 pgs.
Commission Investigative Staff's Pre-Hearing Brief, In re Matter of Certain Child Carriers, United States International Trade Commission, Inv. No. 337-TA-1154, Nov. 20, 2019, 195 pgs.
Commission Investigative Staff's Reply Post-Hearing Brief, In re Matter of Certain Child Carriers, United States International Trade Commission, Inv. No. 337-TA-1154, Jan. 22, 2020, 26 pgs.
Complainant's Post-Hearing Initial Brief, In re Matter of Certain Child Carriers, United States International Trade Commission, Inv. No. 337-TA-1154, Jan. 6, 2020, 147 pgs.
Complainant's Post-Hearing Responsive Brief, In re Matter of Certain Child Carriers, United States International Trade Commission, Inv. No. 337-TA-1154, Jan. 17, 2020, 85 pgs.
Complainant's Pre-Hearing Brief, In re Matter of Certain Child Carriers, United States International Trade Commission, Inv. No. 337-TA-1154, Nov. 21, 2019, 852 pgs.
Complaint, *The Ergo Baby Carrier, Inc*. v. *BOBA Inc*., Case No. 2:15-cv-08946, In the United States District Court for the Central District of California, filed Nov. 17, 2015, 7 pgs.
Constance, M., "Backpacking the Baby," The Sydney Morning Herald, https://www.newspapers.com/image/120542968, Dec. 1, 1988, 1 page.

(56) References Cited

OTHER PUBLICATIONS

Corrected Notice of Allowability for U.S. Appl. No. 15/796,422, dated May 30, 2019, 6 pgs.
Office Action for U.S. Appl. No. 16/694,641, dated Mar. 17, 2021, 17 pgs.
Office Action Issued for Chinese Patent Application No. 201480023993.2, dated Jan. 11, 2017, 20 pages.
Office Action issued for Chinese Patent Application No. 201480023993.2, dated Sep. 26, 2017, 5 pages.
Office Action issued for European Patent Application No. 14773586.4, dated Oct. 12, 2017, 5 pages.
Office Action Issued for Japanese Patent Application No. 2016-502118, dated Apr. 7, 2017, 9 pages.
Office Action Issued for U.S. Appl. No. 15/177,114, dated Oct. 3, 2017, 5 pages.
Office Action with English translation for Chinese Patent Application No. 201680071536.X, dated Apr. 7, 2021, 18 pgs.
Office Action with English translation for Japanese Patent Application No. 2018-521974, dated Oct. 24, 2019, 7 pgs.
Office Action with English translation for Japanese Patent Application No. 2019-523098, dated May 31, 2021, 13 pgs.
Office Action with English translation for Korean Patent Application No. 10-2020-7029046, dated Jun. 2, 2021, 8 pgs.
Packababy, 17 pgs., retrieved from Web Archives of http://www.packababy.com/.
Peekara Story, https://blog.naver.com/becocarrier/140212053895 >, 2022.
Pelot, R.P. et al., "A Static Biomechanical Load Carriage Model", RTO HFM Specialist Meeting on Soldier Mobility Innovation in Load Carriage System Design and Evaluation, Kingston, CA, Jun. 27-29, 2000, 13 pgs.
Pelot, Ron P., et al., "Background Document for an Advanced Personal Load Carriage System for the Canadian Forces", Ergonomics Research Group, Queen's University, Kingston, ON, CA, Mar. 29, 1995, 148 pgs.
Petition for Inter Partes Review of U.S. Pat. No. 8,590,757, 100 pgs.
Petition for Inter Partes Review of U.S. Pat. No. 9,022,260, 94 pgs.
Preliminary Invalidity Contentions, *The Ergo Baby Carrier, Inc.* v. *BOBA Inc.*, Case No. 2:15-cv-08946, in the United States District Court for the Central District of California, Jul. 15, 2016, 18 pgs.
Rafelman, Rachel, The Portable Baby, Baby Gear for the First Year, 1997, pp. 40-41.
REI—Kelty Kangaroo Child Carrier, 2 pgs., retrieved from https://web.archive.org/web/19970222133805/http://rei.com/shopping/store3/CAMPING/BABY_CARRIERS/BABY_CARRIERS/bud/617589.html.
Respondent's Post-Hearing Initial Brief, In re Matter of Certain Child Carriers, United States International Trade Commission, Inv. No. 337-TA-1154, Jan. 6, 2020, 102 pgs.
Respondent's Post-Hearing Responsive Brief, In re Matter of Certain Child Carriers, United States International Trade Commission, Inv. No. 337-TA-1154, Jan. 28, 2020, 127 pgs.
Respondent's Pre-Hearing Brief, In re Matter of Certain Child Carriers, United States International Trade Commission, Inv. No. 337-TA-1154, Nov. 8, 2019, 405 pgs.
Rose, Marion, Baby Carriers—Cultural History, Aware Parenting, Dec. 8, 2006, 11 pgs., retrieved from http://awareparenting.blogspot.corn/2006/12/baby-carriers-cultural-history.html.
Roseman, E., et al., Baby Carriers, The Canadian Parents' Sourcebook, 1986, at pp. 149-153.
Salter, R.B., "Etiology, Pathogenesis and Possible Prevention of Congenital Dislocation of the Hip", The Canadian Medical Association Journal, vol. 98, No. 20, May 18, 1968.
Santa Cruz Sentinel, https://www.newspapers.com/image/71319712, Jul. 26, 1987, 1 page.
SSC Instructions, <<http://www.isara.ro/en/content/7-instructiunissc», Copyright 2016 ISARA, 12 pgs.
Tentative Ruling on Claim Construction, U.S. Pat. Nos. 8,590,757 and 9,022,260, *The Ergo Baby Carrier, Inc.* v. *BOBA Inc.*, Case No. 2: 15-cv-08946, in the United States District Court for the Central District of California, Dec. 1, 2016, 11 pgs.
The Age, Mar. 5, 1970 at p. 14. Certified Translation of "What parents should watch out for when buying babywearing carriers" by Kirkiliones, retrieved from http://web.archive.org/web/20010719033I 13/http://www.continuum -concept.de/liedkir.htm).
The Beginning Ergo Baby Blog, 13 pgs., retrieved from https://blog.ergobaby.com/2011/02/the-beginning/).
The Kozy Family, 16 pgs., retrieved from the Web Archive of http://www.kozycarrier.homestead.com/.
Tough Traveler, Kidsystems, 3 pgs., retrieved from http://web.archive.org/web/20011106132550/http://www.toughtraveler.com/ cat7.html.
U.S. Appl. No. 60/501,396, filed Sep. 10, 2003, 9 pgs.
U.S. Appl. No. 75/057,147 Documents, U.S. Patent and Trademark Office, 44 pgs.
U.S. Appl. No. 17/572,084, Final Office Action dated Jul. 10, 2023.
U.S. Appl. No. 18/202,058, Non-Final Office Action dated Aug. 14, 2023.
Warren, A.J., "The Mom Who Invented the Snugli", CBS News, Mar. 6, 2001, 4 pgs., retrieved from http://www.cbsnews.com/news/the-mom-whoinvented-the- snugli/.
Weego Soft Baby Carrier, Instructions for Use, Weego Babytragesacke, Berlin, DE, 4 pages.
Welcome to Sutemigear, 10 pgs., retrieved from Web Archives of http://sutemigear.com/.
Wilkin et—Product Views, http://www.wilkinet.co.uk/BabyCarriers.asp, Feb. 17, 2003, 2 pages.
Wilkinet—Faq, http://www.wilkinet.co.uk/FAQs.asp, Feb. 17, 2003, 3 pages.
Wilkinet—History of the Wilkinet Baby Carrier, http://www.wilkinet.co.uk/History.asp, Feb. 17, 2003, 3 pages.
Wilkinet—Instructional Videos, http://www.wilkinet.co.uk/Videos.asp, Feb. 18, 2003, 2 pages.
Wilkinet—Reviews and Testimonials, http://www.wilkinet.co.uk/ReviewsParents.asp, Feb. 18, 2003, 2 pages.
Constance, S., "Backpacking the Baby" Sydney Morning Herald, Dec. 1, 1998, 3 pages.
Wormleighton, A., "Baby Gifts: To Sew, Applique, Crochet and Knit," Copyright Marshall Cavendish Limited, 1998, 13 pages.
Wrapping instructions Baby Carriers, http://www.kokadi.de/en/instruction: 162.html, Copyright 2016 IS ARA, 28 pages.
Canadian Patent Application 3,120,946 Examination Report issued Dec. 4, 2023.
Declaration of Judy Pettersen and Exhibits thereto, Aug. 14, 2016, 50 pgs.
Declaration of Judy Petterson regarding BabyTrekker with enclosures 1 and 2, dated May 26, 2011, 18 pgs.
Declaration of Richard N. Hinrichs, Ph.D and Appendix A thereto for Petition for Inter Partes Review of U.S. Pat. No. 8,590,757, 155 pgs.
Declaration of Richard N. Hinrichs, Ph.D and Appendix A thereto for Petition for Inter Partes Review of U.S. Pat. No. 9,022,260, 158 pgs.
Exhibit RX-0240, In re Matter of Certain Child Carriers, United States International Trade Commission, Inv. No. 337-TA-1154, Color Photograph labeled D (Respondent Exhibit), Exhibit 320 to Depo of Dr. Dybwig-Pawelko, 1 pg.
Declaration of Shari Hall White and Appendix A thereto, Jun. 29, 2016, 12 pgs.
Definition of "flexed", Random House Webster's Unabridged Dictionary, Oct. 1999, Second Edition, p. 733.
Doan, Marlyn, Children's Gear, Staffing Small in the Wilderness, The Sierra Club Outdoors Guide for Families, 1979, at pp. 161-167.
European Patent Application 16860977.4 Office Action issued Mar. 22, 2023.
European Patent Application 21180405.9 Decision to Grant issued May 11, 2023.
European Patent Application 23175400.3 Extended Search Report issued Nov. 16, 2023.
European Search Report for European Application No. 14773586.4, dated Oct. 16, 2016, 9 pgs.

(56) References Cited

OTHER PUBLICATIONS

European Search Report for European Patent Application No. 16777348.0, dated Oct. 4, 2018, 10 pgs.
Evenflo Soft Carriers, 2 pgs., retrieved from https://web.archive.org/web/2001033108III3/http://www.evenflo.com/ep/furniture/softcarrier.phtml.
Examination Report for European Application No. 04 783 725.7, dated Dec. 21, 2009, 5 pgs.
Examination Report for European Application No. 04 783 725.7, dated Jun. 1, 2010, 6 pgs.
Examination Report for European Application No. 04 783 725.7, dated Sep. 10, 2009, 3 pgs.
Examination Report for European Application No. 04 783 725.7, dated Sep. 21, 2007, 3 pgs.
Examination Report for European Application No. 04 783 725.7, dated Sep. 9, 2008, 4 pgs.
Examination Report issued for European Patent Application No. 17864576.8, dated Nov. 16, 2020, 5 pgs.
Examination Report issued for European Patent Application No. FR 2 524 288 Oct. 1983 17864576.8, dated Nov. 16, 2020, 5 pgs.
Exhibit A to Declaration of Joline Sikora, Jul. 10, 2007, 1 pg.
Exhibit J to Declaration of Joline Sikora, 1 pg.
Exhibit K to Declaration of Joline Sikora, 2007, 1 pg.
Exhibit L to Declaration of Joline Sikora, Feb. 17, 2008, 4 pgs.
Exhibit Q to Declaration of Joline Sikora, Aug. 23, 2007, 2 pgs.
Exhibit R to Declaration of Joline Sikora, Aug. 23, 2007, 2 pgs.
Exhibit RX-0116, In re Matter of Certain Child Carriers, United States International Trade Commission, Inv. No. 337-TA-1154, Photographs Embedded in Mckibbon Declaration, Exhibit 3 to Depo of Mckibbon, 2 pgs.
Exhibit RX-0118, In re Matter of Certain Child Carriers, United States International Trade Commission, Inv. No. 337-TA-1154, Photographs Embedded in Mckibbon Declaration, Exhibit 4 to Depo of McKibbon, 1 pg.
Exhibit RX-0120, In re Matter of Certain Child Carriers, United States International Trade Commission, Inv. No. 337-TA-1154, Flickr Photos of Petals and Puddles, Exhibit 5 to Depo of McKibbon, 3 pgs.
Exhibit RX-0123, In re Matter of Certain Child Carriers, United States International Trade Commission, Inv. No. 337-TA-1154: Photo of carrier, Exhibit 7 to Depo of McKibbon, 1 pg.
Exhibit RX-0133, In re Matter of Certain Child Carriers, United States International Trade Commission, Inv. No. 337-TA-1154, Etsy Pages for petalsandpuddles, Exhibit 82 to Depo of Wick, 4 pgs.
Exhibit RX-0135, In re Matter of Certain Child Carriers, United States International Trade Commission, Inv. No. 337-TA-1154, Wayback Machine Page for Etsy search results baby sling, Exhibit 83 to Depo of Wick, Aug. 19, 2010, 4 pgs.
Exhibit RX-0159, In re Matter of Certain Child Carriers, United States International Trade Connnission, Inv. No. 337-TA-1154, Ergobaby Omni 360 Cool Air Mesh Instruction Manual, 26 pgs.
Exhibit RX-0160, In re Matter of Certain Child Carriers, United States International Trade Commission, Inv. No. 337-TA-1154, Ergobaby Omni 360 Instruction Manual, 26 pgs.
Exhibit RX-0161, In re Matter of Certain Child Carriers, United States International Trade Commission, Inv. No. 337-TA-1154, Ergobaby Adapt Instruction Manual, 23 pgs.
Exhibit RX-0163, In re Matter of Certain Child Carriers, United States International Trade Commission, Inv. No. 337-TA-1154, Ergobaby 360 Bundle of Joy Instruction Manual, 26 pgs.
Exhibit RX-0200, In re Matter of Certain Child Carriers, United States International Trade Commission, Inv. No. 337-TA-1154, Declaration of Di Linh Reichman Regarding the Hibiscus Carrier, Sep. 2, 2019, 6 pgs.
Exhibit RX-0206, In re Matter of Certain Child Carriers, United States International Trade Commission, Inv. No. 337-TA-1154, Color Photograph (Respondent Exhibit), Exhibit 301 to Depo of Reichman, 1 pg.
Exhibit RX-0208, In re Matter of Certain Child Carriers, United States International Trade Commission, Inv. No. 337-TA-1154, Color Photograph (Respondent Exhibit), Exhibit 302 to Depo of Reichman, 1 pg.
Exhibit RX-0210, In re Matter of Certain Child Carriers, United States International Trade Commission, Inv. No. 337-TA-1154, Color Photograph (Respondent Exhibit), Exhibit 303 to Depo of Reichman, 1 pg.
Exhibit RX-0212, In re Matter of Certain Child Carriers, United States International Trade Connnission, Inv. No. 337-TA-1154, Color Photograph (Respondent Exhibit), Exhibit 304 to Depo of Reichman, 1 pg.
Exhibit RX-0214, In re Matter of Certain Child Carriers, United States International Trade Commission, Inv. No. 337-TA-1154, Color Photograph (Respondent Exhibit), Exhibit 305 to Depo of Reichman, 1 pg.
Exhibit RX-0216, In re Matter of Certain Child Carriers, United States International Trade Commission, Inv. No. 337-TA-1154, Color Photograph (Respondent Exhibit), Exhibit 306 to Depo of Reichman, 1 pg.
Exhibit RX-0218, In re Matter of Certain Child Carriers, United States International Trade Commission, Inv. No. 337-TA-1154, Color Photograph (Respondent Exhibit), Exhibit 307 to Depo of Reichman, 1 pg.
Exhibit RX-0231, In re Matter of Certain Child Carriers, United States International Trade Commission, Inv. No. 337-TA-1154, Declaration of Kristin Dybvig-Pawelko regarding the No Tie Mei Tai Hibiscus Child Carrier Exhibit 7 to Depo of Dr. DybwigPawelko, Sep. 28, 2019, 9 pgs.
Exhibit RX-0235, In re Matter of Certain Child Carriers, United States International Trade Commission, Inv. No. 337-TA-1154, Color Photograph labeled A (Respondent Exhibit), Exhibit 320 to Depo of Dr. Dybwig-Pawelko, 1 pg.
Exhibit RX-0237, In re Matter of Certain Child Carriers, United States International Trade Commission, Inv. No. 337-TA-1154, Color Photograph labeled B (Respondent Exhibit), Exhibit 320 to Depo of Dr. Dybwig-Pawelko, 1 pg.
Exhibit RX-0239, In re Matter of Certain Child Carriers, United States International Trade Commission, Inv. No. 337-TA-1154, Color Photograph labeled C (Respondent Exhibit), Exhibit 320 to Depo of Dr. Dybwig-Pawelko, 1 pg.
Babybjörn AB, Owner's Manual, Babybjorn Baby Carrier Free, Version 1, 2019, www.babybjorn.com.
Babybjörn AB, Owner's Manual, Babybjorn Baby Carrier Harmony, Version 4, 2019, www.babybjorn.com.
Babybjörn AB, Owner's Manual, Babybjorn Baby Carrier Mini, Version 5, 2018, www.babybjorn.com.
Babybjörn AB, Owner's Manual, BabyBjorn Baby Carrier Miracle, Version 5, 2011, www.babybjorn.com.
Babybjörn AB, Owner's Manual, Babybjorn Baby Carrier Move, Version 2, 2019, www.babybjorn.com.
Babybjörn AB, Owner's Manual, Babybjorn Baby Carrier Original, Version 9, 2015, www.babybjorn.com.
Babybjörn AB, Owner's Manual, Babybjorn Baby Carrier We, Version 2, 2015, www.babybjorn.com.
European Patent Application 16860977.4 Office Action issued Jan. 29, 2024.
Rookie, Instructions Rookie Affinity, https://rookie-baby.eu/pages/instructions-rookie-affinity.
Rookie, Instructions Rookie Konnekt Baby Carrier, https://rookie-baby.eu/pages/instructions-rookie-konnekt-baby-carrier-1.
Rookie, Instructions Rookie Premium Baby Carrier, https://rookie-baby.eu/pages/instructions-premium-baby-carrier.
Rookie, Instructions Rookie Revolution Baby Carrier From New Born to Toddler, https://rookie-baby.eu/pages/instructions-revolution-baby-carrier.
U.S. Appl. No. 17/572,084, Notice of Allowance issued Jan. 18, 2024.
U.S. Appl. No. 18/108,979, Non-Final Office Action issued Jan. 18, 2024.
U.S. Appl. No. 18/526,378 Non-Final Office Action issued Feb. 1, 2024.

(56) References Cited

OTHER PUBLICATIONS

European Patent Application 21180405.9 Notice of Opposition issued Mar. 13, 2023.
Japanese Patent Application 2021-529471 Penultimate Official Action issued Feb. 19, 2024.
U.S. Appl. No. 18/136,979, filed Apr. 20, 2023, Rodney V. Telford.
U.S. Appl. No. 18/196,539, filed May 12, 2023, Rodney V. Telford.
U.S. Appl. No. 18/202,058, filed May 25, 2023, Rodney V. Telford.
U.S. Appl. No. 18/069,922, filed Jun. 7, 2023, Daruni M. Gotel.
"6 in One Rider," Infantino, LLC, San Diego, California, 2002, 1 page.
"Baby Matey, Soft Baby Carriers," Copyright Kidpower Unlimited Inc., 4 pages.
"Baby Pack Baby Carrier," http://www.beginnings.org/shop/buikrugdragers_babypack.htm, Feb. 4, 2002, 1 page.
"Baby Trekker Instruction Manual," 16 pgs.
"Baby Trekker instruction Sheet," 2 pages.
"Baby/Toddler Sling," http://www3.telus.net/public/a6a83106/Sling/sling.html, Nov. 19, 2003, 8 pgs.
"Backpack Tips," http://backpacking.net/ gearpack-tips.html,Jun. 2, 2002, 6 pages.
"Blowing Experience," The Australian Women's Weekly, National library of Australia—http://nla.gov.au/nla-news-page5623014, Oct. 11, 1978, 1 page.
"Chinese Baby Carrier," http://portebebe.free.fr, Jun. 2002, 7 pgs.
"Clinical Practice Guideline: Early Detection of Developmental Dysplasia of the Hip," American Academy of Pediatrics vol. 105, No. 4, Apr. 2000, 10 pages.
"Device for Worn Baby," Patent Translate Description of Russian Application No. RU12646, 3 pgs.
"Eager Market for Baby Carrier" The Gazette, Montreal May 15, 1984: C-19 (accessed at https://news.google.corn/newspapersid~zA0vAAAAIBAJ&sjid~mqUFAAAAIBAJ&pg~1454% 2C24685 I 0).
"First Journey Advantages," http://www.first-journey.com/advantagelpics/advantages1.html, Dec. 14, 2002, 1 page.
"First Journey Advantages," http://www.first-journey.com/advantagelpics/advantages2.html, Dec. 14, 2002, 1 page.
"First Journey Advantages," http://www.first-journey.com/advantagelpics/advantagesl.html, Dec. 14, 2002, 1 page.
"First Journey Instructions," http://www.first-journey.com/instructions/instructions, Dec. 14, 2002, 1 page.
"First Journey Photos & Quotes," http://www.first-journey.com/photosandquotes/photos, Dec. 14, 2002, 2 page.
"First Journey Tour Guide," Pettersen Infant Products, www.firstjourney.com, 2002, 2 pages.
"First Journey Visite Guidee," Pettersen Infant Products, www.firstjourney.com, 2004, 2 pages.
"For Shane Gould Innes—Motherhood is a Mind," The Australian Women's Weekly, National library of Australia-http://nla.gov. au/nla-news-page5623013, Oct. 11, 1978, 1 page.
"Graco Soft Carrier Owner's Manual, Model 5070 Series," Graco Children's Products, Inc., 1999, 7 pages.
"GYP Gear G4," http://www.gvogear.com/g4.asp, Jun. 2, 2002, 3 pages.
"Home Watch," The Sydney Morning Herald, https://www.newspapers.com/image/123957115, Jan. 10, 1993, 1 page.
"In & Out Carrier Instructions," Hauck Fun for Kids, Aug. 2003, 3 pages.
"Kinderpack Wearing Instructions for Infant Size," https://mykinderpack.com/pages/instructions, Copyright 2017 Kindercarry, 5 pgs.
"Kinderpack Wearing Instructions for Toddler Size," https://mykinderpack.com/pages/instructions, Copyright 2017 Kindercarry, 5 pages.
"Kwik Sew," Pattern 1046, Kwik Sew Pattern Co., Inc., Minneapolis, MN, 8 pages.
"Lifter Baby Carrier," http://www.beginnings.org/shop/buikheuprugdragers_lifter.htm, Jun. 19, 2002, 2 pages.
"Make Your Own G4 Pack," http://www.gvpgear.com/make_your_own.asp, Jun. 2, 2002, 17 pages.
"Miguel Inspired Originals," http://miguelinspired.com/ gpage2.html, Oct. 30, 2005, 5 pgs.
"Miguel Inspired Originals," http://miguelinspired.com/about.html, Oct. 30, 2005, 2 pages.
"Miguel Inspired Originals," http://miguelinspired.com/gpage.html, Oct. 30, 2005, 2 pgs.
"Miguel Inspired Originals," http://miguelinspired.com/gpage3.html, Oct. 30, 2005, 1 page.
"Porte-hebe chinois," http://portebebe.free.fr/, Jun. 5, 2002, 6 pages.
"The Australian Women's Weekly," vol. 37, No. 8, Jul. 23, 1969, 80 pages.
"The Baby Trekker Product Info," http://www.babytrekker.com/product.htm, Jun. 10, 2002, 1 page.
"The Baby Trekker Testimonials," http://www.babytrekker.com/testimonials.htm, Dec. 21, 2001, 4 pages.
"The Baby Trekker Testimonials," http://www.babytrekker.com/testimonials.htm, Sep. 16, 2002, 4 pages.
"The Beginning" Ergo Baby Blog, 7 pgs., retrieved from https://blog.ergobaby.com/2011/02/the-beginning/).
"The Five Hidden Features of the Yemaya Baby Carrier," http://blog.cybex-online.com/blog/safety/the-five-hidden-featuresof- the-yemaya-baby-carrier/, Oct. 13, 2016 ISARA, 7 pages.
"The Pick of the Extended Trek Packs" Backpacker, Oct. 1997, vol. 23, pp. 58-69.
"Theodore Bean Infants & Toddlers Carriers & Accessories," Theodore Bean Adventure Company Inc., 2000, 16 pages.
"Ultralight Pack,"http://www.backpacking.net/makegear/ gvppack/, Mar. 1, 2003, 29 pgs.
"Wearing Your Baby," http://wearingyourbaby.co.nz/history, 2014, 11 pages.
"Why Choose the Wilkin et?," http://www.wilkinet.co.uk/WhyChoose.asp, Apr. 17, 2003, 2 pages.
"Worauf Eitern beim Kauf von Tragehilfen fuer Sauglinge achten sollten"—Things parents shopping for infant carriers should look out for, http://www.continuum-concept.de/liedkir.htm, Jul. 19, 2001, 4 pages.
Appendix A: Baby Matey Non-Patent Literature as Cited on the Face of U.S. Pat. No. 4,986,458 ("Baby Matey Literature") Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix AAA: Japanese Pub. No., S54-108131 ("The '131 Patent") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Exhibit RX-0241, In re Matter of Certain Child Carriers, United States International Trade Commission, Inv. No. 337-TA-1154, Omni Alternate Preliminary-For Review Only (PowerPoint) 10 pgs.
Exhibit RX-0242, In re Matter of Certain Child Carriers, United States International Trade Commission, Inv. No. 337-TA-1154, Color Photograph labeled E (Respondent Exhibit), Exhibit 320 to Depo of Dr. Dybwig-Pawelko, 1 pg.
Exhibit RX-0280, In re Matter of Certain Child Carriers, United States International Trade Commission, Inv. No. 337-TA-1154, TheBabyWearer post about carriers for facing out and referencing both Silly Goose and Pikkolo, Oct. 22, 2007, 9 pgs.
Exhibit RX-0289, In re Matter of Certain Child Carriers, United States International Trade Commission, Inv. No. 337-TA-1154, Pikkolo physical carrier and packaging, 12 pgs.
Exhibit RX-0296, In re Matter of Certain Child Carriers, United States International Trade Commission, Inv. No. 337-TA-1154, Tula Free-to-Grow Carrier Instruction Manual, 25 pgs.
Exhibit RX-0297, In re Matter of Certain Child Carriers, United States International Trade Commission, Inv. No. 337-TA-1154, Tula Explore Carrier Instruction Manual, 8 pgs.
Exhibit RX-0341, In re Matter of Certain Child Carriers, United States International Trade Commission, Inv. No. 337-TA-1154, Infantino Flip 4-in-I Carrier Design Drawings, Sep. 21, 2017, 12 pgs.
Exhibit RX-0342, In re Matter of Certain Child Carriers, United States International Trade Commission, Inv. No. 337-TA-1154, Infantino Flip 4-in-I Carrier Product Manual, 2 pgs.

(56) References Cited

OTHER PUBLICATIONS

Exhibit RX-0343, In re Matter of Certain Child Carriers, United States International Trade Commission, Inv. No. 337-TA-1154, Infantino Upscale Carrier Product Manual, 2016, 10 pgs.
Exhibit RX-0344, In re Matter of Certain Child Carriers, United States International Trade Commission, Inv. No. 337-TA-1154, Infantino Upscale Carrier Product Manual RX, 2016, 10 pgs.
Exhibit RX-0347, In re Matter of Certain Child Carriers, United States International Trade Commission, Inv. No. 337-TA-1154, Infantino Go Forward Evolved Product Manual, 24 pgs.
Exhibit RX-0351, In re Matter of Certain Child Carriers, United States International Trade Commission, Inv. No. 337-TA-1154, Photograph of Michelle McEntire and Children, Feb. 17, 2008, 1 pg.
Exhibit RX-0402, In re Matter of Certain Child Carriers, United States International Trade Commission, Inv. No. 337-TA-1154, Web Archive Hibiscus Baby Wearing Instructions, 2007, 3 pgs.
Exhibit RX-0411, In re Matter of Certain Child Carriers, United States International Trade Commission, Inv. No. 337-TA-1154, The Cat Bird Baby Website Printout-Dur Booth at the ABC Kids Expo in Las Vegas, Sep. 13, 2007, 5 pgs.
Exhibit RX-0413, In re Matter of Certain Child Carriers, United States International Trade Commission, Inv. No. 337-TA-1154, The Cat Bird Baby Website Printout-Pikkolo, a Mei Tai-Like Buckle Carrier, Aug. 2, 2007, 5 pgs.
Exhibit RX-0415, In re Matter of Certain Child Carriers, United States International Trade Commission, Inv. No. 337-TA-1154, Pikkolo Carrier Design Drawings, Jul. 2007, 1 pg.
Exhibit RX-0417, In re Matter of Certain Child Carriers, United States International Trade Commission, Inv. No. 337-TA-1154, Cat Bird Baby Purchase Order, Sep. 25, 2007, 1 pg.
Exhibit RX-0419, In re Matter of Certain Child Carriers, United States International Trade Connnission, Inv. No. 337-TA-1154, Sales Receipt for Pikkolo Carrier, Sep. 14, 2007, 4 pgs.
Exhibit RX-0437, In re Matter of Certain Child Carriers, United States International Trade Commission, Inv. No. 337-TA-1154, FlickR Page Printout, Sep. 19, 2008, 2 pgs.
Exhibit RX-0480, In re Matter of Certain Child Carriers, United States International Trade Commission, Inv. No. 337-TA-1154, FlickR Photograph of Closet with Different Types of Material, Apr. 30, 2008, 3 pgs.
Exhibit RX-0482, In re Matter of Certain Child Carriers, United States International Trade Commission, Inv. No. 337-TA-1154, FlickR Photograph of Closet with Different Types of Material, Apr. 30, 2008, 2 pgs.
Exhibit RX-0484, In re Matter of Certain Child Carriers, United States International Trade Commission, Inv. No. 337-TA-1154, FlickR Photograph of crafting supplies, Apr. 30, 2008, 2 pgs.
Exhibit RX-0504, In re Matter of Certain Child Carriers, United States International Trade Commission, Inv. No. 337-TA-1154, Exhibit A to Declaration of Joline Sikora, Jul. 10, 2007, 1 pg.
Exhibit RX-0505, In re Matter of Certain Child Carriers, United States International Trade Commission, Inv. No. 337-TA-1154, Exhibit B to Declaration of Joline Sikora, Jul. 11, 2007, 3 pgs.
Exhibit RX-0506, In re Matter of Certain Child Carriers, United States International Trade Commission, Inv. No. 337-TA-1154, Exhibit C to Declaration of Joline Sikora, Jul. 11, 2007, 3 pgs.
Exhibit RX-0507, In re Matter of Certain Child Carriers, United States International Trade Commission, Inv. No. 337-TA-1154, Exhibit D to Declaration of Joline Sikora, Sep. 18, 2007, 1 pg.
Exhibit RX-0508, In re Matter of Certain Child Carriers, United States International Trade Commission, Inv. No. 337-TA-1154, Exhibit E to Declaration of Joline Sikora, Sep. 18, 2007, 1 pg.
Exhibit RX-0509, In re Matter of Certain Child Carriers, United States International Trade Commission, Inv. No. 337-TA-1154, Exhibit F to Declaration of Joline Sikora, Sep. 18, 2007, 1 pg.
Exhibit RX-0510, In re Matter of Certain Child Carriers, United States International Trade Commission, Inv. No. 337-TA-1154, Exhibit G to Declaration of Joline Sikora, Sep. 18, 2007, 1 pg.
Exhibit RX-0512, In re Matter of Certain Child Carriers, United States International Trade Commission, Inv. No. 337-TA-1154, Exhibit I to Declaration of Joline Sikora, 2007), 3 pgs.
Exhibit RX-0513, In re Matter of Certain Child Carriers, United States International Trade Commission, Inv. No. 337-TA-1154, Exhibit J to Declaration of Joline Sikora, 1 pg.
Exhibit RX-0514, In re Matter of Certain Child Carriers, United States International Trade Commission, Inv. No. 337-TA-1154.
Exhibit RX-0515, In re Matter of Certain Child Carriers, United States International Trade Commission, Inv. No. 337-TA-1154.
Exhibit RX-0520, In re Matter of Certain Child Carriers, United States International Trade Commission, Inv. No. 337-TA-1154.
Exhibit RX-0521, In re Matter of Certain Child Carriers, United States International Trade Commission, Inv. No. 337-TA-1154, Exhibit R to Declaration of Joline Sikora, Aug. 23, 2007, 2 pgs.
Exhibit RX-0522, In re Matter of Certain Child Carriers, United States International Trade Commission, Inv. No. 337-TA-1154.
Exhibit RX-0523, In re Matter of Certain Child Carriers, United States International Trade Commission, Inv. No. 337-TA-1154, Exhibit T to Declaration of Joline Sikora, Feb. 17, 2008, 2 pgs.
Exhibit RX-0524, In re Matter of Certain Child Carriers, United States International Trade Commission, Inv. No. 337-TA-1154, Exhibit U to Declaration of Joline Sikora, Feb. 17, 2008, 2 pgs.
Exhibit RX-0525, In re Matter of Certain Child Carriers, United States International Trade Commission, Inv. No. 337-TA-1154, Exhibit V to Declaration of Joline Sikora, Jul. 21, 2007-Sep. 19, 2008, 64 pgs.
Exhibit RX-0526, In re Matter of Certain Child Carriers, United States International Trade Commission, Inv. No. 337-TA-1154, Exhibit W to Declaration of Joline Sikora, Feb. 27, 2007-Apr. 5, 2009, 41 pgs.
Exhibit RX-0527, In re Matter of Certain Child Carriers, United States International Trade Commission, Inv. No. 337-TA-1154, Exhibit A to Declaration of Mischele McEntire, Feb. 17, 2007, 2 pgs.
Exhibit RX-0528, In re Matter of Certain Child Carriers, United States International Trade Commission, Inv. No. 337-TA-1154, Exhibit B to Declaration of Mischele McEntire, Feb. 17, 2008, 4 pgs.
Exhibit RX-0539, In re Matter of Certain Child Carriers, United States International Trade Commission, Inv. No. 337-TA-1154, LILLEbaby Complete 6 Position Baby Carrier User Manual, Exhibit 613 to Depo of L. Lehan, 16 pgs.
Exhibit RX-0551, In re Matter of Certain Child Carriers, United States International Trade Commission, Inv. No. 337-TA-1154, Silly Goose Photos and thread from babywearer. com, Sep. 14, 2007, 14 pgs.
Exhibit RX-0552, In re Matter of Certain Child Carriers, United States International Trade Commission, Inv. No. 337-TA-1154, Silly Goose Photos and thread from babywearer.com, Oct. 31, 2007, 15 pgs.
Exhibit S to Declaration of Joline Sikora, Feb. 17, 2008, 2 pgs.
Exhibit T to Declaration of Joline Sikora, Feb. 17, 2008, 2 pgs.
Exhibit U to Declaration of Joline Sikora, Feb. 17, 2008, 2 pgs.
Extended European Search Report for European Patent Application No. 16860977.4, dated Jun. 5, 2019, 7 pgs.
Extended European Search Report for European Patent Application No. 17864576.8, dated Feb. 14, 2020, 7 pgs.
Appendix B: Baby Matey System Invalidity Chart, *The Ergo Baby Carrier, Inc.* v. *BOBA Inc.*, Case No. 2: 15-cv-08946, In the United States District Court for the Central District of California, Jul. 15, 2016, 22 pgs.
Appendix BB: Consumer Reports Guide to Baby Products by Sandy Jones, published in 2001 ("Guide to Baby Products") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix BB: U.S. Pat. No. 3,780,919 ("Hansson") Invalidity Chart, *The Ergo Baby Carrier, Inc.* v. *BOBA Inc.*, Case No. 2: 15-cv-08946, In the United States District Court for the Central District of California, Jul. 15, 2016, 4 pgs.
Appendix BBB: UK Patent App. No. GB 2026848 ("David") Invalidity Chart, *The Ergo Baby Carrier, Inc.* v. *BOBA Inc.*, Case

(56) References Cited

OTHER PUBLICATIONS

No. 2: 15-cv-08946, In the United States District Court for the Central District of California, Jul. 15, 2016, 5 pgs.
Appendix C: Canadian Patent No. 1332928 ("Pettersen") Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix CC: "Physiological Strain Due to Load Carrying" by Michael Holewijn, published in European Journal of Applied Physiology and Occupational Physiology, Feb. 1990 ("Holewijn") Invalidity Chart, *The Ergo Baby Carrier, Inc.* v. *BOBA Inc.*, Case No. 2:15-cv-08946, In the United States District Court for the Central District of California, Jul. 15, 2016, 12 pgs.
Appendix CCC: DIY Baby Sling System Invalidity Chart, *The Ergo Baby Carrier, Inc.* v. *BOBA Inc.*, Case No. 2: 15-cv-08946, In the United States District Court for the Central District of California, Jul. 15, 2016, 11 pgs.
Appendix D: baby Trekker Instruction Manual copyright date stamped 1998 ("1998 baby Trekker Manual") Invalidity Chart, *The Ergo Baby Carrier, Inc.* v. *BOBA Inc.*, Case No. 2: 15-cv-08946, In the United States District Court for the Central District of California, Jul. 15, 2016, 19 pgs.
Appendix DD: Kelty Kangaroo Invalidity Chart, *The Ergo Baby Carrier, Inc.* v. *BOBA Inc.*, Case No. 2: 15-cv-08946, In the United States District Court for the Central District of California, Jul. 15, 2016, 7 pgs.
Appendix DDD: Kozy System Invalidity Chart, *The Ergo Baby Carrier, Inc.* v. *BOBA Inc.*, Case No. 2: 15-cv-08946, In the United States District Court for the Central District of California, Jul. 15, 2016, 16 pgs.
Appendix E: babyTrekker Instruction Manual ("baby Trekker Manual") Invalidity Chart, *The Ergo Baby Carrier, Inc.* v. *BOBA Inc.*, Case No. 2: 15-cv-08946, In the United States District Court for the Central District of California, Jul. 15, 2016, 21 pgs.
Appendix EE: Kirkiliones Invalidity Chart, *The Ergo Baby Carrier, Inc.* v. *BOBA Inc.*, Case No. 2: 15-cv-08946, In the United States District Court for the Central District of California, Jul. 15, 2016, 9 pgs.
Appendix EEE: Packababy System Invalidity Chart, *The Ergo Baby Carrier, Inc.* v. *BOBA Inc.*, Case No. 2: 15-cv-08946, In the United States District Court for the Central District of California, Jul. 15, 2016, 17 pgs.
Appendix F: babyTrekker System Invalidity Chart, *The Ergo Baby Carrier, Inc.* v. *BOBA Inc.*, Case No. 2: 15-cv-08946, In the United States District Court for the Central District of California, Jul. 15, 2016, 16 pgs.
Appendix FF: "Physicological, Biomechanical and Medical Aspects of Soldier Load Carriage" by Joseph Knapik, Presented in Jun. 2000 ("Knapik") Invalidity Chart, *The Ergo Baby Carrier, Inc.* v. *BOBA Inc.*, Case No. 2: 15-cv-08946, In the United States District Court for the Central District of California, Jul. 15, 2016, 11 pgs.
Appendix FFF: Sakara System Invalidity Chart, *The Ergo Baby Carrier, Inc.* v. *BOBA Inc.*, Case No. 2:15-cv-08946, In the United States District Court for the Central District of California, Jul. 15, 2016, 17 pgs.
Appendix G: First Journey System Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix GG: U.S. Pat. No. 4,434,920 ("Moore") Invalidity Chart, *The Ergo Baby Carrier, Inc.* v. *BOBA Inc.*, Case No. 2: 15-cv-08946, In the United States District Court for the Central District of California, Jul. 15, 2016, 6 pgs.
Appendix GGG: Sutemi System Invalidity Chart, *The Ergo Baby Carrier, Inc.* v. *BOBA Inc.*, Case No. 2:15-cv-08946, In the United States District Court for the Central District of California, Jul. 15, 2016, 12 pgs.
Appendix H: French Patent Pub. No. 2795010 ("Ducruet") Invalidity Chart, *The Ergo Baby Carrier, Inc.* v. *BOBA Inc.*, Case No. 2: 15-cv-08946, In the United States District Court for the Central District of California, Jul. 15, 2016, 8 pgs.
Appendix HH: "A Static Biomechanical Load Carriage Model" by R.P. Pelot et al., Presented in Jun. 2000 ("Pelot") Invalidity Chart, *The Ergo Baby Carrier, Inc.* v. *BOBA Inc.*, Case No. 2: 15-cv-08946, In the United States District Court for the Central District of California, Jul. 15, 2016, 13 pgs.
Appendix HHH: Casses Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix I: U.S. Pat. No. 4,986,458 ("Linday") Invalidity Chart, *The Ergo Baby Carrier, Inc.* v. *BOBA Inc.*, Case No. 2: 15-cv-08946, In the United States District Court for the Central District of California, Jul. 15, 2016, 16 pgs.
Appendix II: Pony Ride Invalidity Chart, *The Ergo Baby Carrier, Inc.* v. *BOBA Inc.*, Case No. 2: 15-cv-08946, In the United States District Court for the Central District of California, Jul. 15, 2016, 7 pgs.
Appendix III: U.S. Pat. No. 6, 182,873 ("Christopher") Invalidity Chart, *The Ergo Baby Carrier, Inc.* v. *BOBA Inc.*, Case No. 2: 15-cv-08946, In the United States District Court for the Central District of California, Jul. 15, 2016, 2 pgs.
Appendix J: U.S. Pat. No. 4,469,259 ("Krich") Invalidity Chart, *The Ergo Baby Carrier, Inc.* v. *BOBA Inc.*, Case No. 2: 15-cv-08946, In the United States District Court for the Central District of California, Jul. 15, 2016, 8 pgs.
Appendix JJ: U.S. Pat. No. 5, 114,059 ("Thatcher") Invalidity Chart, *The Ergo Baby Carrier, Inc.* v. *BOBA Inc.*, Case No. 2: 15-cv-08946, In the United States District Court for the Central District of California, Jul. 15, 2016, 4 pgs.
Appendix JJJ: U.S. Pat. No. 6, 155,579 ("Eyman") Invalidity Chart, *The Ergo Baby Carrier, Inc.* v. *BOBA Inc.*, Case No. 2: 15-cv-08946, In the United States District Court for he Central District of California, Jul. 15, 2016, 2 pgs.
Appendix K: "A Blue-Jean Person Pack," by E.A. Byrnes as published on p. 164 of the May/Jun. 1982 issue of the Mother Earth News ("Byrnes") Invalidity Chart, *The Ergo Baby Carrier, Inc.* v. *BOBA Inc.*, Case No. 2:15-cv-08946, In the United States District Court for the Central District of California, Jul. 15, 2016, 21 pgs.
Appendix KK: Weego System Invalidity Chart, *The Ergo Baby Carrier, Inc.* v. *BOBA Inc.*, Case No. 2:15-cv-08946, In the United States District Court for the Central District of California, Jul. 15, 2016, 20 pgs.
Appendix KKK: U.S. Pat. No. 5,848,741 ("Fair") Invalidity Chart, *The Ergo Baby Carrier, Inc.* v. *BOBA Inc.*, Case No. 2: 15-cv-08946, In the United States District Court for the Central District of California, Jul. 15, 2016, 2 pgs.
Appendix L: EP Patent No. 0437365 ("Gunderman") Invalidity Chart, *The Ergo Baby Carrier, Inc.* v. *BOBA Inc.*, Case No. 2: 15-cv-08946, In the United States District Court for the Central District of California, Jul. 15, 2016, 14 pgs.
Appendix LL: U.S. Pat. No. 6,257,468 ("Yamazoe") Invalidity Chart, *The Ergo Baby Carrier, Inc.* v. *BOBA Inc.*, Case No. 2: 15-cv-08946, In the United States District Court for the Central District of California, Jul. 15, 2016, 4 pgs.
Appendix LLL: Consumer Reports Guide to Baby Products by Sandy Jones, published in 2001 ("Guide to Baby Products") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix M: Kwik Sew Pattern No. 1046 ("Kwik Sew") Invalidity Chart, *The Ergo Baby Carrier, Inc.* v. *BOBA Inc.*, Case No. 2:15-cv-08946, In the United States District Court for the Central District of California, Jul. 15, 2016, 18 pgs.
Appendix MM: Baby Matey Literature as Cited on the Face of U.S. Pat. No. 4,986,458 ("Baby Matey Literature") Invalidity Chart, *The Ergo Baby Carrier, Inc.* v. *BOBA Inc.*, Case No. 2: 15-cv-08946, In the United States District Court for the Central District of California, Jul. 15, 2016, 20 pgs.
Appendix MMM: U.S. Pat. No. 3,780,919 ("Hansson") Invalidity Chart, *The Ergo Baby Carrier, Inc.* v. *BOBA Inc.*, Case No.

(56) References Cited

OTHER PUBLICATIONS

2:15-cv-08946, In the United States District Court for the Central District of California, Jul. 15, 2016, 2 pgs.
Appendix N: Japanese Pub. No. S53-155443 ("The '443 Patent") Invalidity Chart, *The Ergo Baby Carrier, Inc.* v. *BOBA Inc.*, Case No. 2: 15-cv-08946, In the United States District Court for the Central District of California, Jul. 15, 2016, 12 pgs.
Appendix NN: Baby Matey System Invalidity Chart, *The Ergo Baby Carrier, Inc.* v. *BOBA Inc.*, Case No. 2: 15-cv-08946, In the United States District Court for the Central District of California, Jul. 15, 2016, 22 pgs.
Appendix NNN: "Physiological Strain Due to Load Carrying" by Michael Holewijn, published in European Journal of Applied Physiology and Occupational Physiology, Feb. 1990 ("Holewijn") Invalidity Chart, *The Ergo Baby Carrier, Inc.* v. *BOBA Inc.*, Case No. 2:15-cv-08946, In the United States District Court for the Central District of California, Jul. 15, 2016, 11 pgs.
Appendix O: Japanese Patent Pub. No. S54-108131 ("The '131 Patent") Invalidity Chart, *The Ergo Baby Carrier, Inc.* v. *BOBA Inc.*, Case No. 2:15-cv-08946, In the United States District Court for the Central District of California, Jul. 15, 2016, 13 pgs.
Appendix OO: Canadian Patent No. 1332928 ("Pettersen") Invalidity Chart, *The Ergo Baby Carrier, Inc.* v. *BOBA Inc.*, Case No. 2:15-cv-08946, In the United States District Court for the Central District of California, Jul. 15, 2016, 16 pgs.
Appendix OOO: Kelty Kangaroo Invalidity Chart, *The Ergo Baby Carrier, Inc.* v. *BOBA Inc.*, Case No. 2: 15-cv-08946, In the United States District Court for the Central District of California, Jul. 15, 2016, 4 pgs.
Appendix P: U.S. Pat. No. 4,009,808 ("Sharp") Invalidity Chart, *The Ergo Baby Carrier, Inc.* v. *BOBA Inc.*, Case No. 2:15-cv-08946, In the United States District Court for the Central District of California, Jul. 15, 2016, 5 pgs.
Appendix PP: babyTrekker Instruction Manual copyright date stamped 1998 ("1998 babyTrekker Manual") Invalidity Chart, *The Ergo Baby Carrier, Inc.* v. *BOBA Inc.*, Case No. 2: 15-cv-08946, In the United States District Court for the Central District of California, Jul. 15, 2016, 16 pgs.
Appendix PPP: Kirkiliones Invalidity Chart, *The Ergo Baby Carrier, Inc.* v. *BOBA Inc.*, Case No. 2:15-cv-08946, In the United States District Court for the Central District of California, Jul. 15, 2016, 9 pgs.
Appendix Q: UK Patent App. No. GB 2026848 ("David") Invalidity Chart, *The Ergo Baby Carrier, Inc.* v. *BOBA Inc.*, Case No. 2:15-cv-08946, In the United States District Court for the Central District of California, Jul. 15, 2016, 8 pgs.
Appendix QQ: babyTrekker Instruction Manual ("babyTrekker Manual") Invalidity Chart, *The Ergo Baby Carrier, Inc.* v. *BOBA Inc.*, Case No. 2: 15-cv-08946, In the United States District Court for the Central District of California, Jul. 15, 2016, 17 pgs.
Appendix QQQ: "Physiological, Biomechanical and Medical Aspects of Soldier Load Carriage" by Joseph Knapik, presented in Jun. 2000 ("Knapik") Invalidity Chart, *The Ergo Baby Carrier, Inc.* v. *BOBA Inc.*, Case No. 2: 15-cv-08946, In the United States District Court for the Central District of California, Jul. 15, 2016, 10 pgs.
Appendix R: DIY Baby Sling System Invalidity Chart, *The Ergo Baby Carrier, Inc.* v. *BOBA Inc.*, Case No. 2:15-cv-08946, In the United States District Court for the Central District of California, Jul. 15, 2016, 13 pgs.
Notice of Allowance for U.S. Appl. No. 16/551,286, dated Jan. 19, 2021, 2 pgs.
Notice of Allowance for U.S. Appl. No. 16/682,288, dated Apr. 26, 2021, 3 pgs.
Notice of Allowance for U.S. Appl. No. 16/682,288, dated Mar. 2, 2021, 3 pgs.
Notice of Allowance for U.S. Appl. No. 16/694,641, dated Sep. 7, 2021, 23 pgs.
Notice of Allowance issued for U.S. Appl. No. 15/170,629, dated Feb. 1, 2017, 14 pages.
Notice of Allowance issued for U.S. Appl. No. 15/170,629, dated Oct. 28, 2016, 14 pages.
Notice of Allowance issued for U.S. Appl. No. 15/602,744, dated Dec. 8, 2017, 14 pages.
Notice of Allowance with English translation for Korean Patent Application No. 10-2020-7029046, dated Aug. 5, 2021, 8 pgs.
Notice of Commission Determination to Review in Part a Final Initial Determination Finding No Violation of Section 337; Termination of the Investigation, 85 Federal Register 95, at 29484-29485, May 15, 2020, 2 pgs.
Notice of Opposition filed on Mar. 13, 2012, against European Patent No. EP1765123 B1, 213 pgs.
Nov. 24, 1998 Letter from U.S. ITC regarding U.S. tariff classification of babyTrekker, 2 pgs., retrieved from http://www.faqs.org.rulings/rulingsl998NYD83381.htrnl.
NUNA International B.V., Cudl Clik Instructions User Manual, www.nunababy.com.
O'Donohue, Rosaleen, Baby Rides the Asian Way, The Australian Women's Weekly, Jul. 23, 1969 at p. 9.
Office Action (with English translation) for Chinese Patent Application No. 201680071536.X, dated Nov. 16, 2020, 16 pgs.
Office Action (with English translation) for Korean Patent Application No. 10-2018-7015023, dated Dec. 17, 2019, 10 pgs.
Office Action (with English translation) for Korean Patent Application No. 10-2020-7029046, dated Oct. 22, 2020, 11 pgs.
Office Action for Chinese Patent Application No. 201480023993.2, dated Jan. 11, 2017, 20 pgs.
Office Action for Chinese Patent Application No. 201480023993.2, dated Sep. 26, 2017, 5 pages.
Office Action for European Patent Application No. 14773586.4, dated Oct. 12, 2017, 5 pages.
Office Action for Japanese Patent Application No. 2016-502118, dated Apr. 7, 2017, 9 pages.
Office Action for Japanese Patent Application No. 2017-552901 (with English translation), dated Feb. 19, 2019, 9 pgs.
Office Action for Japanese Patent Application No. 2018-521974 dated Aug. 1, 2020, 5 pgs.
Office Action for Japanese Patent Application No. 2018-521974 dated Aug. 14, 2020.
Office Action for Japanese Patent Application No. 2020-060090, dated Feb. 19, 2021, 2 pg.
Office Action for Korean Patent Application No. 10-2015-7028949, dated Jul. 20, 2017, 20 pages.
Office Action for Korean Patent Application No. 10-2018-7015023, dated Dec. 17, 2019, 5 pgs.
Office Action for U.S. Appl. No. 10/937,193, dated Aug. 14, 2007,9 pgs.
Office Action for U.S. Appl. No. 11/949,324, dated Apr. 28, 2010, 9 pgs.
Office Action for U.S. Appl. No. 11/949,324, dated Jul. 18, 2011, 14 pgs.
Office Action for U.S. Appl. No. 11/949,324, dated Oct. 4, 2010, 10 pgs.
Office Action for U.S. Appl. No. 11/949,324, dated Oct. 6, 2009, 9 pgs.
Office Action for U.S. Appl. No. 14/685,235, dated May 22, 2015, 8 pgs.
Office Action for U.S. Appl. No. 14/685,235, dated Nov. 27, 2015, 8 pgs.
Office Action for U.S. Appl. No. 14/862,933, dated Oct. 30, 2015, 5 pgs.
Office Action for U.S. Appl. No. 15/094,515, dated Feb. 19, 2019, 15 pgs.
Office Action for U.S. Appl. No. 15/094,515, dated Jun. 28, 2018, 15 pgs.
Office Action for U.S. Appl. No. 15/177,114, dated Aug. 24, 2016, 10 pgs.
Office Action for U.S. Appl. No. 15/177,114, dated Aug. 25, 2016, 10 pgs.
Office Action for U.S. Appl. No. 15/177,114, dated Feb. 21, 2018, 13 pages.
Office Action for U.S. Appl. No. 15/177,114, dated May 30, 2018, 5 pgs.

(56) References Cited

OTHER PUBLICATIONS

Office Action for U.S. Appl. No. 15/177,114, dated May 31, 2017, 12 pages.
Office Action for U.S. Appl. No. 15/177,114, dated Nov. 3, 2017, 12 pages.
Office Action for U.S. Appl. No. 15/177,114, dated Oct. 3, 2017, 5 pages.
Office Action for U.S. Appl. No. 15/337,813, dated May 22, 2018, 6 pgs.
Office Action for U.S. Appl. No. 15/602,744, dated Aug. 8, 2017, 42 pages.
Office Action for U.S. Appl. No. 15/796,422, dated Nov. 21, 2019, 20 pgs.
Office Action for U.S. Appl. No. 15/796,422, dated Nov. 26, 2018, 18 pgs.
Office Action for U.S. Appl. No. 15/916,990, dated May 15, 2018, 5 pgs.
Office Action for U.S. Appl. No. 16/204,581, dated Jan. 25, 2019, 5 pgs.
Office Action for U.S. Appl. No. 16/551,286, dated Apr. 23, 2020, 6 pgs.
International Search Report and Written Opinion for International Patent Application No. PCT/US19/063052, 11 pgs.
International Search Report and Written Opinion for International Patent Application No. PCT/US2016/026626, dated Jun. 30, 2016, 7 pgs.
International Search Report and Written Opinion for International Patent Application No. PCT/US2016/059534, dated Jan. 3, 2017, 8 pgs.
International Search Report and Written Opinion for PCT Application No. PCT /US2004/029614, completed on Feb. 11, 2005, dated Mar. 3, 2005, 9 pgs.
International Search Report and Written Opinion, International Patent Application No. PCT/US2017/058820, dated Jan. 5, 2018, 11 pgs.
Japanese Patent Application 2021-529471 Office Action issued Oct. 18, 2023.
Joint Motion to Terminate for Inter Partes Review of U.S. Pat. No. 9,022,260 (IPR2016-01870) and U.S. Pat. No. 8,590,757 (IPR2016-01866), 3 pgs.
Jones et al., "Guide to Baby Products," Consumer Reports Books, Fourth Edition, Dec. 1995, 10 pages.
Jones, S., "Guide to Baby Products," Consumer Reports, Completely Revised Seventh Edition, 2001, 21 pages.
Jones, Sandy, Back Packs and Soft Carriers, Guide to Baby Products, Consumers Digest, 1998, Ch. 4, pp. 33-40.
Jones, Sandy, Back Packs and Soft Carriers, Guide to Baby Products, Consumers Reports, 1991, pp. 9-15.
Jones, Sandy, Getting Around, Guide to Baby Products, Consumers Digest, 2001, pp. 41, 55-60, 157-160, 199-201.
King, F.H, "Farmers of Forty Centuries," Copyright 2002 Blackmask Online, www.blackmask.com, 118 pages.
Kirkilionis, E., Das Tragen des Siiuglings im Hilftsitz—eine spezielle Anpassung des menschlichen Traglings. Zoologische Jahrbiicher, 1992, 96 (3), 395-415.
Kirkilionis, E., Die Grundbediirfnisse des Sauglings und deren medizinische Aspekte—<largestellt und charakterisiert am Jungentypus Tragling. notabene medici, 1997, 27 (2), 61-66, 27 (3), 117-121.
Kirkilionis, E., Ein Baby will gatragen sein, 1999, 171 pgs.
Kirkilionis, E., Worauf Eltern beim Kauf von Tragehilfen fiir Sauglinge achten sollten, 1994.
Knapik, J., "Physiological, Biomechanical and Medical Aspects of Soldier Load Carriage", RTO HFM Specialist Meeting on Soldier Mobility Innovation in Load Carriage System Design and Evaluation, Kingston, CA, Jun. 27-29, 2000, 20 pgs.
Korean Patent Application No. 10-2019-7015083, Notice of Allowance, mailed Oct. 25, 2022.
KR Application No. 10-2019-7015083 Korean Office Action dated Apr. 28, 2022.
Krantz, L. and Ludman-Exley, S., "The Best of Everything for Your Baby," Copyright 2000 by Prentice Hall, Inc., 18 pages.
Lascal M1 Carrier User Manual, ASTM F2236-16a, EN13209-2:2015, US-80006 Ver13, www.lascal.net.
Laury, Jean Ray, Baby Carrier, A Treasury of Needlecraft Gifts for the New Baby, 1976, pp. 90-93.
Leveau, Barney F., et al., "Developmental biomechanics," Physical Therapy, 64.12, 1984:1878.
Longe, Jaqueline L., Baby Carrier, How Products are Made: An Illustrated Guide to Product Manufacturing, 2001, vol. 6, pp. 8, 22-26.
LUCKY Industries Co., Ltd., LUCKY 1934 LUCKY Fuwa Hug, Waist Belt Type, https://lucky-industries.jp/products/lucky 1934-fuwa-hug/, Japan.
LUCKY Industries Co., Ltd., LUCKY 1934 (Lucky 1934) fuwahug Fuwahug Baby Carrier Baby Strap L4620 (from 14 days old), https:// luckybabystore.jp/products/fuwahug 2023, Japan.
Mackie, H.W. et al., "The effect of simulated school load carriage configurations on shoulder strap tension forces and shoulder interface pressure", Applied Ergonomics, 36, 2005, pp. 199-206.
Martin, et al., "A Mathematical Model of the Inertial Properties of a Carrier-Backpack System vol. IV", United States Army Natick, Research and Development Laboratories, Natick, MA, May 1982, 89 pgs.
Martin, et al., "Effects of Gender, Load, and Backpack on the Temporal and Kinematic Characteristics of Walking Gait vol. III", United States Army Natick, Research and Development Laboratories, Natick, MA, Apr. 1982, 77 pgs.
Martin, J. and Hooper, R., "Military Load Carriage: A Novel Method of Interface Pressure Analysis," RTO HFM Specialists' Meeting on "Soldier Mobility: Innovations in Load Carriage System Design and Evaluation," Jun. 27-29, 2000, 9 pgs.
Meet Isara Quick Half Buckle Carrier, https:// www.yumpu.com/en/document/read/63362302/isara-quick-half-buckle-carrier.
Moriguchi Yuko, JP-2014176494A, Google translation, dated Sep. 2014, 14 pgs.
Najell Rise, Baby Carrier | 0-3 years | 3 Carrying Position, https://najell.com/p/najell-rise-jet-black.
Nelson, et al., "Effects of Gender, Load, and Backpack on Easy Standing and Vertical Jump Performance vol. II", United States Army Natick, Research and Development Laboratories, Natick, MA, Mar. 1982, 77 pgs.
Newspaper ad for Napsak Soft Baby Carrier by Evenflow, The Pittsburgh Press (Pittsburgh, Pennsylvania), Thursday, Dec. 12, 1991, p. 57.
Notice of Allowance (with English translation) for Korean Patent Application No. 10-2018-7015023, dated Jul. 9, 2020, 10 pgs.
Notice of Allowance for Chinese Patent Application No. CN-201480023993.2, dated Mar. 5, 2018, 7 pages.
Notice of Allowance for Korean Patent Application No. KR 10-2015-7028949, dated Dec. 13, 2017, 5 pages.
Notice of Allowance for U.S. Appl. No. 15/337,813, dated Feb. 14, 2019, 2 pgs.
Notice of Allowance for U.S. Appl. No. 15/337,813, dated Jul. 1, 2019, 21 pgs.
Notice of Allowance for U.S. Appl. No. 15/337,813, dated Nov. 5, 2018, 2 pgs.
Notice of Allowance for U.S. Appl. No. 15/796,422, dated Apr. 20, 2020, 4 pgs.
Notice of Allowance for U.S. Appl. No. 15/796,422, dated Jul. 25, 2019, 5 pgs.
Notice of Allowance for U.S. Appl. No. 15/796,422, dated Mar. 27, 2019, 53 pgs.
Notice of Allowance for U.S. Appl. No. 15/916,990, dated Aug. 15, 2018, 15 pgs.
Notice of Allowance for U.S. Appl. No. 15/916,990, dated Nov. 9, 2018, 44 pgs.
Notice of Allowance for U.S. Appl. No. 16/204,581, dated Aug. 19, 2019, 5 pgs.
Notice of Allowance for U.S. Appl. No. 16/204,581, dated Oct. 9, 2019, 3 pgs.
Notice of Allowance for U.S. Appl. No. 16/551,286, dated Aug. 18, 2020, 2 pgs.

(56) References Cited

OTHER PUBLICATIONS

Chinese Patent Application 202111280861.6 Notification of the First Office Action issued Dec. 27, 2023.
European Patent Application 23181194.4 Extended Search Report issued Jan. 4, 2024.
Portier, Limited Edition Limitlesscarrier—Papillon Denim, https://portier.com.au/collections/featured/products/limited-edition-limitless-carrier-papillon-denim.
European Patent Application 19889231.7 Intent to Grant issued Mar. 25, 2024.
European Patent Application 21180405.9 Notice of Opposition issued Apr. 2, 2024.
European Patent Application 19889231.7 Communication pursuant to Rule 114(2) EPC issued Apr. 16, 2024.
Screen captures of transcript from YouTube video clip entitled "Ergobaby Adapt Carrier Instructions Front Inward with "H" straps," 7 pages, uploaded on Jul. 4, 2016, by user "Ergobaby UK & Ireland". Retrieved from Internet: https://www.youtube.com/watch?v=pET5hq_hfL8&ab_channel=ErgobabyUK%26Ireland.
Japanese Patent Application 2021-529471 Notice of Allowance issued May 28, 2024.
U.S. Appl. No. 18/196,539 Notice of Allowance issued Jul. 10, 2024.
*BabyBjörn AB* v. *The Ergo Baby Carrier, Inc.*, Petition for Inter Partes Review of U.S. Pat. No. 11,786,055, United States and Trademark Office Before the Patent Trial and Appeal Board, IPR2025-00110, filed Oct. 29, 2024.
*BabyBjörn AB* v. *The Ergo Baby Carrier, Inc.*, Petition for Inter Partes Review of U.S. Pat. No. 11,786,055, United States and Trademark Office Before the Patent Trial and Appeal Board, IPR2025-00111, filed Oct. 29, 2024.
*BabyBjörn AB* v. *The Ergo Baby Carrier, Inc.*, Petitioner's Declaration of David Smith, P.E., CSP, In Support of Petition For Inter Partes Review of U.S. Pat. No. 11,786,055, United States and Trademark Office Before the Patent Trial and Appeal Board, IPR2025-00111, filed Oct. 29, 2024.
*BabyBjörn AB* v. *The Ergo Baby Carrier, Inc.*, Petitioner's Declaration of David Smith, P.E., CSP, In Support of Petition For Inter Partes Review of U.S. Pat. No. 11,786,055, United States and Trademark Office Before the Patent Trial and Appeal Board, IPR2025-00110, filed Oct. 29, 2024.
BabyBjorn Baby Carrier Synergy Owners Manual, 2007, www.babybjorn.com.
Korean Patent Application 10-2021-7019475, Office Action, issued Dec. 9, 2024.

ADJUSTABLE CHILD CARRIER

RELATED APPLICATION

This application is a continuation of U.S. patent application Ser. No. 18/136,979, filed Apr. 20, 2023; which is a continuation of U.S. patent application Ser. No. 18/108,979, filed Feb. 13, 2023; which is a continuation of U.S. patent application Ser. No. 17/349,821 filed Jun. 16, 2021, now U.S. Pat. No. 11,583,104 issued Feb. 21, 2023; which is a continuation of U.S. patent application Ser. No. 16/551,286 filed Aug. 26, 2019, now U.S. Pat. No. 11,051,634 issued Jul. 6, 2021; which is a continuation of U.S. patent application Ser. No. 15/337,813 filed Oct. 28, 2016, now U.S. Pat. No. 10,426,275 issued Oct. 9, 2019; which claims the benefit of priority to U.S. Provisional Patent Application No. 62/248,745 filed Oct. 30, 2015. The disclosures of which are incorporated herein by reference in their entirety.

TECHNICAL FIELD

The present disclosure relates to child carriers. Even more particularly, the present disclosure relates to a child carrier that is adaptable to ergonomically carry a child as the child grows.

BACKGROUND

Various child carriers are currently available for transporting a child by a parent or other individual. Child carriers have become popular for carrying infants and toddlers because they afford the wearer freedom of hand and arm movement while carrying a child. In pursuit of child safety, some of these devices have become overly complex involving, among other things, rigid seats and frames which considerably increase the weight of the carrier and cannot accommodate for the growth of the child. These complex carriers are relatively heavy and place an undue strain upon the wearer, particularly in the lumbar region. In addition, because of the size of many of the present day carriers, they can only be worn on the back thus denying the child the comfort and security of a position where a child and its mother may be in a face-to-face relationship.

Soft structured carriers have become increasingly popular because they are lighter, less cumbersome and more comfortable to wear. These carriers incorporate padding, stitching and fabrics, rather than a rigid frame, to provide the structure. However, some soft-structured carriers hold a child in an upright position with the child's legs hanging down and the base of the child's spine supporting the child's bodyweight. This position may not be optimal for infant and other young children. While an adult spine has four curves, a young child's spine only has two curves. A majority of a young child's spine will form a C-shape (so-called total kyphosis). Positioning a young child, particularly an infant, in an upright position may unduly limit curvature of the spine and puts stress on the infant's sacrum. This can cause the infant's pelvis to tilt backward limiting leg and hip movement, which may impede healthy development of the infant's pelvis.

Moreover, conventional soft structured carriers are usually designed for a very limited age, weight and size of child and make compromises regarding the shape of the carrier to accommodate a range of ages. Even if a carrier supports ergonomic positioning of the child at one age/weight/size, positioning a child in an ergonomic position through the range of ages while utilizing the same carrier poses a problem as different children develop at different rates and the anatomy and physiology of children changes dramatically between infancy and toddlerhood.

A carrier designed for infants or younger babies may not accommodate a child as the child grows into toddlerhood because the seat and back support portions of the carrier will become too small. In an attempt to make carriers more adaptable, some carriers provide additional panels that can be unfolded and added to the seat to widen the seat and/or back panels that can expand (e.g., by unfolding additional back panel material or attaching new panels) to accommodate the child's growth. However, simply widening the seat or lengthening the carrier does not adequately address proper ergonomics.

On the other hand, a carrier designed for older children may not properly support an infant. One solution to this problem is the use of a specially designed "infant insert." In general, an infant insert is an accessory that incorporates additional padding and structure and makes it possible to carry a small infant in a carrier that would not otherwise properly support the infant. However, not all carriers support the use of infant inserts. Moreover, depending on design, infant inserts may be cumbersome, non-intuitive, and easily lost. In particular, the use of a separate infant insert may require that parents keep track of two separate devices and may significantly increase the difficulty of configuring the carrier for a wearer, the wearing of the carrier, or the ingress and egress of a child to the carrier.

Due to the foregoing issues, parents often opt for changing carriers as the child ages.

SUMMARY

Embodiments described herein provide a wearable child carrier that can be adapted to a baby's size and provide ergonomic positioning of the child throughout the range of the carrier adjustability.

According to one embodiment, a child carrier includes a waist belt adapted for securing about a wearer's hips and a main body coupled to the waist belt, where the main body adapted to form a child carrying area in cooperation with a wearer's torso. The main body can include a torso support portion configured for supporting at least the torso of a child; and an adjustable bucket seat configurable in a plurality of bucket seat configurations, each of the plurality of bucket seat configurations having a different bucket seat depth and bucket seat width and adapted to support a child in a corresponding size range in a spread squat position. In one embodiment, the plurality of bucket seat configurations comprises a configuration adapted to support an infant in a spread squat position without an infant insert. The plurality of bucket seat configurations may include a configuration adapted to support a toddler in a spread squat position.

The child carrier can include one or more adjustment areas adapted to adjust the bucket seat depth and the bucket seat width. In one embodiment, the child carrier has a minimum wearable height that is dependent on the bucket seat depth.

In accordance with one aspect, the plurality of bucket seat configurations comprises a first configuration adapted to support a child in a first size range in a first spread squat position; and a second configuration adapted to support a child in a second size range in a second spread squat position. The first configuration may have a first bucket seat width and first bucket seat depth and the second configuration may have a second bucket seat width and a second bucket seat depth, wherein the first bucket seat width is less than the second bucket seat width and the first bucket seat depth is greater than the second seat bucket depth.

In one embodiment, the main body further comprises a seat center portion coupled to the waist belt and torso support portion and thigh supports disposed on either side of the seat center portion. The thigh supports can be adapted to pass under and support a child's thighs and cooperate with the seat center portion to form the bucket seat. The carrier can further include a base width adjuster coupled to each thigh support. The base width adjusters can be configured for selective coupling to the waist belt in multiple locations to adjust a width of the main body at the waist belt. The base width adjusters can also be configured for selective coupling to the waist belt in multiple locations to adjust the bucket seat depth.

The child carrier may include one or more fabric shaping members adapted to control a bulge of the bucket seat. As one example, the fabric shaping members may comprise darts disposed between the thigh supports and the seat center portion, where the darts are adapted to open or close responsive to adjustment of the base width adjusters. The base width adjusters may be configurable in a first setting corresponding to a maximum bucket seat depth and a second setting corresponding to a minimum bucket seat depth, wherein the darts or other fabric shaping members have a first shape corresponding to the first setting and a second shape corresponding to the second setting.

In accordance with one embodiment, the seat center portion comprises laterally outer edges and the thigh supports comprise laterally inner edges. The fabric shaping members may be disposed between the laterally outer edges and the laterally inner edges. The base width adjusters can be adjustable through rotation to rotate the laterally inner edges relative to the laterally outer edges to open or close the fabric shaping members. Furthermore, adjusting the base width adjusters can increase or decrease the bucket depth/shape.

The carrier may further include thigh width adjusters comprising thigh width adapters coupled to the thigh supports where the thigh width adapters can adjust the width of the bucket seat.

The carrier may also include a neck support configurable in an inside folded down position in which the neck support is positioned in the child carrying area to support a child's neck. The neck support may also be configured in an extended position to provide additional carrier length and support for a larger child, or additional neck support and coverage for a sleeping baby. The neck support may also be configurable in an outside folded down position.

According to one embodiment, a method of configuring a child carrier can comprise: for a child to be carried, adjusting a bucket seat of the child carrier to a child's size and positioning the child in a child carrying area of the child carrier such that the child is supported in an ergonomic spread squat position. Adjusting the bucket seat to the child's size can include configuring a depth of the bucket seat by coupling base width adjusters of the child carrier to a waist belt of the child carrier at positions for a base width setting corresponding to the child's size and adjusting thigh width adapters to adjust a width of the bucket seat. Configuring the depth the bucket seat may further comprise rotating the base width adjusters to open or close darts. The method may further include configuring an adjustable neck support to fill a portion of the child carrying area and support a child's neck.

Embodiments described herein provide an advantage over prior carriers because the ergonomic bucket seat gradually adjusts to a growing baby from newborn to toddler, to ensure baby is seated in an ergonomic spread-squat, natural "M shape" position at multiple stages.

As an additional advantage, embodiments described herein can provide an adjustable seat shape that does not require adding to or removing structure from the carrier to change the seat shape. For example, some embodiments can accommodate infants and larger children without requiring an infant insert for an infant.

Embodiments described herein can provide another advantage by allowing for easy adjustment of the carrier seat shape without adding or removing panels from the seat.

Embodiments described herein can provide another advantage by providing a carrier with a wearable length that can be adjusted without requiring complicated mechanisms to extend the overall length of the carrier.

BRIEF DESCRIPTION OF THE DRAWINGS

For a better understanding of these and other objects of the invention, reference will be made to the following detailed description of the invention which is to be read in association with the accompanying drawings, wherein.

DETAILED DESCRIPTION

Figure 1:
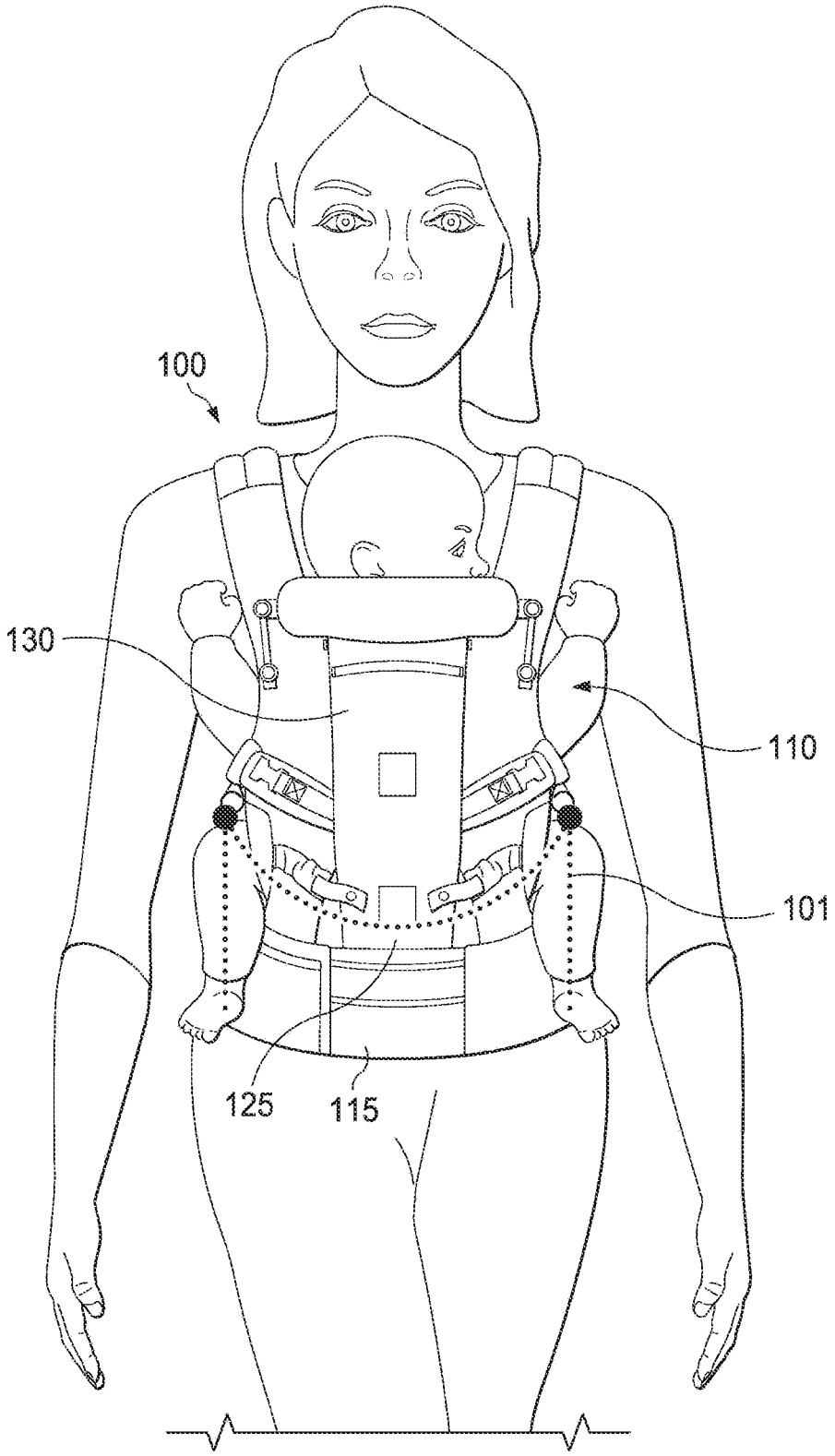
FIG. 1 is a diagrammatic representation of an adult wearer carrying a child in an adjustable carrier.

Child carriers and related methods and the various features and advantageous details thereof are explained more fully with reference to the nonlimiting embodiments that are illustrated in the accompanying drawings and detailed in the following description. Descriptions of well-known starting materials, processing techniques, components and equipment are omitted so as not to unnecessarily obscure the invention in detail. It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

The present disclosure relates to child carriers that allow a child, including an infant, to be carried in a manner that supports the child and maintains the child's pelvis and thighs in a preferred ergonomic position through a range of ages. In particular, embodiments described herein provide carriers that support the child's bottom, pelvis and thighs in a desired position. Embodiments described herein also allow a child to be carried on the front or back or to the side of the person carrying the child. The carrier can be worn by a user in front of, in back of or to the side of the wearer with the child's weight carried near the wearer's center of gravity and close to the wearer's front, back or side in a front, back or side position, respectively.

The adjustable child carrier can be configured to accommodate children of a wide range of sizes in a front, rear or side carrying position while supporting the child's hips, pelvis, bottom and both upper thighs when the child is being carried in various orientations. For example, embodiments of a child carrier as disclosed herein may provide an adjustable child carrier usable with a newborn children (infant) (e.g., around 7 pounds) and additionally with children all the way to up to around 45 pounds or more.

In accordance with one aspect of the present disclosure, a carrier includes a bucket seat for a child and one or more adjustment areas that when adjusted serve to adjust a depth of the seat bucket and a height of the child carrier. When adjusted to a newborn setting, the carrier is configured such that the depth of the seat bucket may be at a maximum. Conversely, when adjusted to its maximum, or largest size, setting (e.g., a setting for the largest child the carrier is designed to accommodate) the depth of the seat bucket may be at a minimum. When the depth of the bucket seat is at a maximum the thighs may be supported such that the angle of the thighs of the child relative to the coronal plane may be greatest and when the depth of the bucket seat is at a minimum the thighs may be supported such that the angle of the thighs of the child relative to the coronal plane may be the smallest. Similarly, then, the bucket seat is at a maximum, the carrier may be configured such that the carrier maintains a child carried therein with relatively more curve in their spine than when the bucket seat is at a minimum depth.

A child carrier may include one or more adjustment points that work alone or in cooperation to adjust the shape of the bucket seat area provided by the child carrier. These adjustment points may include base width adjusters adapted to adjust the width of the main panel of the baby carrier at a point where the main panel is coupled to the waistband of the carrier. The adjustment of the width of the base of the main panel may serve to provide maximum shape for the bucket area and thus maximum depth of the bucket seat area when adjusted to the narrowest setting for newborn babies and the minimal depth of the bucket seat area for the largest children when adjusted to the widest setting.

Another adjustment point provided by embodiments may be thigh width adjusters. These thigh width adjusters are configured to adjust the width of the main panel of the baby carrier at a point in the main panel configured to accommodate the thighs of a child. The thigh width of the main panel may be smallest at the tightest or smallest setting of the thigh width adjusters for newborn babies and widest at its largest or loosest setting (which may be fully released or not engaged) for the largest children (e.g., that the carrier is designed to accommodate).

These adjustment points may also work in cooperation to adjust the baby carrier. For example, the thigh width adjusters may also serve as more granular adjustment for the bucket area within the range of gross adjustment provided by the base width adjuster.

The carrier of certain embodiments may also be configured to adjust in height. In certain embodiments, the length of the physical carrier from the top edge of the waist belt at the center to the top edge of carrier at the center remains consistent, however, the wearable height changes depending on the setting of the bucket seat size. With the base width at its smallest/narrowest setting the bucket seat is deeper consuming more of the carrier length measurement, thus leaving less measurement for the wearable height while with the base width at is largest/widest setting the bucket seat is shallow consuming less of the carrier length measurement, thus leaving more measurement for the wearable height.

Embodiments of such carriers may also include an adjustable neck support. Such a neck support or collar that may be positioned according to the direction the child is facing, the size of the child, or other criteria. The adjustable neck support may be rotatable relative to the main panel such that the neck support may be extended increasing the center height of the carrier giving additional back or neck support for a child (depending on the size of the child). The neck support may also be folded back away from the wearer to reduce the height of the carrier (e.g., for non-infant children). The neck support may also be folded down into the carrier toward the wearer such that it may reside inside the child carrying area to give an infant or other child additional head or neck support.

Embodiments as disclosed herein may therefore provide an adjustable child carrier configured to accommodate children of a wide range of sizes in a front, rear or side carrying position. Embodiments may thus be sized appropriately to carry an infant without the use of an additional infant insert. Configured according to such a setting, the carrier may be adapted for placement of a child in a child carrying area of the child carrier with the infant's knees raised. In one embodiment, when adjusted to accommodate an infant the carrier is adapted to support the infant in a position with the infant's femur at an angle of 90-120 degrees from the coronal plane. Additionally, the carrier can be adapted to support the infant in a position with the infant's knees at 45-60 degrees from the median plane. In particular embodiments, the carrier can be adapted to promote a spread-squat-position.

The carrier can be ergonomic for the wearer as well. A padded waist belt may provide lumbar support and may cooperate with shoulder straps (that may attach to the same or opposite sides of the carrier) that can form a configurable harness that can position the carrier in a front, side or back carry position while distributing the weight evenly to the wearer. The carrier may be adjusted such that the child is positioned close to the wearer's center of gravity which distributes the child's weight evenly. In some embodiments, the harness may be adjusted so that a majority of the child's weight is transferred to the wearer's hips.

FIG. 1 is a diagrammatic representation of an adult wearer carrying a child in an adjustable carrier 100. Adjustable carrier comprises a main body 110 coupled to a waist belt 115. Main body 110 includes a torso support portion 130 and a bucket seat 125. The torso support portion 130 is configured for supporting the upper body of the child while in the carrier 100. The seat 125 is configured for supporting the legs, hips and posterior of the child in an ergonomic position. As discussed in more detail below, embodiments of adjustable carrier 100 can include various adjustments such that carrier 100 can be adjusted as the child grows to support the child in an ergonomic spread squat position appropriate for the weight or size of the child with the child's pelvis, bottom and thighs all being supported. In an ergonomic spread squat position (also known as the "frog leg", "frog", "squat spread" or "M" position) (indicated by line 101) the flexion at the hip joint is at least 90° and in some cases is 110° to 120° from the coronal plane, and the spreading angle can average at approximately 45-55° from the median plane. As carrier 100 is adjustable, the angle of the hips and spread can depend on the settings of the carrier 100 and developmental stage of the child.

In one embodiment, the carrier can be adapted to support the child in a position with the child's femur approximately 90° to 120° (or other elevated position) from the coronal plane and to position the child's knees with an amount of spreading. The amount of spreading may depend on the developmental stage of the child and orientation with a newborn having less than 30°, then approximately 30°, then approximately 35°-40° and so on so, such that the final spread is approximately 40°-45°, though other amounts of spreading may be achieved including (e.g., for example approximately 55°). In one embodiment, the spreading may be at least 20° degrees from the median plane. The child's weight can be distributed across the child's bottom, thighs and back so that the sacrum does not bear too much weight and the child can rest with a more naturally curved "C" spine in a spread squat position that is believed to be better for pelvic development. It can be noted, however, that the child can be positioned in any comfortable position, preferably emphasizing a supportive posture rather than a posture where the child is primarily sitting on his or her sacrum.

Figure 2A:
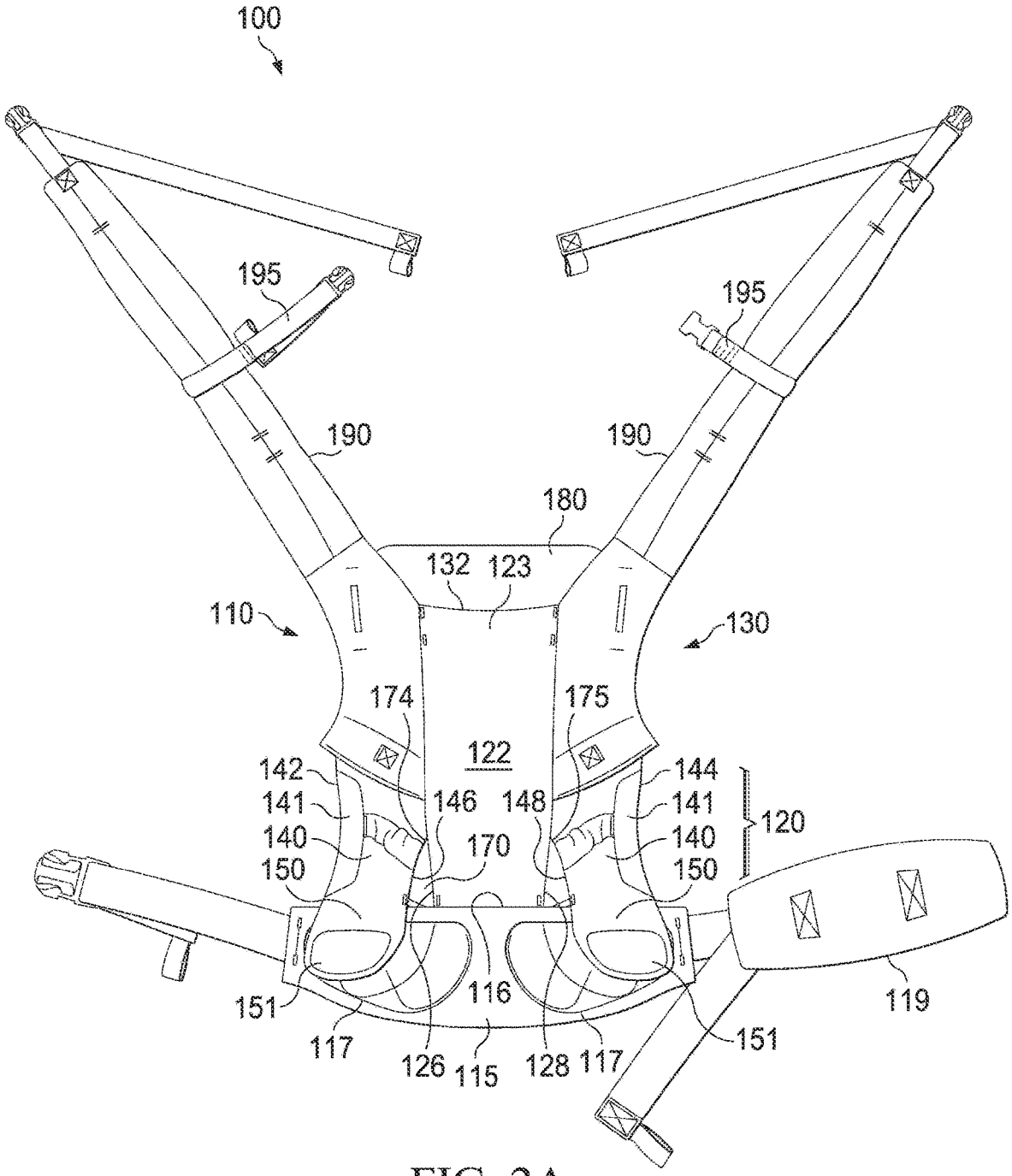
FIG. 2A is a diagrammatic representation of an inside view of one embodiment of an adjustable baby carrier.
Figure 2B:
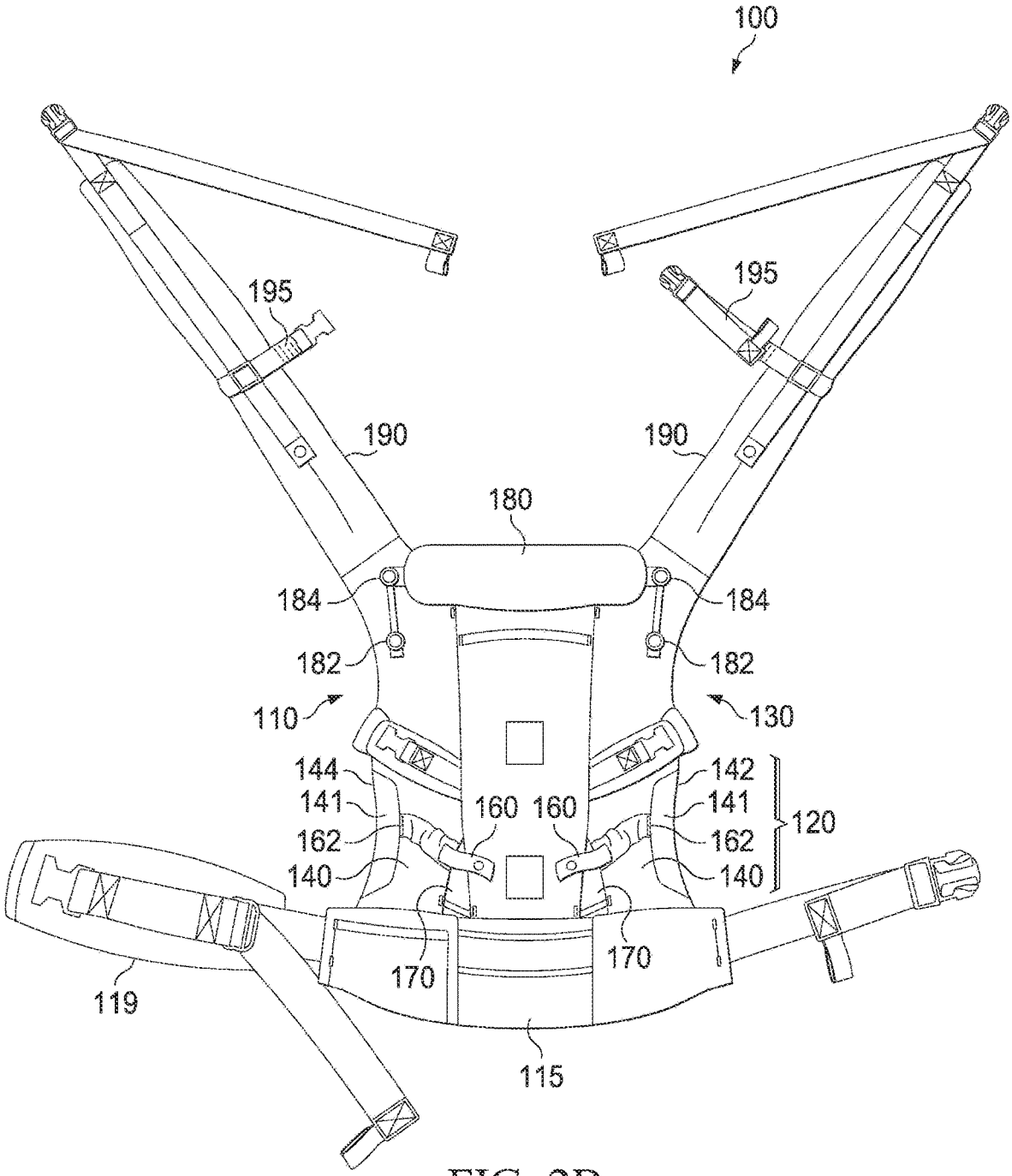
FIG. 2B is a diagrammatic representation of an outside view of one embodiment of adjustable carrier.

FIG. 2A is a diagrammatic representation of an inside view of one embodiment of an adjustable baby carrier 100 and FIG. 2B is a diagrammatic representation of an outside view of one embodiment of adjustable carrier 100 (FIGS. 2A and 2B are referred to collectively herein as FIG. 2). Carrier 100 comprises a main body 110 coupled to a waist belt 115. Main body 110 includes an upper torso support portion 130, a seat portion 120 and thigh support areas 140. Carrier 100 may also include shoulder straps 190 and a chest strap 195. A child can be supported in a child carrying area created by the main body 110 in cooperation with the wearer's torso. Torso support portion 130 is configured to support upper body of the child while in the carrier while seat portion 120 cooperates with adjustable thigh support areas 140 to form an adjustable bucket seat 125 (FIG. 1) adapted to ergonomically position the child's legs and hips. Waist belt 115 and shoulder straps 190 provide a harness that distributes the child's weight to the wearer. Chest strap 195 can be used to secure left and right shoulder straps together.

Bucket seat portion 120 and thigh support areas 140 are adapted to pass from the outer side of the child carrying area (the side away from the wearer's torso) to inner side to form supportive and adjustable bucket seat 125. Inner end portions of thigh support areas 140 can be selectively coupled to waist belt 115 by base width adjusters 150 that are configurable for adjusting the width and depth of the bucket seat 125. Thigh width adjusters 160 can also be provided to provide additional width adjustment. Thus, the bucket seat 120 can be adjusted to accommodate a range of ages/sizes/weights.

The supportive and adjustable bucket seat 125 can have a generally concave (e.g., "C" shape) inner profile from the inward side to the outward side and from right to left. Seat side edges 142, 144 (formed by the edges of thigh support areas 140) can be higher than the center of the seat and can be spaced such that the side edges pass under and around the child's thighs at a distance from the child's hips such that the child's legs (e.g., above the knee) do not dangle down. In some embodiments, thigh support areas 140 may provide additional support. In particular, in certain embodiments the thigh support areas 140 may include gathers, elastic material or another type of biasing material.

Bucket seat portion 120 comprises a seat center portion 122 that is coupled to waist belt 115 or other portion of carrier 100 at one end and to upper torso support portion 130 at the other end. Seat center portion 122 may be formed from a single piece of material, or may be formed from multiple pieces of material, multiple layers of materials, or multiple materials. The junction between upper torso support portion 130 and seat center portion 122 may be a substantially seamless transition. For example, in one embodiment, a center panel 123 may form seat center portion 122 and an upper torso center panel such that seat center portion 122 and the upper torso center panel comprise a unitary construction of one or more layers of material. In other embodiments, the junction may include seams, edges or other features delineating between upper torso support portion 130 and seat center portion 122.

Thigh support areas 140 are disposed to the left and right of seat center portion 122. Thigh support areas 140 may be selectively coupled to waist belt 115 by base width adjusters 150 such that thigh support areas 140 pass under and around the child's thighs at a distance from the child's hips where the portion of the thigh support areas 140 that pass under and around the child's thighs is higher than the child's bottom so that the child's knees are lifted. The thigh support areas 140 can have sufficient stiffness such that the child's thighs may be encouraged to spread by the thigh support areas 140 or wearer's torso. In one embodiment, thigh support areas 140 provide areas of thigh padding 141 to support the child's thighs.

Base width adjusters 150 may be coupled to respective thigh support areas 140. In one embodiment, base width adjusters 150 may comprise flaps or tabs coupled to thigh support areas 140. In the illustrated embodiment, base width adjusters 150 are coupled to a respective thigh support areas 140 by virtue of being part of the same thigh support straps. However, other configurations may also be used. In any event, base width adjusters 150 can be selectively coupled to waist belt 115 to couple thigh support areas 140 of main body 110 to waist belt 115.

Base width adjusters 150 can be used to adjust the width of the base of main body 110 where it connects to waist belt 115. A fastening mechanism 151 of base width adjusters 150, such as a hook and loop material, buttons, snaps, zipper, etc., can cooperate with a corresponding fastening mechanism 117 on waist belt 115 to couple thigh support areas 140 to waist belt 115. The fastening mechanisms 117, 151 are configured such that the base width adjusters 150 may be coupled to the waist belt 115 in multiple positions or throughout a range of positions.

The width of bucket seat 125 proximate to waist belt 115 can be adjusted by changing the position at which base width adjusters 150 are secured to waist belt 115. For example, moving the bottom ends of base width adjusters 150 laterally inboard (rotating base width adjusters 150 inward) decreases the width of main body 110 at the point main body 110 meets waist band 115 and may serve to decrease the width of the bucket seat where thigh support areas 140 pass under the child's thighs. Moving the ends of base width adjusters 150 more laterally outboard (rotating base width adjusters 150 laterally outward) increases the width of the main body 110 where it is coupled to the waist belt 115 and may increase the bucket seat width where the thigh support areas 140 pass under the child's thighs.

Base width adjusters 150 can be used to control the depth of the bucket seat 125. In a minimum (or narrowest) base width setting the base width adjusters 150 may be fastened to the waist belt 115 such that they are maximally proximate one another toward the center axis of the waist belt 115 (given the range or number of positions possible). In this minimum base width setting carrier 100 is configured such that the depth of the seat bucket 125 may be at a maximum. In a maximum (or widest) base width setting, the base width adjusters 150 may be fastened to the waist belt 115 such that they are maximally distal one another away from the center axis of the waist belt 115 (given the range or number of positions possible). In this maximum (or widest) base width setting, carrier 100 is configured such that the depth of the bucket seat 125 may be at a minimum.

Bucket seat portion 120 may include one or more shaping members to facilitate shaping the bucket seat. In one embodiment, bucket seat portion 120 includes gusset portions 170 that span the gap between the respective inner edges 146, 148 of thigh support areas 140 and the laterally outer edges 126, 128 of seat center portion 122. Gusset portions 170 may be fastened to seat center portion 122 at or proximate to laterally outer edges 126, 128 and to thigh support areas at or proximate to laterally inner edges 146, 148 to form a first dart having a dart apex 174 generally pointing toward the bottom of the bucket seat 125 and dart legs defined by the connections at or proximate to edges 126, 146 and a second dart having a dart apex 175 and dart legs defined by the connections at or proximate to edges 128, 148. The dart legs can be closed or opened to gather or release the darts. In particular, by adjusting base width adjusters 150 to decrease the angle between seat center portion 122 and thigh support areas 140, the dart legs can be closed and darts deepened. Consequently, bucket seat 125 can bulge further and take on a deeper curve. Conversely, adjusting base width adjusters 150 to increase the angle between seat center portion 122 and thigh support areas 140 opens the dart legs and makes the darts formed by gusset portions 170 shallower. Consequently, the bucket seat 125 formed by carrier 100 will be shallower. While, in the above embodiment, the shaping members are darts, other shaping mechanisms can be used to control the fullness of bucket seat 125 including, but not limited to pleats, gathers or tucks.

Figure 3A:
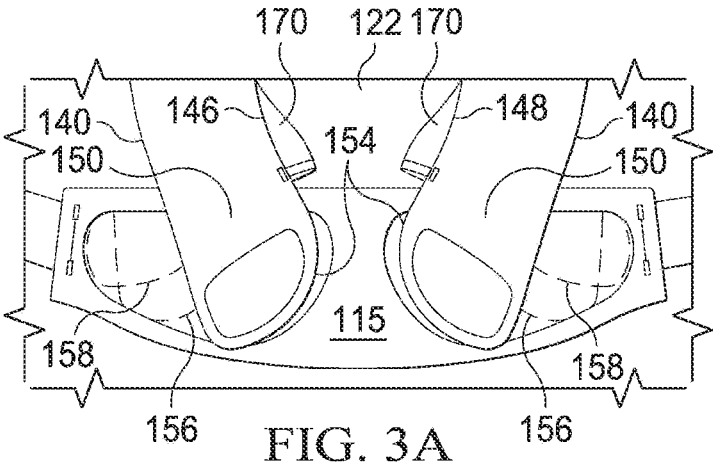
FIG. 3A is a diagrammatic representation of one embodiment of a base width adjuster in a first base width adjuster configuration.
Figure 3B:
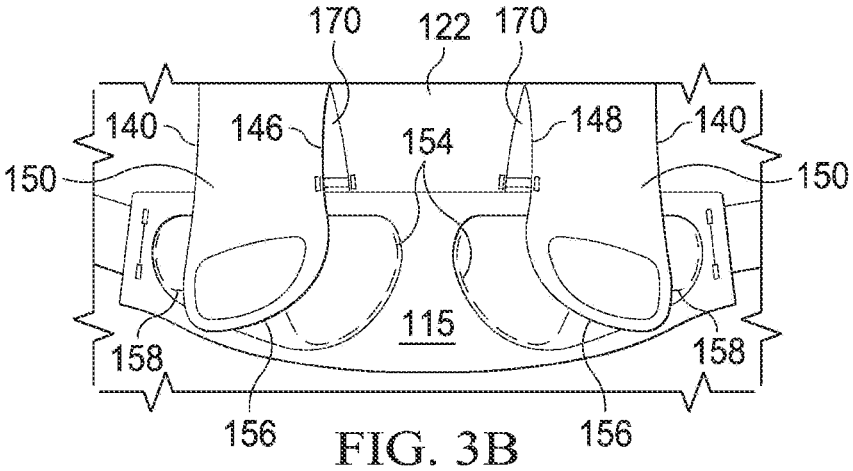
FIG. 3B is a diagrammatic representation of one embodiment of a base width adjuster in a second base width adjuster configuration.
Figure 3C:
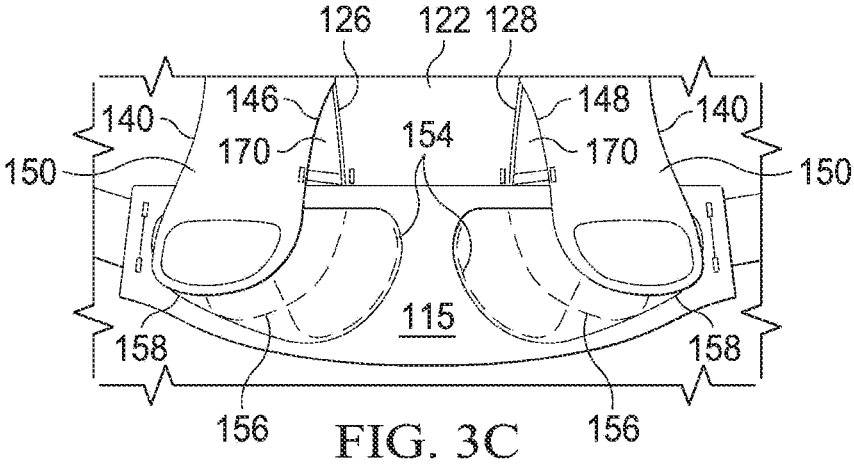
FIG. 3C is a diagrammatic representation of one embodiment of a base width adjuster in a third base width adjuster configuration.

Referring briefly to FIGS. 3A, 3B and 3C (collectively FIG. 3), FIG. 3 illustrates the operation of one embodiment of base width adjusters 150. In FIG. 3, the base width adjusters 150 can be secured to waist belt 115 to either side of the lateral centerline of main body 110 to adjust the width of carrier 100 at thigh support areas 140. In the embodiment illustrated, hook and loop material is used to secure the base width adjusters 150 to waist belt 115 on the side of waist belt 115 sandwiched between waist belt 115 and the wearer. This can increase the hold of the hook and loop material when in use because of the pressure against the base width adjusters 150.

In the embodiment of FIG. 3, each base width adjuster 150 is secured to waist belt 115 in one of three positions 154, 156, 158. These positions may correspond to particular size ranges of children. In FIG. 3A, base width adjusters 150 are secured at positions 154 corresponding to a minimum (or narrowest) base width setting. In FIG. 3B, base width adjusters 150 are secured at positions 156 corresponding to a moderate base width setting. In FIG. 3C, base width adjusters 150 are secured at positions 158 corresponding to a maximum (or widest) base width setting.

It can be noted that base width adjusters 150 as illustrated essentially rotate from a pivot point as they are adjusted. Thus, not only does the lateral position of the attachment position change, the vertical position does as well (e.g., positions 154, 156 and 158 for a base width adjuster 150 are both laterally and vertically displaced from each other). The use of a rotational motion like this provides a greater change in bucket depth for a given lateral change. Other embodiments, however, could use a more linear motion (e.g., in which the attachment positions are horizontally aligned). Furthermore, positions 154, 156 and 158 are provided by way of example. In the embodiment illustrated, base width adjusters 150 can be coupled to fastening mechanism 117 in a continuous range of positions. Other embodiments may provide discrete attachment points.

Referring to FIG. 3A, base width adjusters 150 are fastened to the waist belt 115 such that they are maximally proximate one another toward the center axis of the waist belt 115 (given the range or number of positions possible). However, because laterally inner edges 146, 148 of thigh support areas 140 are drawn close to laterally outer edges 126, 128 (hidden by gusset portion 170) of seat center support part 122, gusset portions 170 form deeply curved darts. Put another way, by fastening base width adjusters 150 to waist belt 115 such that they are maximally proximate one another, the laterally outer edges of gusset portions 170 may be drawn toward the laterally inner edges of gusset portions 170, creating a corresponding greater curve or dart shapes in gusset portions 170. This serves to shape bucket seat portion 120 to increase the depth of the bucket seat portion.

Referring to FIG. 3C, the base width adjusters 150 are secured at positions 158 corresponding to a maximum (or widest) base width setting. In this configuration, the laterally inner edges 146, 148 are rotated away from the respective laterally outer edges 126, 148 of FIG. 3C. In other words, the dart legs are opened to release the darts and create less shape (curve) at the end of the gusset portions 170. By fastening base width adjusters 150 to waist belt 115 such that they are maximally distal one another (again, given the range of possible setting for coupling base width adjusters 150 to waist belt 115), tension may be maintained on outer edges of gusset portions 170 such that gusset portions 170 remain relatively flat. As such, bucket seat portion 120 may be maintained in a relatively flat or less shaped configuration, serving to minimize the depth of the bucket seat 125.

Base width adjusters 150 primarily adjust the width of the seat proximate to waist belt 115. However, moving away from waist belt 115, the seat (edges 142, 144) may flare out. With reference to FIG. 2, thigh width adjusters 160 may be provided to adjust the width of the seat away from waist belt 115. In particular, thigh width adjusters 160 may be adapted to adjust the width of the bucket seat where edges 142, 144 of thigh supports 140 pass under the child's thighs. Thigh width adjusters 160 can be used to pull in thigh support areas 140 so that thigh support areas 140 do not extend past the child's knee and thus prevent thigh support areas 140 from straightening the child's legs or overspreading the child's legs.

In certain embodiments, thigh width adjusters 160 may be coupled to respective thigh support areas 140 and are configured to adjust the width of the carrier at the level of thigh support areas 140. In accordance with one embodiment, each thigh width adjuster 160 may be a piece of material(s) (webbing or other material) that is coupled at a first end 162 to the respective thigh support area 140 proximate to support portions 141 and includes a second end that can be selectively coupled to main body 110 (e.g., to seat center portion 122 or elsewhere). The thigh width adjusters 160 can act as a drawstring system, one on each side, to adjust the width of carrier 100 at thigh level by pulling the thigh support areas 140 laterally inward and thereby further adjusting the width of carrier 100 at the child's thighs.

Figure 4C:
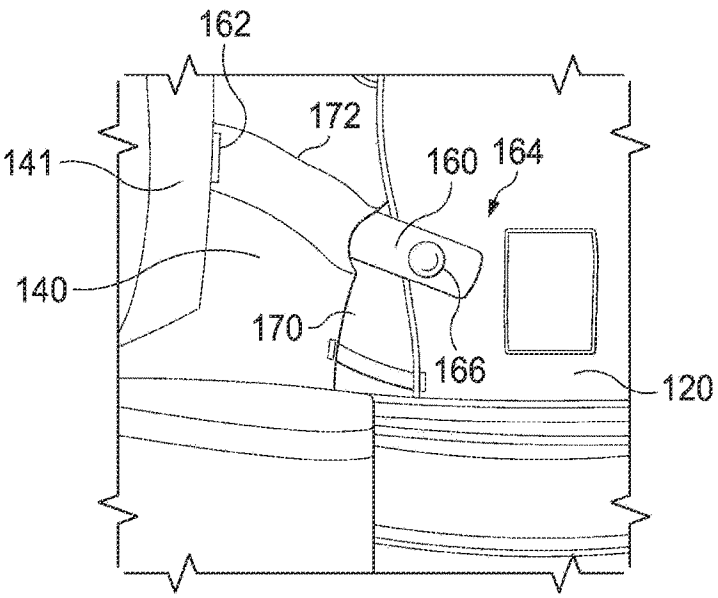
FIG. 4C is a diagrammatic representation of one embodiment of a carrier with thigh width adjusters in a third thigh width adjuster configuration.
Figure 4B:
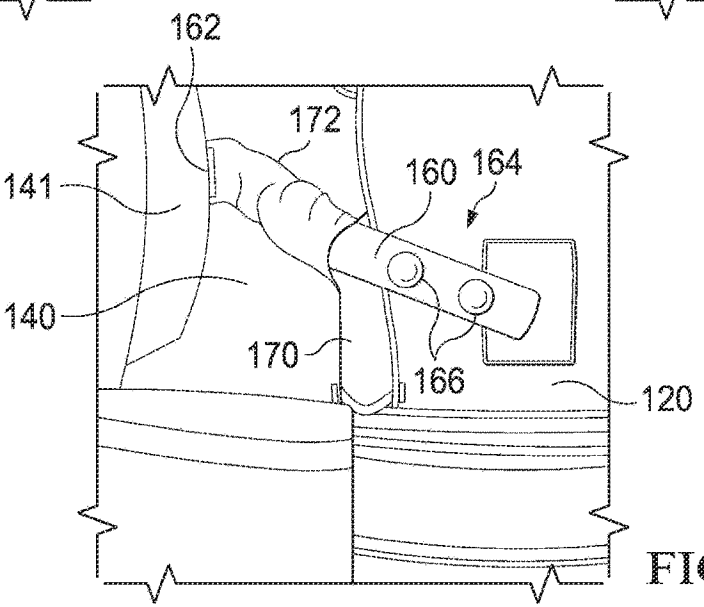
FIG. 4B is a diagrammatic representation of one embodiment of a carrier with thigh width adjusters in a second thigh width adjuster configuration.
Figure 4A:
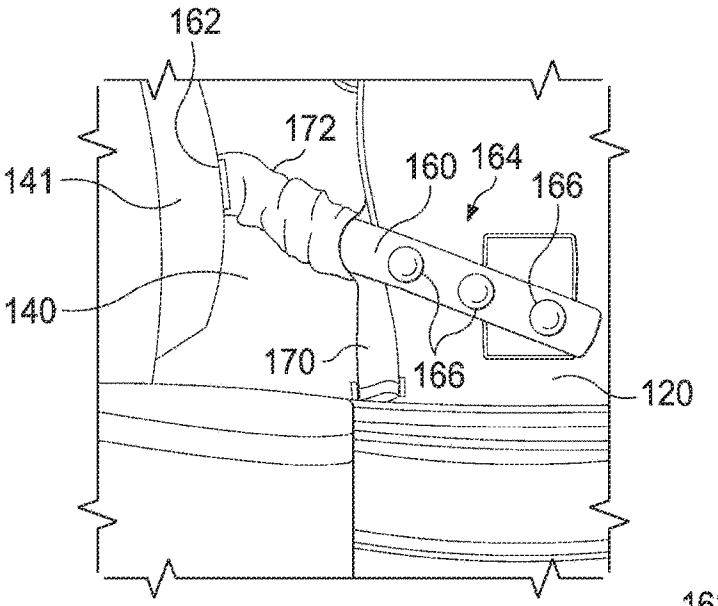
FIG. 4A is a diagrammatic representation of one embodiment of a carrier with thigh width adjusters in a first thigh width adjuster configuration.
Figure 5A:
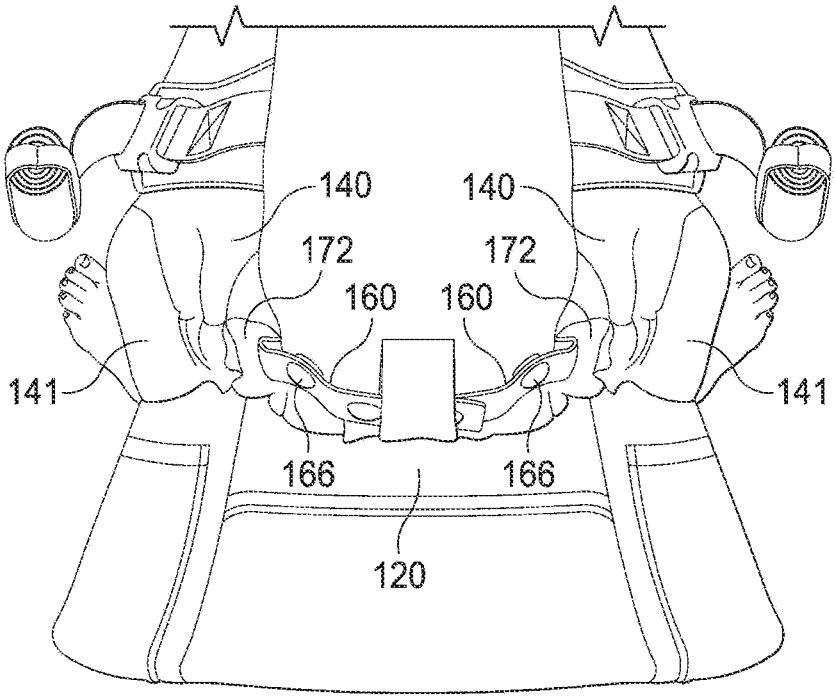
FIG. 5A is a diagrammatic representation of another view one embodiment of a carrier with thigh width adjusters in the first thigh width adjuster configuration.
Figure 5B:
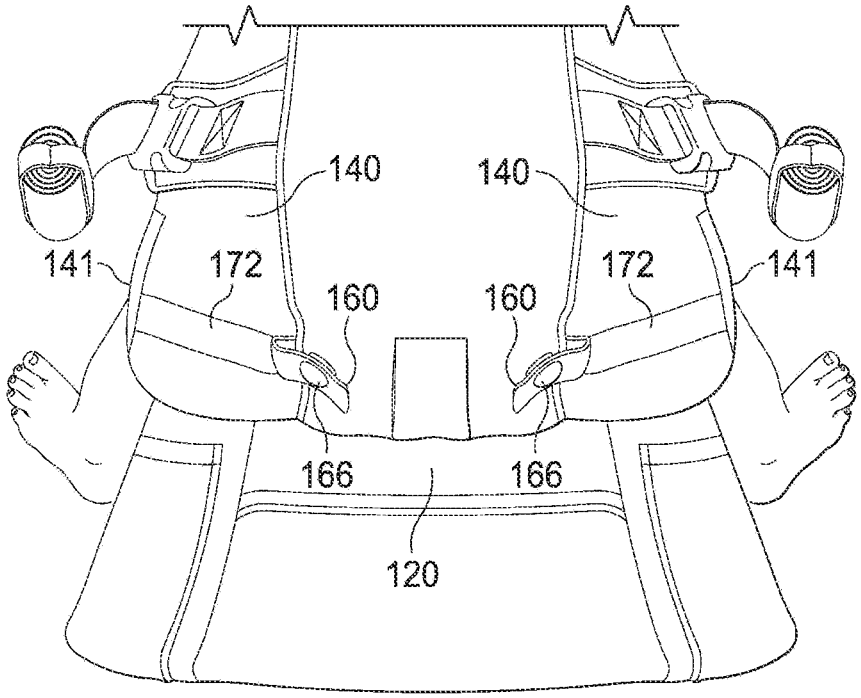
FIG. 5B is a diagrammatic representation of another view of one embodiment of a carrier with thigh width adjusters in the third thigh width adjuster configuration.

Referring briefly to FIGS. 4A, 4B and 4C (collectively FIG. 4) and FIGS. 5A and 5B (collectively FIG. 5), the operation of one embodiment of thigh width adjusters 160 is illustrated. Thigh width adjusters 160 can be selectively coupled to bucket seat portion 120 to pull thigh support areas 140 laterally inward a desired amount. FIG. 4, for example, illustrates the thigh width adjuster 160 secured in three positions corresponding to a narrowest (tightest) setting (FIG. 4A, FIG. 5A), a moderate setting (FIG. 4B) and a widest (loosest) setting (FIG. 4C, FIG. 5B).

In the embodiment illustrated, each thigh width adjuster 160 includes a strip of material that is fastened at first end 162 to the outside of a respective thigh support area 140 proximate to the thigh padding 141 (e.g., near the respective outer edge 142, 144). The thigh width adjuster 160 runs laterally inboard through a fabric tunnel 172 to a distal portion 164 that includes a plurality of spaced thigh width adjuster fasteners 166 (e.g., snaps, buttons, hook and loop, etc.) that can be selectively fastened to a corresponding fastener on bucket seat portion 120 of main body 110.

In FIG. 4A, the thigh width adjuster fastener 166 that is closest to the respective thigh support area 140 is fastened to the corresponding fastener on the bucket seat portion 120. This position corresponds to a narrowest thigh width adjuster setting and, as illustrated in FIG. 5A, thigh support area 140 is gathered inward to decrease the width of carrier 100 at the child's thighs. Conversely, fastening the fastener 166 that is farthest from the respective thigh support area 140 to bucket seat portion 120, as shown in FIG. 4C, may achieve the widest setting of the thigh width adjusters 160. When the thigh width adjusters 160 are in the widest setting position of FIG. 4C, the outer edges of the thigh support areas 140 can spread out as illustrated in FIG. 5B, thus widening carrier 100 at the child's thighs.

As can be understood from the foregoing, the base width adjusters 150 and the thigh width adjusters 160 may work in cooperation to adjust the carrier 100. In accordance with one embodiment, base width adjusters 150 can be used for adjustment of seat depth and provide a gross adjustment of seat width, while thigh width adjusters 160 may serve as granular adjustments for width within the range of gross adjustment provided by the base width adjusters 150. For example, at a particular setting of the base width adjusters 150 of the carrier 100, the width of the carrier 100 at thigh support areas 140 may be narrowest with the thigh width adjusters 160 at their smallest or narrowest (tightest) setting and largest with the thigh width adjusters 160 at their widest (loosest) setting.

Carrier 100 may also adjust in height based on other settings of carrier 100. In particular, adjusting base width adjusters 150 adjusts the wearable back height (length from bottom of bucket seat 125 to top edge 132). This occurs because the length of the physical carrier material from the top edge 116 of the waist belt 115 at center to the top edge 132 of main body 110 at center remains consistent such that the wearable back height changes depending on the setting of the bucket seat size. A deeper bucket consumes more length of material between edges 116 and 132, thus leaving less measurement for the wearable height On the other hand, a shallower bucket consumes less length of material between edges 116 and 132, thus leaving more measurement for the wearable height.

Thus, adjusted to a smallest child mode (e.g., an infant mode) (base width at its smallest/narrowest setting) the bucket seat 125 may be deeper consuming more of the carrier length measurement, thus leaving less measurement for the wearable height (length from bottom of bucket seat 125 to top edge of carrier center panel 123 at center is at its shortest height). Adjusted to a largest child mode (e.g., a toddler mode) (base width at its largest/widest setting) the bucket seat 125 is shallow consuming less of the carrier length measurement, thus leaving more measurement for the wearable height (length from bottom of bucket seat 125 to top edge of carrier center panel 123 at center at its longest height). The carrier thus adjusts to the height of the child based on adjustment to the bucket seat.

Carrier 100 may be adjusted to provide ergonomic support for the child regardless of the size of the child through a supported range. In accordance with one embodiment, carrier 100 can be set for an infant with base width adjusters 150 and thigh width adjusters 160 set at their narrowest settings. In this configuration, the bucket seat will be at its deepest with higher walls at the thigh support areas 140 lifting the child's thighs and knees to a greater angle and into a spread squat position appropriate for that size child. Similarly, carrier 100 can be set for the largest child with the base width adjusters 150 and the thigh width adjusters 160 at their widest settings. In this configuration, the bucket seat may be at its shallowest depth with lower walls at the thigh support areas 140 lifting the child's thighs and knees to a lesser angle and into a spread squat position appropriate for a larger sized child.

Thus, the adjustable bucket seat is configurable in a plurality of configurations having different seat bucket depths and seat bucket widths. The different configurations can be adapted to support a child in a corresponding size range in a spread squat position. For example, in one embodiment, bucket seat can have a first configuration adapted to ergonomically carry a child of 20-24 inches (generally corresponding to an infant of 0-3 months and over 7 pounds) in a spread squat position appropriate for the infant without requiring an infant insert. Furthermore, the carrier can have a second configuration adapted to ergonomically carry a child of 24-28 inches (generally corresponding to an older baby of 3-9 months) in a spread squat position appropriate for that child's size. In addition, the carrier, in this example, can have a third configuration adapted to ergonomically carry a child of 28 inches or greater (generally corresponding to an older baby or toddler of 9-48 months (up to the carrying capacity of the carrier or the wearer)). The first configuration can correspond to the base width being at the narrowest setting (deepest bucket seat) (an infant mode), the second configuration can correspond to the base width being at a moderate setting and the third configuration can correspond to the base width being at a widest setting (shallowest bucket seat) (a toddler mode). It can be noted that the ranges provided above are provided by way of example and not limitation. Furthermore, the seat may have other configurations.

The user can thus adjust the bucket seat 125 to support the child in an ergonomic spread squat position appropriate for the weight or size of the child with the child's pelvis, bottom and thighs all being supported. The child's weight can be supported so that the child is squatting in the seat rather than sitting with the child's weight primarily on the sacrum. The child can be supported with the knees higher than the bottom, in some cases higher than 90 degrees. The bucket seat 125 can be adjusted to form a sling or pouch that is wider than the child's hips in which the child's bottom is supported. The thigh support areas 140 can be adjusted pass under and around the child's thighs at a distance from the child's hips such that the portions of thigh support areas 140 that pass under and around the child's thighs are higher than the child's bottom to lift the child's knees. The thigh support areas 140 can have sufficient stiffness to encourage the child's thighs to spread by the thigh support straps or wearer's torso.

Figure 6C:
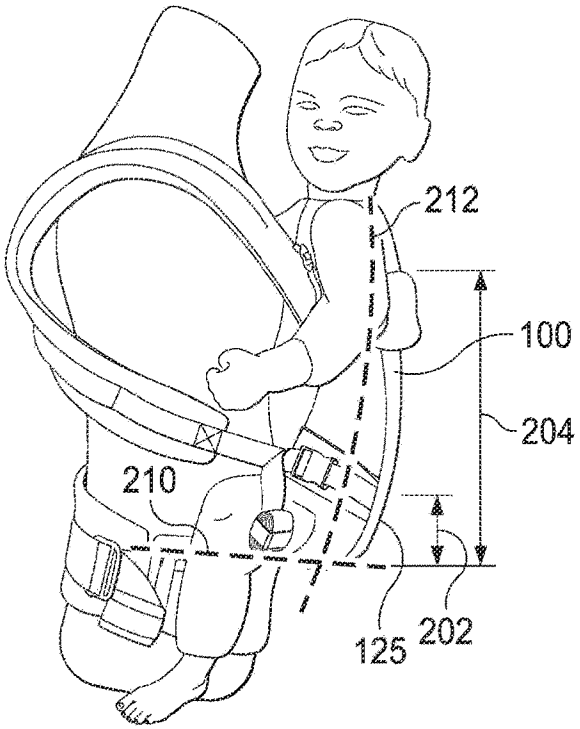
FIG. 6C is a diagrammatic representation of one embodiment of a carrier with bucket seat in a third seat configuration.
Figure 6B:
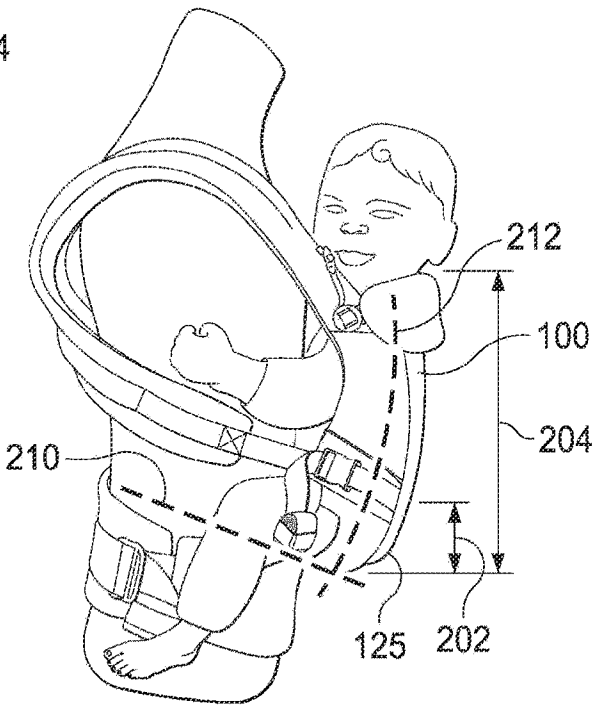
FIG. 6B is a diagrammatic representation of one embodiment of a carrier with bucket seat in a second seat configuration.
Figure 6A:
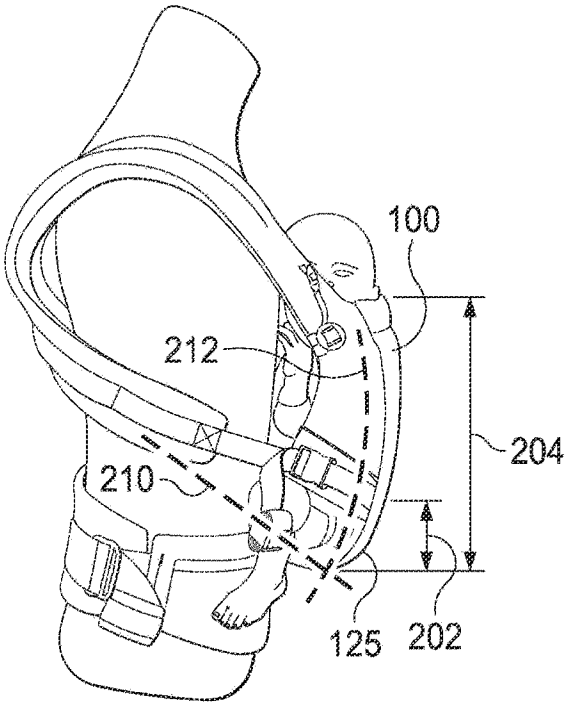
FIG. 6A is a diagrammatic representation of one embodiment of a carrier with bucket seat in a first seat configuration.

FIGS. 6A, 6B and 6C (collectively FIG. 6) are diagrammatic representations of one embodiment of carrier 100 adjusted to accommodate various sized children. FIG. 6A corresponds to the minimum base width setting of FIG. 3A, FIG. 6B corresponds to a moderate base width setting of FIG. 3B and FIG. 6C corresponds to the maximum base width setting of FIG. 3C. Through adjustment of base width adjusters 150 and thigh width adjusters 160, the width of bucket seat 125 and the depth of bucket seat 125 (indicated by depth 202) can be configured. Furthermore, because the length of material of carrier 100 available to support the back depends on the depth of bucket seat 125, adjusting base width adjusters 150 also adjusts the minimum wearable height 204 of carrier 100. As illustrated in FIG. 6, the wearable height 204 of carrier 100 increases with decreasing bucket depth.

With all settings set for a small baby, the seat center portion 122, gusset portions 170 and thigh support areas 140 cooperate to form a deep bucket seat 125 as illustrated in FIG. 6A. The deep bucket seat 125 with higher walls at the thigh (under the knee) tends to lift the child's knees (indicated by line 210) to the appropriate spread squat position and promotes rounding of the back into a c-shape (indicated by line 212). Moreover, a deeper bucket seat 125 shortens the wearable height 204. Thus, the configuration of FIG. 6A may be suitable for infants. As the child grows, the child's spine should naturally straighten and the child will require less knee support. Base width adjusters 150 and thigh width adjusters can be adjusted to widen bucket seat 125 and provide additional back support length to support the child's lengthening spine. As shown in FIG. 6B and FIG. 6C, for example, carrier 100 the bucket seat 125 may be adjusted to provide less knee lift, but enough to maintain an appropriate spread squat position (e.g., for an older baby in FIG. 6B and for a toddler in FIG. 6C) and allow the child to rest with a straighter back.

Returning to FIG. 2, carrier 100 may also include an adjustable neck support 180. Adjustable neck support 180 may be extended to increase the center height of carrier 100, giving additional back or neck support for a child (depending on the size of the child). The neck support 180 may also be folded back away from the wearer to reduce the height of the carrier (e.g., for non-infant children). The neck support 180 may also be folded down toward the wearer such that it may reside inside the child carrying area to give an infant or other child additional head or neck support. The size, shape and position of neck support 180 can be selected so that neck support 180 will fit behind and support the average infant's neck when neck support 180 is folded into the carrier.

Complementary extended position securing mechanisms and complementary non-extended position securing mechanisms such as, but not limited to, buttons, snaps, d-rings and clips or hooks, patches of hook and loop material or other securing mechanism, can be provided so that adjustable neck support 180 can be secured in an extended position or folded back and secured in a non-extended position.

Figure 7A:
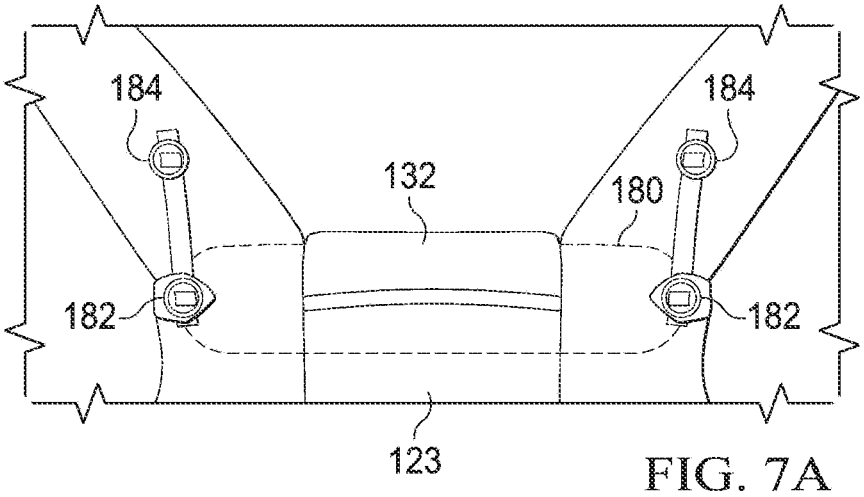
FIG. 7A is a diagrammatic representation of one embodiment of a carrier with a neck support in a first neck support configuration.
Figure 7B:
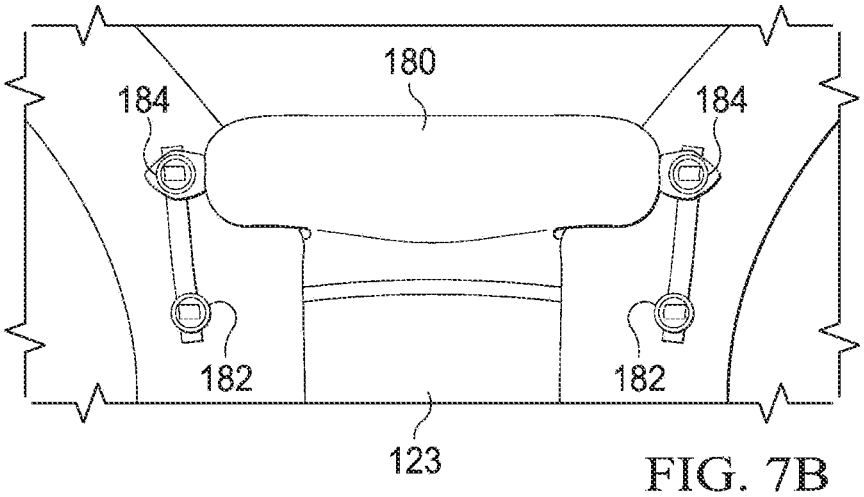
FIG. 7B is a diagrammatic representation of one embodiment of a carrier with a neck support in a second neck support configuration.
Figure 7C:
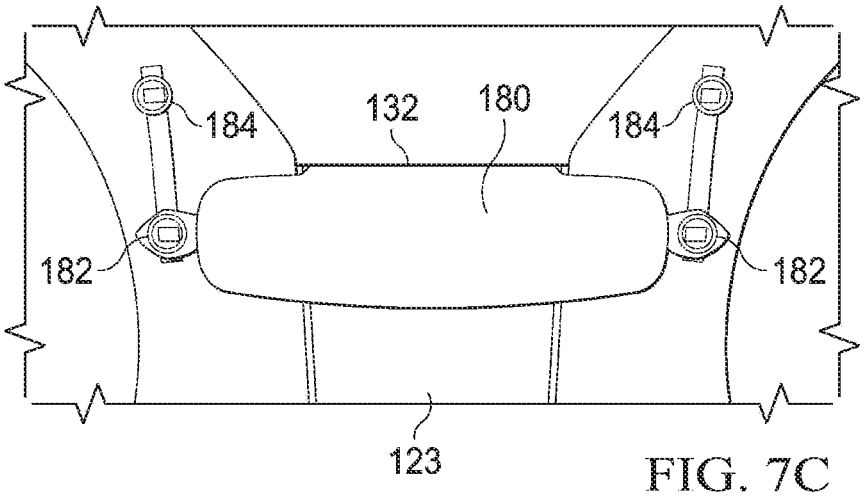
FIG. 7C is a diagrammatic representation of one embodiment of a carrier with a neck support in a third neck support configuration.

FIGS. 7A, 7B and 7C illustrate one embodiment of adjustable neck support 180 in an inside folded down configuration, an extended configuration and an outside folded down configuration respectively. In the inside folded down position of FIG. 7A, adjustable neck support 180 can be adapted to partially fill the inside of the carrying area of carrier 100 to give infants with insufficient head control more head and neck support (see also FIG. 6A). Adjustable neck support 180 can also be configured in the outside folded down configuration of FIG. 7B to provide additional volume in the carrier as the child grows (see also FIGS. 6B and 6C). Neck support 180 can be configured in the extended mode (flipped up) as illustrated in FIG. 7C to increase the center back length, giving additional back support for toddlers or head and neck support for non-infant babies. Neck support 180 may be positioned according to the size of the child, or other criteria.

According to one embodiment, adjustable neck support 180 may be joined to main body 110 proximate to top edge 132. The coupling may form a generally horizontal hinge that allows adjustable neck support 180 to flip over edge 132 from the inside folded down configuration to the outside folded down configuration. In the embodiment illustrated, adjustable neck support 180 may be secured in the inside folded down configuration and outside folded down configuration using first set of neck support fasteners 182 and may be secured in the extended configuration using a second set of neck support fasteners 184 located above the first set of neck support fasteners 182. Preferably, but not necessarily, the neck support fasteners are located on the outside of main body 110.

With reference again to FIG. 2, shoulder straps 190 can be configured to form a loop and attach on either side of the lateral centerline of carrier 100. In other embodiments, shoulder straps may be worn in an "x" configuration. Each shoulder strap 190 may connect to upper torso support portion 130 at one or more locations to pull upper torso support portion 130 toward the wearer. A shoulder strap may also couple to main body 110 of carrier 100 above thigh support areas 140 or other portion of carrier 100 on the same side, or an opposite side, of the centerline where the shoulder strap 190 is coupled to the upper torso support portion 130. Shoulder straps 190 may be adjustable and, in some cases, can be re-configured to support multiple carrier positions, such as a front carry, side carry position (hip carry) or back carry position.

Waist belt 115 may have a lumbar support portion 119 and be configured to rest on the wearer's hips. Preferably, the harness is configured so that the child's weight is evenly distributed to the wearer's hips and shoulders and even more preferably such that the child's weight is distributed evenly to the wearer's hips and shoulders and in some cases primarily to the wearer's hips rather than shoulders. In some cases, 70 percent or more of the child's weight can be distributed to the wearer's hips through waist belt 115, thereby promoting wearer comfort and diminishing wearer fatigue.

In accordance with one aspect of the present disclosure, carrier 100 can be a soft structured carrier that incorporates padding, stitching and fabrics to provide structure. Main body 110, including upper torso support portion 130, bucket seat portion 120, thigh supports 140 and thigh width adjusters 150 can be flexible and can be formed primarily of natural or synthetic fibers without a rigid frame. As would be understood by a person of ordinary skill in the art, however, some components, such as buckles, fasteners, etc. of a soft structured carrier may be formed of hard plastics, metals and the like.

Carrier 100 may include one or more panels formed from a single piece of material or multiple pieces of material, multiple layers of materials, or multiple materials. For example, in some embodiments, upper torso support portion 130 may be formed with an inner layer selected for comfort against a child's skin and an outer layer selected for breathability, fashion, stain resistance, etc. Upper torso support portion 130 may have straight edges, tapered edges for an area of increased width or decreased width, or otherwise configured for comfort or security of a child or a user. Similarly, bucket seat portion 120 may include one or more panels formed from a single piece of material, or may be formed from multiple pieces of material, multiple layers of materials, or multiple materials. The junction between upper torso support portion 130 and bucket seat portion 120 may be a substantially seamless transition. In one embodiment, the center of upper torso support portion 130 and center of bucket seat portion 120 may be formed from a unitary center panel 123 (of one or more layers) attached to side panels that form the laterally outer portions of upper torso support portion 130 and thigh support areas 140. Inner layers may be selected for comfort against a child's skin and outer layers selected for breathability, fashion, stain resistance, etc. In some embodiments, the center portion may be selected for comfort and lateral portions selected for breathability, security, etc.

Figure 9:
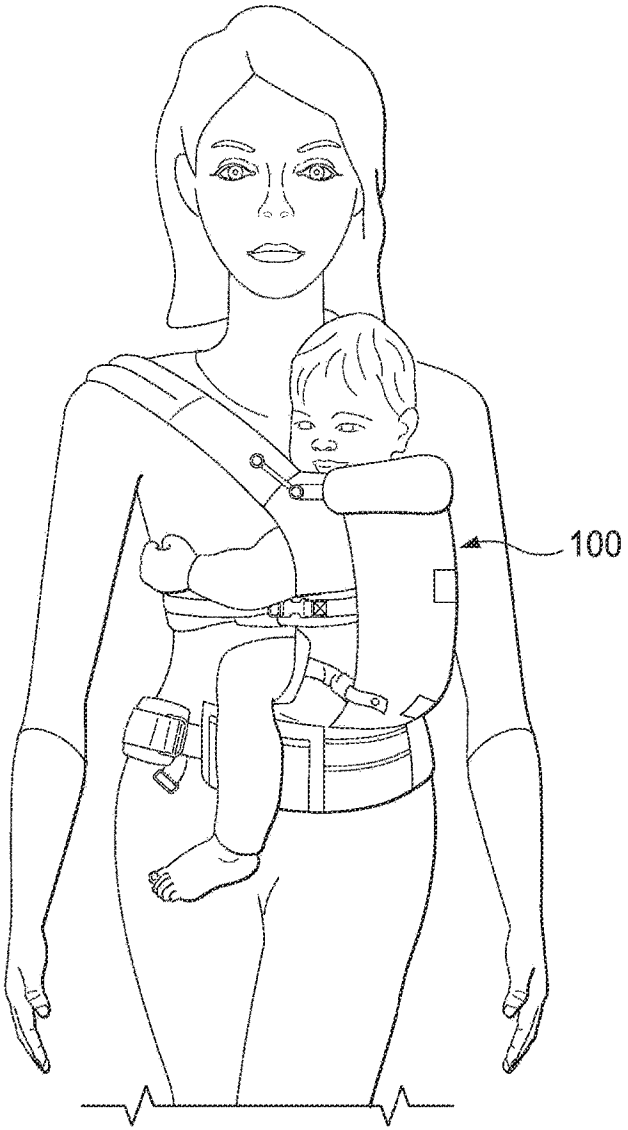
FIG. 9 is a diagrammatic representation of one embodiment of a wearer wearing a carrier in a side carry configuration.
Figure 8:
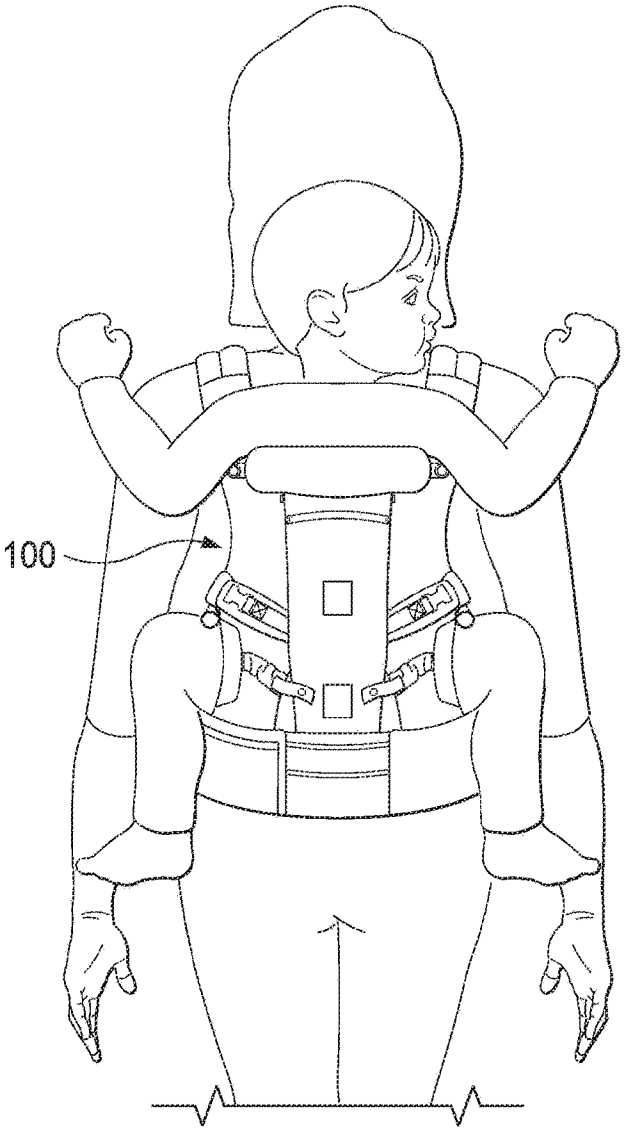
FIG. 8 is a diagrammatic representation of one embodiment of a wearer wearing a carrier in a back carry position.

It can be noted that carrier 100 may support a number of carrying positions. FIG. 1, for example, is a diagrammatic representation of one embodiment of an adult wearer carrying a child in an inward facing front carry position. FIG. 8 is a diagrammatic representation of one embodiment of an adult wearer carrying a child in carrier 100 in an inward facing back wearing configuration. FIG. 9 is a diagrammatic representation of one embodiment of an adult wearer carrying a child in carrier 100 in a side (hip) wearing configuration.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present). As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural). Also, as used in the description herein and throughout the meaning of "in" includes "in" and "on" unless the context clearly dictates otherwise.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations include, but is not limited to: "for example," "for instance," "e.g.," "in one embodiment."

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/Figures should be considered only as exemplary, and not limiting, unless otherwise specifically noted.

The representative embodiments, which have been described in detail herein, have been presented by way of example and not by way of limitation. It will be understood by those skilled in the art that various changes may be made in the form and details of the described embodiments resulting in equivalent embodiments that remain within the scope of the appended claims.

The invention claimed is:

1. An adjustable child carrier, the adjustable child carrier comprising:

a body configured to support a child, wherein the body is adapted to form a child carrying area in cooperation with a torso of a wearer, wherein the body forms a bucket seat configured to support legs of the child;

a first shoulder strap coupled to the body and configured to extend over a first shoulder of the wearer;

a second shoulder strap coupled to the body and configured to extend over a second shoulder of the wearer;

a waist belt coupled to the body and adapted for securing about a wearer's hips, wherein the waist belt defines a first setting, a second setting, and a third setting; and at least one base width adjuster coupled to the body, the at least one base width adjuster positioned on an outer side of the body such that the at least one base width adjuster faces away from the wearer, wherein selectively attaching the at least one base width adjuster to the first setting, the second setting, or the third setting simultaneously adjusts both a width of the bucket seat and a length of the body to accommodate various sizes of the child as the child ages, wherein the length of the body is defined from a bottom of the bucket seat to a top of the body.

2. The adjustable child carrier of claim 1, wherein the first shoulder strap comprises a first attachment for securing a neck support to the first shoulder strap, wherein the second shoulder strap comprises a second attachment for securing the neck support to the second shoulder strap.

3. The adjustable child carrier of claim 2, wherein the neck support is configured in an outside folded down position when the neck support is secured to the first attachment and the second attachment.

4. The adjustable child carrier of claim 1, wherein the at least one base width adjuster comprises a plurality of hooks, wherein the first setting, the second setting, and the third setting comprises a plurality of loops, and wherein selectively attaching the at least one base width adjuster to the first setting, the second setting, or the third setting fastens the plurality of hooks to the plurality of loops comprised on the first setting, the second setting, or the third setting to thereby form a hook and loop fastening mechanism.

5. The adjustable child carrier of claim 1, wherein the first setting is at least partially laterally displaced from the second setting, the second setting is at least partially laterally displaced from the third setting, and the first setting is at least partially laterally displaced from the third setting, wherein the first setting is at least partially vertically displaced from the second setting, the second setting is at least partially vertically displaced from the third setting, and the first setting is at least partially vertically displaced from the third setting, and wherein the waist belt defines the second setting between the first setting and the third setting.

6. The adjustable child carrier of claim 1, wherein selectively attaching the at least one base width adjuster at the first setting adjusts the length of the body to a first length and the width of the bucket seat to a first width, wherein selectively attaching the at least one base width adjuster at the second setting adjusts the length of the body to a second length greater than the first length and the width of the bucket seat to a second width greater than the first width, wherein selectively attaching the at least one base width adjuster at the third setting adjusts the length of the body to a third length greater than the second length and the width of the bucket seat to a third width greater than the second width.

7. The adjustable child carrier of claim 6, wherein adjusting the length of the body to the first length and the width of the bucket seat to the first width configures the adjustable child carrier in an infant mode, wherein, in the infant mode, the adjustable child carrier is capable of carrying the child when a height of the child is within a range of 20-24 inches.

8. The adjustable child carrier of claim 7, wherein adjusting the length of the body to the third length and the width of the bucket seat to the third width configures the adjustable child carrier in a toddler mode, wherein, in the toddler mode, the adjustable child carrier is capable of carrying the child when the height of the child is greater than 28 inches.

9. The adjustable child carrier of claim 1, wherein each of the first setting, the second setting, and the third setting is a discrete location on the waist belt at which the wearer selectively attaches the at least one base width adjuster.

10. The adjustable child carrier of claim 1, wherein each of the first setting, the second setting, and the third setting is visible to the wearer for the selective attachment of the at least one base width adjuster.

11. An adjustable child carrier for supporting a child by a user, the adjustable child carrier comprising:

a body configured to support the child between the body and a torso of the user, wherein the body forms a bucket seat configured to support legs of the child;

a first shoulder strap coupled to the body and configured to extend over a first shoulder of the user;

a second shoulder strap coupled to the body and configured to extend over a second shoulder of the user;

a waist belt coupled to the body and adapted for securing about hips of the user, wherein the waist belt comprises a fastening mechanism, the fastening mechanism defining a first position, a second position, and a third position, wherein the first position corresponds to a first setting, the second position corresponds to a second setting, and the third position corresponds to a third setting; and at least one base width adjuster coupled to the body, the at least one base width adjuster positioned on an outer side of the body such that the at least one base width adjuster faces away from the user, wherein adjustment of the at least one base width adjuster among the first position, the second position, and the third position simultaneously adjusts a length of the body and a width of the bucket seat to configure the adjustable child carrier to one of the first setting, the second setting, or the third setting, the length defined from a bottom of the bucket seat to a top of the body.

12. The adjustable child carrier of claim 11, wherein the first shoulder strap and the second shoulder strap are configured to form an X configuration on the user's back when the first shoulder strap extends over the first shoulder and the second shoulder strap extends over the second shoulder of the user, wherein, in the X configuration, at least a portion of the first shoulder strap crosses over at least a portion of the second shoulder strap.

13. The adjustable child carrier of claim 11, wherein the waist belt cooperates with the first shoulder strap and the second shoulder strap to form a harness, the harness configured to position the adjustable child carrier in a front inward facing configuration, side inward facing configuration, and a rear inward facing configuration.

14. The adjustable child carrier of claim 11, wherein adjustment of the at least one base width adjuster among the first position, the second position, and the third position comprises selectively attaching the at least one base width adjuster to the first position, the second position, or the third position defined by the fastening mechanism, wherein the at least one base width adjuster attaches to the first position, the second position, or the third position through a hook and loop fastener.

15. The adjustable child carrier of claim 11, wherein the first position is at least partially laterally displaced from the second position, the second position is at least partially laterally displaced from the third position, and the first position is at least partially laterally displaced from the third position, wherein the first position is at least partially vertically displaced from the second position, the second position is at least partially vertically displaced from the third position, and the first position is at least partially vertically displaced from the third position, and wherein the fastening mechanism defines the second position between the first position and the third position.

16. The adjustable child carrier of claim 11, wherein adjustment of the at least one base width adjuster from the first position to the second position adjusts the length of the body from a first length to a second length and the width of the bucket seat from a first width to a second width, the second length being greater than the first length and the second width being greater than the first width, wherein adjustment of the at least one base width adjuster from the second position to the third position adjusts the length of the body from the second length to a third length and the width of the bucket seat from the second width to a third width, the third length being greater than the first length and the second length and the third width being greater than the first width and the second width.

17. The adjustable child carrier of claim 16, wherein adjusting the length of the body to the first length and the width of the bucket seat to the first width configures the adjustable child carrier in an infant mode, wherein, in the infant mode, the adjustable child carrier is capable of carrying the child when a height of the child is within a range of 20-24 inches.

18. The adjustable child carrier of claim 17, wherein adjusting the length of the body to the third length and the width of the bucket seat to the third width configures the adjustable child carrier in a toddler mode, wherein, in the toddler mode, the adjustable child carrier is capable of carrying the child when the height of the child is greater than 28 inches.

19. The adjustable child carrier of claim 11, wherein each of the first position, the second position, and the third position is a discrete location on the fastening mechanism at which the user adjusts the at least one base width adjuster to the first setting, the second setting, or the third setting.

20. The adjustable child carrier of claim 11, wherein each of the first position, the second position, and the third position is visible to the user for the adjustment of the at least one base width adjuster.

21. An adjustable child carrier, the adjustable child carrier comprising:

a body configured to support a child, wherein the body is adapted to form a child carrying area in cooperation with a torso of a wearer, wherein the body forms a bucket seat configured to support legs of the child;

a first shoulder strap coupled to the body and configured to extend over a first shoulder of the wearer;

a second shoulder strap coupled to the body and configured to extend over a second shoulder of the wearer;

a waist belt coupled to the body and adapted to secure about hips of the wearer, wherein the waist belt defines a pair of first settings, a pair of second settings, and a pair of third settings; and a pair of base width adjusters coupled to the body, the pair of base width adjusters positioned on an outer side of the body such that the pair of base width adjusters face away from the wearer, wherein selective attachment of the pair of base width adjusters to the pair of first settings, the pair of second settings, or the pair of third settings simultaneously adjusts a length of the body and a width of the bucket seat to accommodate various sizes of the child as the child ages, the length defined from a bottom of the bucket seat to a top of the body.

22. The adjustable child carrier of claim 21, wherein the pair of base width adjusters comprises a first base width adjuster and a second base width adjuster, wherein selective attachment of the pair of base width adjusters at the pair of first settings positions the first base width adjuster at a first distance from the second base width adjuster such that the first base width adjuster is proximate the second base width adjuster.

23. The adjustable child carrier of claim 22, wherein selective attachment of the pair of base width adjusters at the pair of second settings positions the first base width adjuster at a second distance from the second base width adjuster, the second distance being greater than the first distance, and wherein selective attachment of the pair of base width adjusters at the pair of third settings positions the first base width adjuster at a third distance from the second base width adjuster, the third distance being greater than the second distance.

24. The adjustable child carrier of claim 21, wherein the pair of first settings is at least partially laterally displaced from the pair of second settings, the pair of second settings is at least partially laterally displaced from the pair of third settings, and the pair of first settings is at least partially laterally displaced from the pair of third settings, wherein the pair of first settings is at least partially vertically displaced from the pair of second settings, the pair of second settings is at least partially vertically displaced from the pair of third settings, and the pair of first settings is at least partially vertically displaced from the pair of third settings, and wherein the waist belt defines the pair of second settings between the pair of first settings and the pair of third settings.

25. The adjustable child carrier of claim 21, wherein selectively attaching the pair of base width adjusters at the pair of first settings adjusts the length of the body to a first length and the width of the bucket seat to a first width, wherein selectively attaching the pair of base width adjusters at the pair of second settings adjusts the length of the body to a second length greater than the first length and a second width greater than the first width, wherein selectively attaching the pair of base width adjusters at the pair of third settings adjusts the length of the body to a third length greater than the second length and a third width greater than the second width.

26. The adjustable child carrier of claim 25, wherein adjusting the length of the body to the first length and the width of the bucket seat to the first width configures the adjustable child carrier in an infant mode, wherein, in the infant mode, the adjustable child carrier is capable of carrying the child when a height of the child is within a range of 20-24 inches.

27. The adjustable child carrier of claim 26, wherein adjusting the length of the body to the third length and the width of the bucket seat to the third width configures the adjustable child carrier in a toddler mode, wherein, in the toddler mode, the adjustable child carrier is capable of carrying the child when the height of the child is greater than 28 inches.

28. The adjustable child carrier of claim 21, wherein each of the pair of first settings, the pair of second settings, and the pair of third settings is visible to the wearer for the selective attachment of the pair of base width adjusters.

29. The adjustable child carrier of claim 21, wherein the first shoulder strap and the second shoulder strap are configured to form an X configuration on the wearer's back when the first shoulder strap extends over the first shoulder of the wearer and the second shoulder strap extends over the second shoulder of the wearer, wherein, in the X configuration, at least a portion of the first shoulder strap crosses over at least a portion of the second shoulder strap.

30. The adjustable child carrier of claim 21, wherein the waist belt cooperates with the first shoulder strap and the second shoulder strap to form a harness, the harness configured to position the adjustable child carrier in a front inward facing configuration, a side inward facing configuration, and a rear inward facing configuration.

* * * * *